US007249802B2

(12) United States Patent
Schmitz et al.

(10) Patent No.: US 7,249,802 B2
(45) Date of Patent: Jul. 31, 2007

(54) BACK SUPPORT STRUCTURE

(75) Inventors: Johann Burkhard Schmitz, Berlin (DE); Claudia Plikat, Berlin (DE); Nicolai Neubert, Berlin (DE); Carola E. M. Zwick, Berlin (DE); Roland R. O. Zwick, Berlin (DE); Chad D. Aerts, Grand Haven, MI (US); John F. Aldrich, Grandville, MI (US); Christopher C. Hill, Holland, MI (US); Shane M. Ramsdell, Lowell, MI (US); James D. Slagh, Holland, MI (US); Douglas M. VanDeRiet, Holland, MI (US)

(73) Assignee: Herman Miller, Inc., Zeeland, MI (US)

( * ) Notice: Subject to any disclaimer, the term of this patent is extended or adjusted under 35 U.S.C. 154(b) by 434 days.

(21) Appl. No.: 10/365,682

(22) Filed: Feb. 12, 2003

(65) Prior Publication Data

US 2003/0178882 A1 Sep. 25, 2003

Related U.S. Application Data

(60) Provisional application No. 60/418,578, filed on Oct. 15, 2002, provisional application No. 60/356,478, filed on Feb. 13, 2002.

(51) Int. Cl.
*A47C 7/40* (2006.01)

(52) U.S. Cl. ..... 297/452.31; 297/284.4; 297/452.46

(58) Field of Classification Search ..... 297/452.29, 297/452.3, 452.31, 284.4, 452.46, 452.47
See application file for complete search history.

(56) References Cited

U.S. PATENT DOCUMENTS 2,549,902 A 4/1951 Hibbard et al.

(Continued)

FOREIGN PATENT DOCUMENTS

CA 1315186 3/1993

(Continued)

OTHER PUBLICATIONS

Digital image of "Ypsilon" by Vitra, date unknown.

(Continued)

*Primary Examiner*—Anthony D. Barfield
(74) *Attorney, Agent, or Firm*—Brinks Hofer Gilson & Lione

(57) ABSTRACT

A tiltable chair including a housing, a back support pivotally attached to the housing about a first horizontal axis and a seat support pivotally attached to the back support about a second horizontal axis and moveably supported by a curved track formed on the housing. A leaf spring includes a first end supported by the housing and a second end biasing the back support and seat support in an upward direction. Preferably, a fulcrum member, which includes a support surface having a curvilinear contour, is moveably supported in the housing and engages a bottom surface of the spring intermediate the first and second ends of the spring. Preferably, a linkage mechanism including a first and second link is adapted to adjust the position of the fulcrum. In another preferred embodiment, a gear housing is removably disposed in said housing and coupled to the fulcrum. In one preferred embodiment, rearward and forward tilt limiters are provided. In various preferred embodiments, the chair further includes a backrest having a plurality of openings, and armrests that are vertically, laterally and pivotally adjustable. In a preferred embodiment, a kit for assembling a seating structure includes a tilt housing having a plurality of connector arrangements comprising at least a first and second connector arrangement, a first seating arrangement having a first mounting arrangement configured to be connected to the first connector arrangement, and a second seating arrangement having a second mounting arrangement configured to be connected to the second connector arrangement.

21 Claims, 45 Drawing Sheets

U.S. PATENT DOCUMENTS 3,059,919 A 10/1962 Marchino
D201,355 S 6/1965 Cavalli
3,198,578 A 8/1965 Geoffrey et al.
3,720,568 A 3/1973 Rowland
3,762,769 A 10/1973 Poschl
3,767,261 A 10/1973 Rowland
4,368,917 A 1/1983 Urai
4,418,958 A 12/1983 Watkin
4,502,728 A 3/1985 Sheldon et al.
4,541,670 A 9/1985 Morgenstern et al.
4,556,254 A 12/1985 Roberts
4,576,351 A 3/1986 Brink
4,695,096 A 9/1987 Kincaid
4,722,569 A 2/1988 Morgenstern et al.
4,915,448 A 4/1990 Morgenstern
4,961,610 A 10/1990 Reeder et al.
4,993,164 A 2/1991 Jacobsen
5,018,786 A 5/1991 Goldstein et al.
5,143,422 A 9/1992 Althofer et al.
5,344,211 A 9/1994 Adat et al.
5,368,365 A 11/1994 Feldberg
D355,534 S 2/1995 Saotome
5,393,124 A 2/1995 Neil
5,415,459 A 5/1995 Schultz
5,460,427 A 10/1995 Serber
5,484,187 A 1/1996 Doerner et al.
5,486,035 A 1/1996 Koepke et al.
5,487,591 A 1/1996 Knoblock
5,518,294 A 5/1996 Ligon, Sr. et al.
5,553,917 A 9/1996 Adat et al.
5,567,010 A 10/1996 Sparks
5,590,934 A 1/1997 Gibbs
5,599,067 A 2/1997 Schuelke et al.
5,624,158 A 4/1997 Adat et al.
5,630,647 A 5/1997 Heidmann et al.
5,641,203 A 6/1997 Van De Riet et al.
5,647,638 A 7/1997 Ritt et al.
5,651,586 A 7/1997 Groth
5,655,814 A 8/1997 Gibbs
5,664,841 A 9/1997 Dal Monte
5,685,606 A 11/1997 Lance
D390,712 S 2/1998 Koepke et al.
5,718,476 A 2/1998 De Pascal et al.
5,749,628 A 5/1998 Snyder et al.
5,791,733 A 8/1998 Van Hekken et al.
5,795,026 A 8/1998 Dral et al.
5,797,652 A 8/1998 Darbyshire
5,848,823 A 12/1998 Su
5,853,223 A 12/1998 Ritt et al.
5,860,700 A 1/1999 Lance
5,868,466 A 2/1999 Massara et al.
5,871,256 A 2/1999 Kogai
5,876,097 A 3/1999 Cao
D407,911 S 4/1999 Bräuning
5,895,095 A 4/1999 Chen
5,904,400 A 5/1999 Wei
5,909,923 A 6/1999 DeKraker
5,913,569 A 6/1999 Klingler
5,927,811 A 7/1999 Tseng
5,934,758 A 8/1999 Ritch et al.
5,944,386 A 8/1999 Yamagishi et al.
D414,349 S 9/1999 Jenkins et al.
5,975,632 A 11/1999 Ginat
5,984,408 A 11/1999 Bujaryn
D418,316 S 1/2000 Vogtherr
6,017,091 A 1/2000 Cao
6,030,041 A 2/2000 Hsiao
6,053,578 A 4/2000 Van Hekken et al.
6,053,579 A 4/2000 Nelson et al.
D424,824 S 5/2000 Chu
6,059,362 A 5/2000 Lin
6,062,649 A 5/2000 Nagel et al.
6,079,785 A 6/2000 Peterson et al.
6,099,076 A 8/2000 Nagel et al.
6,109,694 A 8/2000 Kurtz
6,125,521 A 10/2000 Stumpf et al.
6,129,419 A 10/2000 Neale
D434,918 S 12/2000 Arko et al.
6,179,384 B1 1/2001 DeKraker et al.
D437,701 S 2/2001 Bellini et al.
6,189,971 B1 2/2001 Witzig
D442,790 S 5/2001 Simons, Jr. et al.
D442,791 S 5/2001 Simons, Jr. et al.
D444,309 S 7/2001 Nagamitsu
D444,955 S 7/2001 Su
6,254,186 B1 7/2001 Falzon
6,260,921 B1 7/2001 Chu et al.
D449,174 S 10/2001 Neil
D453,633 S 2/2002 Diffrient
6,378,942 B1 4/2002 Chu
D456,650 S 5/2002 Ball et al.
D457,023 S 5/2002 Ball et al.
D460,869 S 7/2002 Koepke et al.
6,419,318 B1 7/2002 Albright
D461,661 S 8/2002 Koepke et al.
6,439,661 B1 8/2002 Bräuning
D462,187 S 9/2002 Koepke et al.
6,471,294 B1 10/2002 Dammermann et al.
6,523,898 B1 2/2003 Ball et al.
D471,042 S 3/2003 Schmitz et al.
D471,370 S 3/2003 Schmitz et al.
D474,346 S 5/2003 Saylor et al.
6,557,938 B1 5/2003 Long
6,568,760 B2 5/2003 Davis et al.
6,572,190 B2 6/2003 Koepke et al.
6,598,251 B2 7/2003 Habboub et al.
6,626,494 B2 9/2003 Yoo
6,669,301 B1 12/2003 Funk et al.
6,688,687 B2 2/2004 Chu
6,688,690 B2 2/2004 Watson et al.
6,698,833 B2 3/2004 Ball et al.
6,709,058 B1 3/2004 Diffrient
6,755,467 B1 6/2004 Chu
D494,792 S 8/2004 Schmitz et al.
6,908,159 B2 6/2005 Prince et al.
6,913,315 B2 7/2005 Ball et al.
2001/0030457 A1 10/2001 Gregory
2002/0043841 A1 4/2002 Giacinto
2002/0060492 A1 5/2002 Nagamitsu et al.
2002/0096920 A1 7/2002 Watson et al.
2002/0190564 A1 12/2002 Coffield et al.
2003/0001425 A1 1/2003 Koepke et al.
2004/0124679 A1 7/2004 Teppo et al.

FOREIGN PATENT DOCUMENTS

DE 201 00 569 U1 4/2001
EP 0 154 582 A3 9/1985
FR 2 267 726 A1 4/1974
GB 2 165 445 A 9/1985
WO WO 93/25121 12/1993
WO WO 00/22961 4/2000
WO WO 00/74531 A3 12/2000

OTHER PUBLICATIONS

Digital image of "Project 2000" by Sitag, date unknown.
Digital image of "Fluid" by allseating, date unknown.
Digital image of "HAG H05" by HAG, date unknown.
Digital image of "Konca" by Kastel, date unknown.
Digital image of "Vigor"/ Topdeq, date unknown.
Digital image of "NetWeb"/Topdeq, date unknown.
Digital image of "Lucy" by Vecta, date unknown.
Digital image of "Open up"/Cairo, date unknown.
Digital image of "IB Office" Seating by Bieffe, date unknown.

Digital image of "Freedom" by Humanscale, date unknown.
Digital image of "Cordo" by Klöber, date unknown.
Copy of Digital images of "Please" by Steelcase, date unknown.
"X99 Haworth®" brochure, date unknown.
"Ypsilon vitra." brochure, date unknown.
Izzydesign "Maxwell" brochure, date unknown.
Search Report from Great Britain Application No. GB 0414694.0, dated Sep. 1, 2005, 1 page.

29
30
336
342
360
358
340
362
356
354
366
346
344
348
338
352
350
364
329

78
74
716
88
714
734
726
720
728
718
722
724
710
708
706
24
732
87
730
712
83
704
84
86
706
710

303
303
1300
1306
1304
1318
1300
1308
1316
1328
1302
1320
1314
1344
824
1336
1338
1330
826
820
823
1336
332
330
332
330
324
326
328
1320
1302
90
1314
1328
1326
90
1318
1316
1322
1324
1322
350
302

BACK SUPPORT STRUCTURE

This application claims the benefit of U.S. Provisional Application No. 60/418,578, filed Oct. 15, 2002 and U.S. Provisional Application No. 60/356,478, filed Feb. 13, 2002, the entire disclosures of which are hereby incorporated herein by reference.

BACKGROUND

The present invention relates generally to tiltable chairs, and in particular, to a tilt chair having a flexible back, adjustable armrests, and an adjustable seat depth, and methods for using and/or adjusting the chair, including one or more of the seat, backrest and armrests.

Chairs of the type typically used in offices and the like are usually configured to allow tilting of the seat and backrest as a unit, or to permit tilting of the backrest relative to the seat. In chairs having a backrest pivotally attached to a seat in a conventional manner, the movement of the backrest relative to the seat can create shear forces which act on the legs and back of the user, and which can also create an uncomfortable pulling of the user's shirt, commonly called "shirt-pull."

To enhance the user's comfort and to promote ergonomically healthy seating, synchro-tilt chairs provide for the seat and backrest to tilt simultaneously, but at different rates, preferably with the back tilting at a greater rate than the seat. In general, synchro-tilt chairs are usually configured as a four-bar linkage or as a three-bar, slide linkage. In a three-bar, slide configuration, the sliding path is typically linear. Such chairs often have a multiplicity of components and parts that can be difficult and time consuming to assemble and which require multiple fasteners or joints to connect the components.

In addition, synchro-tilt chairs normally employ compression and/or tension springs, torsion springs and/or torsion bars, or leaf springs to bias the seat and back upwardly and to counterbalance the rearward tilting of the user. Chairs using these types of springs can have various limitations associated with the type of spring used therein as explained in U.S. Pat. No. 6,250,715, entitled Chair, and assigned to Herman Miller, Inc., the entire disclosure of which is hereby incorporated herein by reference. In addition, the mechanisms used to adjust the load on the spring(s), or the load capability of the spring(s), typically are complicated, and/or require multiple, excessive rotations of a knob or other grippable member to obtain the desired setting.

It is also desirable to provide a chair that can be adjusted to accommodate the various needs and sizes of the user. For example, it is often desirable to provide a chair having adjustable armrests and an adjustable seat depth. For example, armrests can be provided with vertical adjustment capabilities, lateral adjustment capabilities and pivotable adjustment capabilities about a vertical axis. Often, however, armrests fail to provide such capabilities in combination, and/or employ complex, moving parts and assemblies that can be expensive to manufacture and assemble and difficult to use. Moreover, armrests having vertical adjustment capabilities often employ a support member that extends vertically down along the side of the chair, where the armrest or support member can interfere with the user's legs and other objects as the user moves about in the chair. In addition, the range of adjustment is typically limited to the length of the support member. However, the longer the support member, or the further it extends below the seating surface, the more likely it is to increase the foot print of the chair and interfere with the mobility of the chair.

Chairs with adjustable seat depths often employ devices and mechanisms to shift the entire seat in a forward and rearward direction relative to the backrest. Therefore, such chairs must provide for structure to allow the seat to move relative to the backrest while at the same time bearing the load of the seat and user. Moreover, such chairs typically must employ an extra support member which allows the seat to move thereon, for example, when the seat or support member are integrated into the linkage assembly.

Typically, backrests having a resilient and/or flexible material, whether a fabric, elastic membrane or plastic mat, are often supported by a peripheral frame, which surrounds the material. Such construction, however, does not ordinarily permit flexing of the material at the periphery of the backrest, or allow for torsional movement of the backrest. In addition, even in those chairs that employ a resilient material, the material often has uniform mechanical and physical properties across the entire portion of the material.

Finally, as disclosed for example in U.S. Pat. No. 5,873,634 to Heidmann et al., it is known to connect different seating arrangements to a control housing. However, Heidmann discloses connecting different seating arrangements to a tilt control housing and back support at common connection points. Accordingly, the overall kinematics of the chair cannot be altered or varied, but rather are predetermined by the common connection points. In such a device, only localized adjustments within each seating arrangement can be varied between the different seating arrangements.

SUMMARY

The present inventions are defined by the claims, and nothing in this section should be read as a limitation on those claims. Rather, by way of general introduction and briefly stated, various preferred embodiments are described that relate to a tiltable chair having a flexible back, adjustable armrests, an adjustable seat depth, various control mechanisms and linkage assemblies, and methods for the use of the various preferred aspects.

For example and without limitation, in one aspect, the preferred embodiments relate to an adjustable armrest, and the method for the use thereof. In one preferred embodiment, an armrest assembly for a seating structure includes a support member comprising an upwardly extending curved spine portion having a first defined curvature and a stem slidably disposed on the support member and comprising a curved portion having a second defined curvature corresponding to and mating with the first curvature of the spine portion. An armrest is preferably supported by the stem. A latch mechanism is moveable between at least an engaged position and a disengaged position, wherein the latch mechanism engages at least one of the stem and the support member to prevent movement therebetween when in the engaged position. The stem is moveable relative to the support member when the latch mechanism is in the disengaged position.

In another aspect, one preferred embodiment of the armrest assembly includes a support member, a stem slidably disposed on the support member, an armrest supported by the stem, a latch mechanism and an index member. The latch mechanism is moveable between at least an engaged position and a disengaged position. The latch mechanism engages at least one of the stem and the support member to prevent movement therebetween when in the engaged position. The stem is moveable relative to the support member when the latch mechanism is in the disengaged position. The index member selectively engages at least one of the support member and the stem when the latch mechanism is in the disengaged position as the stem is moved relative to the support member.

In yet another aspect, in one preferred embodiment, an armrest assembly comprises a platform and an armrest support moveably supported on the platform. The armrest support is moveable between at least a first position and a second position. A linear gear is disposed on one of the platform and the armrest support and extends in a substantially horizontal direction. A pinion gear is rotatably mounted on the other of the platform and the armrest support about a substantially vertical rotation axis. The pinion gear meshes with the linear gear as the armrest support is moved relative to the platform between at least the first and second positions.

In one preferred embodiment, the armrest assembly includes a pair of pinion gears meshing with each other and a pair of linear gears. Also in one preferred embodiment, one of the platform and the armrest support includes a guide member that moves in a track formed in the other thereof as the armrest support is moved relative to the platform. In one preferred embodiment, first and second guide members move in first and second tracks.

Various methods of using the various preferred embodiments of the armrest assemblies are also provided.

In another aspect, one preferred embodiment of a seating structure includes a primary seat support having a rear portion and a front portion and an auxiliary seat support having a rear portion and a front portion. The rear portion of the auxiliary seat support is connected to the front portion of the primary seat support. At least a portion of the auxiliary seat support is flexible, wherein the front portion of the auxiliary seat support is moveable between at least a first and second position relative to the rear portion of the auxiliary seat support as the flexible portion of the auxiliary seat support is flexed.

In one preferred embodiment, the seating structure includes a linkage assembly connecting the front portion of the auxiliary seat support and one of a housing, which supports the primary seat support, and the primary seat support. In one preferred embodiment, the linkage assembly includes first and second links.

In one preferred embodiment, the seating structure further includes a lock device releasably connected between the auxiliary seat support and one of the housing and primary seat support.

In one preferred embodiment, the seating structure comprises a seat support comprising a forward portion, a rear portion and opposite, laterally spaced sides. At least the forward portion is bendable about a substantially horizontal and laterally extending axis between at least a first and second position, wherein the forward portion has a greater curvature when in the second position compared with the first position. A lock device is moveable between at least an engaged position and a disengaged position, wherein the lock device maintains the seat support in at least one of the first and second positions when in the engaged position, and wherein the seat support is bendable between at least the first and second positions when the lock device is in the disengaged position.

Various methods for adjusting the depth of the seat, or the curvature of the front portion thereof, are also provided.

In another aspect, one preferred embodiment of a backrest for a seat structure comprises a frame member and a compliant, resilient back member having a top, a bottom and opposite sides. The back member is mounted to the frame member. The back member includes a lumbar region, a thoracic region disposed above the lumbar region, and a lower region disposed below the lumbar region. The lumbar region comprises a first array of openings formed therethrough, with the first array comprising a first plurality of staggered, elongated openings that are elongated in a direction from the top to the bottom of the back member. The thoracic region comprises a second array of openings formed therethrough, with the second array comprising a second plurality of staggered, elongated openings, which are elongated in a direction from the top to the bottom of the back member. The first plurality of openings has a greater elongation on average than the second plurality of openings.

In another preferred embodiment, a backrest for a seat structure includes a frame member comprising an upper support member and a lower support member spaced from the upper support member, with the upper support member having opposite shoulder portions. A fabric member having a front, body-supporting surface and a rear surface comprises at least one pocket that is received on the opposite shoulder portions. The fabric member is connected to the lower support member and extends in tension between the upper and lower support members. The fabric member comprises a central thoracic region that is free of contact on the rear surface thereof.

In another aspect, one preferred embodiment of a chair comprises a housing comprising a track having a curvilinear support surface formed within a vertical plane. A back support is pivotally connected to the housing about a first horizontal axis, and a seat support is pivotally connected to the back support about a second horizontal axis and is moveably supported on the support surface of the track.

In yet another aspect, the chair comprises a housing, a seat support supported by the housing, and at least one leaf spring comprising a first end supported by the housing and a second end biasing the seat support in an upward direction, wherein the at least one leaf spring flexes within a substantially vertical first plane. A fulcrum member is moveably supported by the housing and has a support surface engaging the at least one leaf spring between the first and second ends. The support surface is preferably not symmetrical about any laterally extending second vertical plane oriented substantially perpendicular to the first plane.

In yet another aspect, one preferred embodiment of a chair includes a fulcrum member having a curvilinear support surface engaging at least one leaf spring between a first and second end. Preferably, a tangent of any point along the support surface of the fulcrum slopes rearwardly and downwardly.

In yet another aspect, one preferred embodiment of a seating structure includes a linkage assembly comprising a first and second link pivotally connected to a housing about a first pivot axis. The first link is pivotally and slidably connected to a fulcrum at a second pivot axis spaced from the first pivot axis and the second link is pivotally and slidably connected to the fulcrum at a third pivot axis spaced from the first and second pivot axes. In one preferred embodiment, an actuator member pivotally engages the first and second links at pivot axes spaced from the first, second and third pivot axes. In various preferred embodiments, various tracks are formed in one of the links and the fulcrum member, the actuator member and various brackets. Guide members are formed on the other of the links and the fulcrum member, the actuator member and various brackets. In one preferred embodiment, certain of the tracks, preferably formed in the brackets, are curved.

In yet another aspect, one preferred embodiment of a seating structure includes a housing and a support member pivotally mounted to the housing. A tilt limiter member is moveably mounted to one of the housing and the support member, and a stop member is connected to the other of the support member and the housing. An actuator mechanism is coupled to one of the housing and the support member and includes a spring having a first and second arm, a drive link and a follower link. The drive link is pivotally mounted to one of the housing and the support member about a first axis and engages the first arm of the spring at a first location spaced from the first axis. The follower link is pivotally mounted to one of the housing and the support member about a second axis spaced from the first axis and engages the second arm of the spring at a second location spaced from the second axis. The follower link is pivotally coupled to the tilt limiter member.

In one preferred embodiment, the stop member has a downwardly facing stop surface and the tilt limiter has an upwardly facing bearing surface engaging the stop surface. In an alternative preferred embodiment, the stop member has at least one upwardly facing stop surface and the tilt limiter has a downwardly facing bearing surface engaging the at least one stop surface. In yet another preferred embodiment, the tilt limiter member comprises a first and second tilt limiter member moveably mounted to one of the housing and the support member, and the stop member comprises a first and second stop member connected to the other of the support member and the housing. The actuator mechanism comprises first and second springs each having a first and second arm, spaced apart first and second drive links each pivotally mounted to one of the housing and the support member about the first axis, and first and second follower links.

In another aspect, in one preferred embodiment, a kit for assembling a seating structure includes a tilt housing having a plurality of connector arrangements comprising at least a first and second connector arrangement, a first seating arrangement having a first mounting arrangement configured to be connected to the first connector arrangement, and a second seating arrangement having a second mounting arrangement configured to be connected to the second connector arrangement. In another aspect, a method of assembling a seating structure includes providing a tilt housing having a plurality of connector arrangements comprising at least a first and second connector arrangement, selecting one of a first and second seating arrangements, wherein the first seating arrangement includes a first mounting arrangement configured to be connected to the first connector arrangement, and wherein the second seating arrangement includes a second mounting arrangement configured to be connected to the second connector arrangement, and connecting the selected one of the first and second seating arrangements to the tilt housing.

In yet another aspect, the seating structure includes a tilt housing, a seating structure pivotally connected to the tilt housing and a biasing member applying a biasing force to the seating structure as the seating structure is pivoted relative to the tilt housing. An adjustment mechanism is operably connected to the biasing member and is operable to adjust the biasing force applied by the biasing member. The adjustment mechanism includes a gear housing removably disposed in the tilt housing. The gear housing is rotatably connected to the tilt housing about an axis. The gear housing includes first and second locator portions abutting the tilt housing. The first locator portion prevents the gear housing from moving relative to the tilt housing in a first direction. The second locator portion prevents the gear housing from rotating relative to the tilt housing about the axis.

In another aspect, a support member for a seating structure component includes a first support member having a first plurality of spaced apart fins and a second support member having a second plurality of spaced apart fins. The first support member is secured to the second support member with the first plurality of fins nested between the second plurality of fins. In one preferred embodiment, a back member is connected to at least one of the first and second support members.

In yet another aspect, a control device for an adjustable seating structure includes a first adjustment control positioned in an orientation approximating a seating member. The first adjustment control is moveable about a horizontal axis. A second adjustment control is positioned adjacent the first adjustment control in an orientation approximating a backrest member. The second adjustment control is moveable about the horizontal axis. The first adjustment control and the second adjustment control, in combination, generally resemble a seating structure. In one preferred embodiment, the first adjustment control and the second adjustment control are coupled to a forward tilt limiter and a rear tilt limiter respectively.

Various methods of assembling a tilt chair, and of using and adjusting a tilt chair having an adjustable fulcrum member and various tilt limiters also are provided. For example, various preferred embodiments of the seating structure include inserting an insert member into a pivot tube to deform or expand the tube so as to fixedly secure the tube to a wall or other structure. In addition, other preferred embodiments include inserting a pivot member having a key surface through a mouth of a bearing member and rotating the pivot member so as to locate the pivot member in the bearing member. In yet another preferred embodiment, a plurality of tilt housing components are disposed on an annular bushing and an end of the bushing is deformed to capture the components on the bushing.

The various preferred embodiments provide significant advantages over other tilt chairs and seating structures, including chairs and seating structures having adjustable armrests, backrests, seats and tilt controls. For example, in one preferred embodiment, an improved tilt control mechanism is provided. The resistive force of the leaf springs is easily and simply adjusted by moving the fulcrum member longitudinally within the housing. In one embodiment, a removable gear housing can be quickly easily installed without fasteners and the like for adjusting the fulcrum member. In another preferred embodiment, the configuration of the linkage assembly allows the user to quickly move the fulcrum over a wide range of longitudinal positions with minimal turns of the drive shaft. In addition, the unique shape of the support surface on the fulcrum provides a variable balancing spring rate, which results from an increasing amount of contact between the support surface and the spring as the user tilts rearwardly.

The three bar slide mechanism also provides several advantages. For example, the linkage provides for a synchrotilt chair wherein the back tilts at a greater rate than the seat, but avoids the use of a fourth bar, which can add to the complexity and manufacturing costs of the chair. Indeed, the overall design is greatly simplified by forming "bars" out of the housing, seat support and back support. Additionally, the use of a slide member allows for the assembly to be made in a more compact and aesthetically pleasing form.

The modular tilt housing also provides significant advantages. In particular, different seating arrangements can be mounted or connected to a single tilt housing with different connection configurations, thereby providing seating structures with different kinematics and appearances. At the same time, a single modular tilt housing provides significant savings and reductions in inventories. Indeed, completely different chairs operating on completely different kinematic principles can be assembled from a single tilt housing. The modular tilt housing can also be configured to support different actuation mechanisms at various mounting locations. The back support can also be configured as a modular member, wherein it is adapted to support and be coupled with different seat configurations at different connector locations, thereby providing additional flexibility in assembling different seating structures with different kinematics and appearances.

The preferred embodiments of the armrests also provide advantages. For example, the curved spine and stem provide maximum vertical adjustment, while maintaining a relatively open area beneath the seat. In addition, the height of the armrests can be adjusted quickly and easily, with the indexing member providing an audible signal to the user about the various available positions. Moreover the armrests can be laterally and pivotally adjusted quickly and easily, while the mechanism, with the interaction of gears, maintains a firm, robust feel to the user.

The preferred embodiments of the adjustable seat also provide advantages. For example, the depth of the seat can be adjusted without having to move the entire seat, or in other words, while maintaining a rear portion of the seat in the same position. Such construction avoids the need for additional support members. In addition, the adjustment mechanism can be easily grasped and manipulated the user to adjust the depth of the seat. Moreover the front portion of the seat, when bent downwardly, provides transitional support for the user's legs when sitting down or standing up from the chair.

The preferred embodiments of the tilt limiter controls also provide advantages. For example, in one embodiment, both of the forward and rearward tilt limiters are spring loaded, such that the position of each can be adjusted at any time, but with the limiter being moved only when the load is relieved from the chair. In another embodiment, the rear tilt limiter is supported by the tilt housing, which carries the load applied by the back support against the tilt limiter, which increases the overall robustness of the limiter without having to unnecessarily fortify the pivot connections of the tilt limiter. Moreover, an indexing feature provides the user with a distinct indication that an available setting has been achieved.

In addition, the orientation and/or shape of the adjustment controls provides indicia to the user about the functionality of the device or mechanism coupled to the control. For example, a first and second adjustment control can be oriented to generally resemble a seating structure, with each of the adjust controls being coupled to device or mechanism that controls the adjustment of the corresponding seating structure member, for example the seat or backrest.

The support member for a seating structure component having a first support member with a first plurality of spaced apart fins and a second support member with a second plurality of spaced apart fins also provides significant advantages. In particular, the first and second support members in combination provide substantial bending strength, yet provide torsional flexibility by way of the fins moving relative to each other. In this way, the support member, when used for example as a backrest spine, provides resistance to bending, but allows the backrest to flex torsionally about a longitudinal axis. In addition, the first and second support members can be configured to provide for the coupling of various back members and adjustment devices. For example, the first and second support members can be configured to define a gap therebetween to allow for an engagement member to be inserted therethrough wherein it can engage one of the first and second support members. In addition, the support members can be easily and cheaply manufactured by various molding processes.

The present invention, together with further objects and advantages, will be best understood by reference to the following detailed description taken in conjunction with the accompanying drawings.

DETAILED DESCRIPTION OF THE PRESENTLY PREFERRED EMBODIMENTS

General:

The terms "longitudinal" and "lateral" as used herein are intended to indicate the direction of the chair from front to back and from side to side, respectively. Similarly, the terms "front", "side", "back", "forwardly", "rearwardly", "upwardly" and "downwardly" as used herein are intended to indicate the various directions and portions of the chair as normally understood when viewed from the perspective of a user sitting in the chair.

Figure 11:
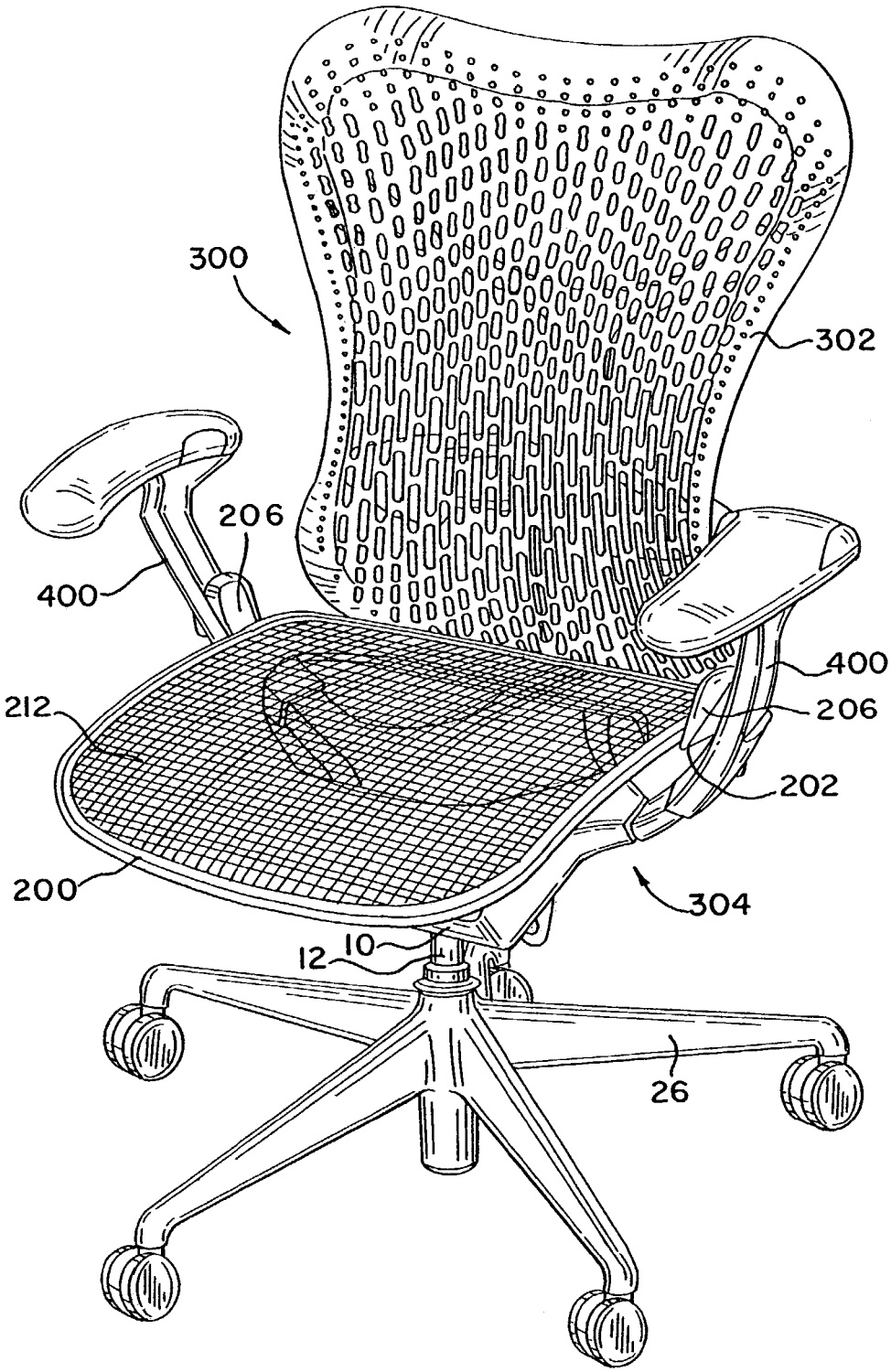
FIG. 11 is a perspective view of one preferred embodiment of a chair.
Figure 12:
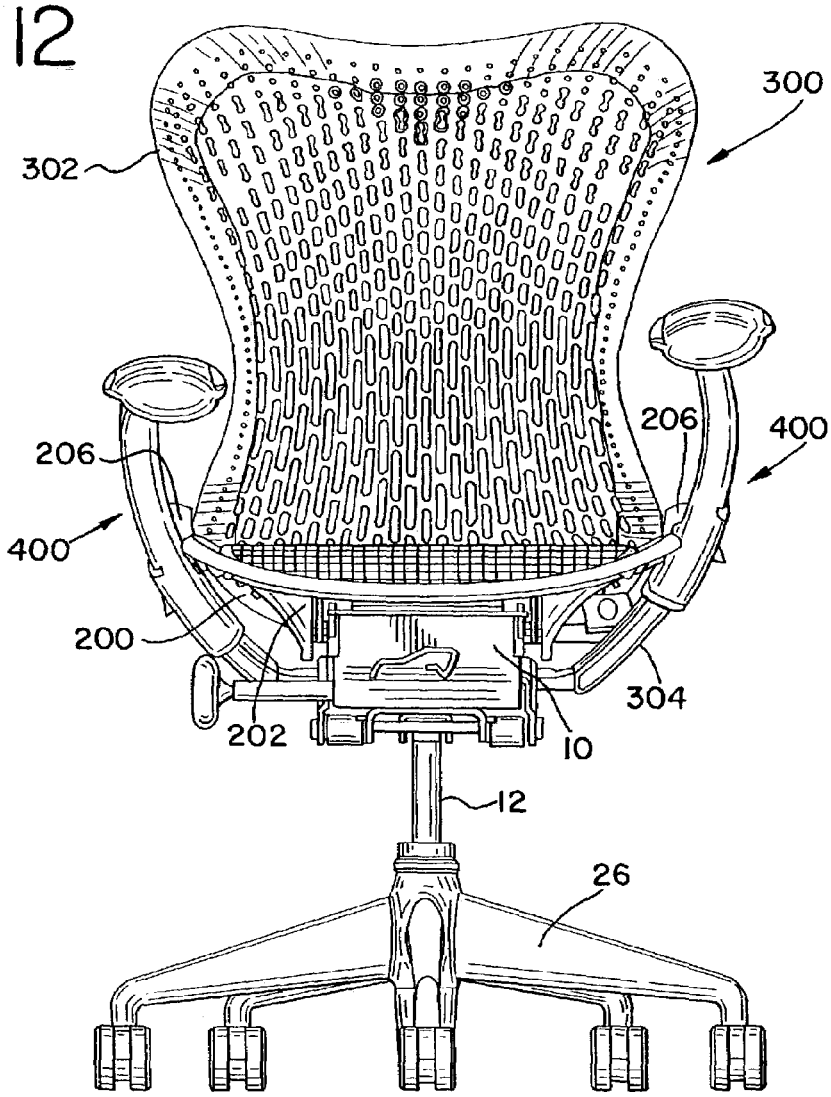
FIG. 12 is a front view of the chair shown in FIG. 11.

Referring to the drawings, FIGS. 11 and 12 show a preferred embodiment of the chair having tilt control housing 10, seat 200, back support 304 and back 302. It should be understood that the term "housing" generally refers to any support member that supports another member, and includes, but is not limited to a structure that provides an enclosure. A pair of armrests 400 extend from, move with and define a portion of the back support 304. Preferably, the back support 304 is pivotally mounted to the control housing 10, and the seat 200 is pivotally mounted to the back support 304 via a pivot axis located on the armrests 400 at the approximate hip joint of the user above the seating surface. The seat 200 is further slideably and pivotally supported by the tilt control housing.

It should be understood that the terms "mounted," "connected", "coupled," "supported by," and variations thereof, refer to two or more members or components that are joined, engaged or abutted, whether directly or indirectly, for example, by way of another component or member, and further that the two or more members, or intervening member(s) can be joined by being integrally formed, or by way of various fastening devices, including for example and without limitation, mechanical fasteners, adhesives, welding, press fit, bent-over tab members, etc.

In operation, the housing 10, seat 200 and back support 304, with the armrests 400, form a three-bar linkage with a slide. It should be understood that the term "slide," as used herein, refers to two members that translate relative to each other, whether by direct sliding or by rolling. Preferably, the pivot axis formed between the seat 200 and housing 10 is positioned forwardly of the pivot axis formed between the back support 304 and housing 10, which axis is positioned forwardly of the pivot axis formed between the back support 304 and the seat 200, such that the backrest 300 and back support 304 tilt rearwardly at a greater rate and angle than does the seat 200. Preferably, the back tilts relative to the seat at about a preferred 2:1 ratio, such that the shirt-tail pull effect is avoided. Of course, other synchrotilt ratios are contemplated and suitable. In addition, the configuration of the back support, the seat and the various positions of the pivot axes, allow the seat to pivot about the ankles of a user seated in the chair, preferably without the front edge of the seat rising as the user tilts rearwardly. The three-bar linkage provides a simple and compact mechanism that avoids the use of additional links. Additionally, by forming the linkage assembly from the seat, back support and housing, complex and expensive links and load bearing parts are avoided.

Figure 42:
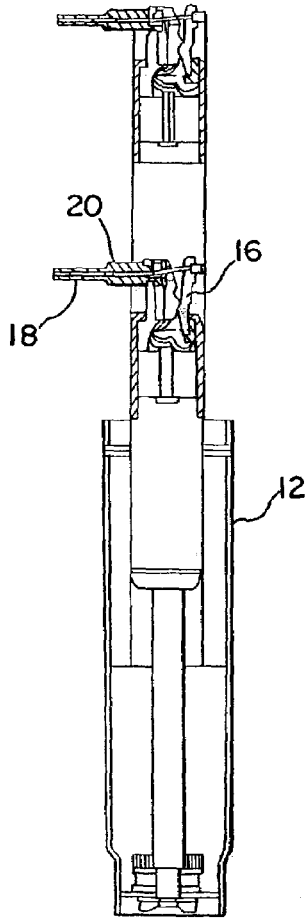
FIG. 42 is a partial cross-sectional view of a support column in an elevated and compressed position.
Figure 41:
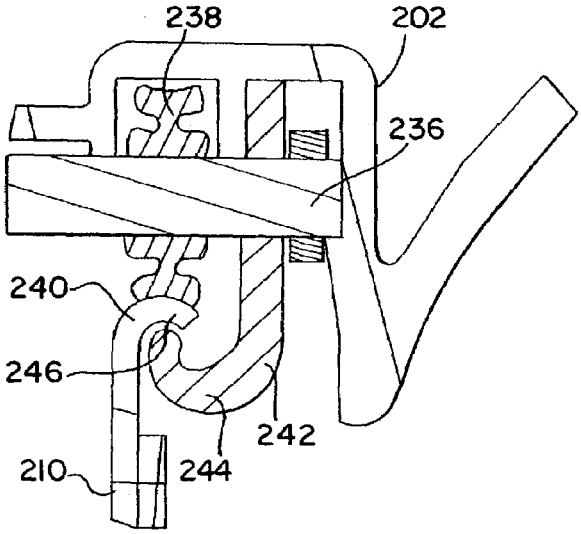
FIG. 41 is a partial cross-sectional view of the seat supported by the tilt control housing track.

An adjustable support column 12, preferably pneumatic and shown in FIG. 42, is mounted to a rear portion of the housing 10 at opening 14. A top portion of the column 12, having a side-actuated lever 16, extends into the housing, and preferably is fitted inside a bushing 50 that captures and connects the various tilt control housing components. A cable 18 is connected to the lever, and can be moved within a guide to actuate the lever. An opposite end of the cable is engaged by an arm on a pivot tube 22, shown in FIGS. 43 and 60. A grippable handle 24, or paddle, extends from the tube. In operation, the user rotates the paddle 24 and thereby moves the cable 18 to actuate the lever 16, which in turn allows the support column 10 to extend in response to a gas spring contained therein, or to collapse in response to the weight of the user being applied to the seat. One suitable support column is available from Samhongsa Co. Ltd., otherwise referred to as SHS.

Figure 60:
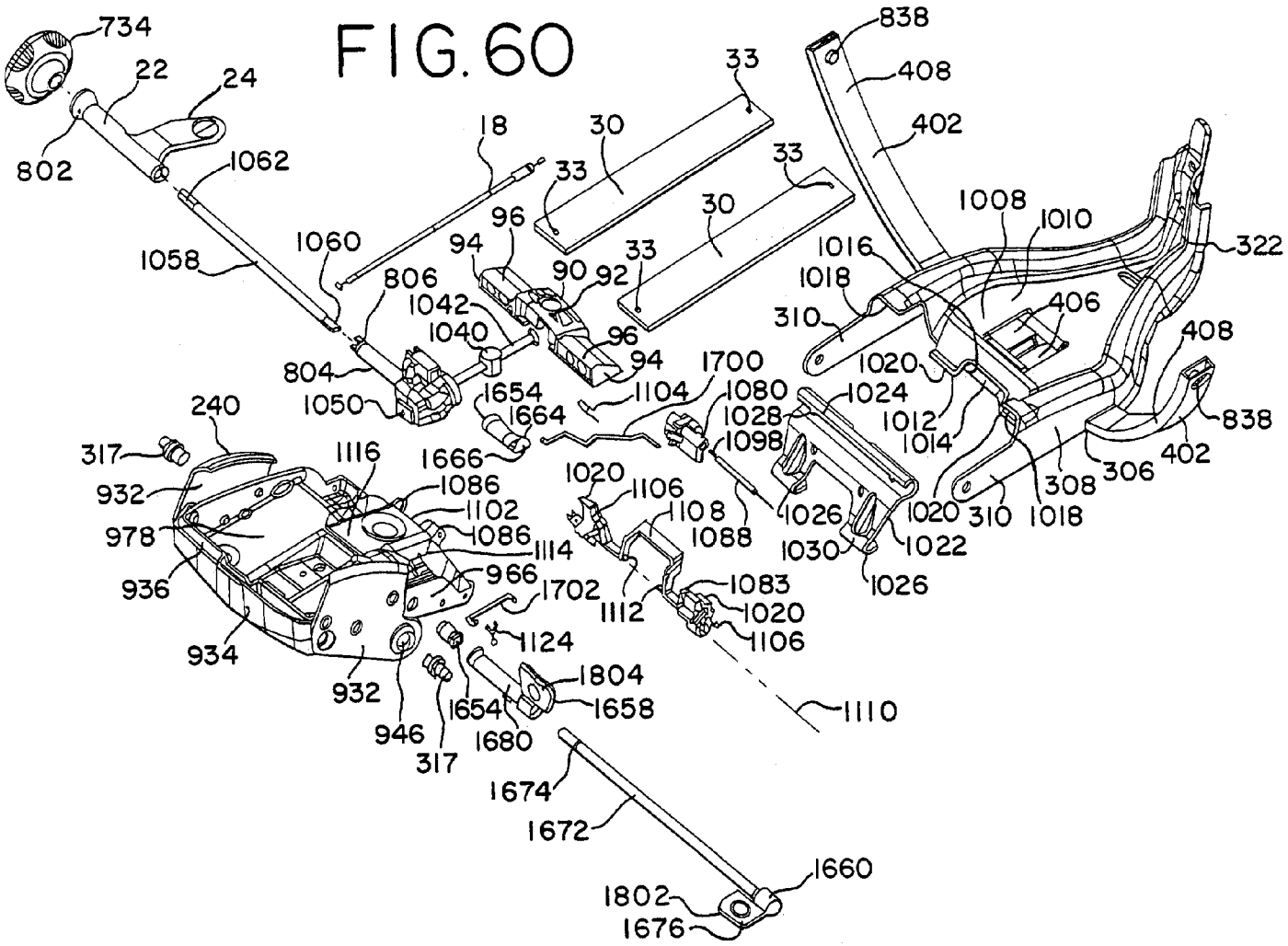
FIG. 60 is an exploded perspective view of on embodiment of a tilt assembly and back support.
Figure 61:
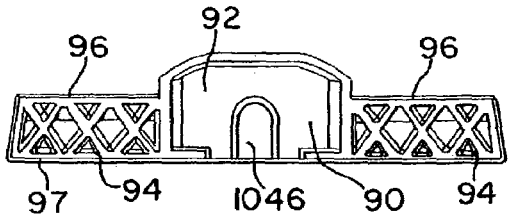
FIG. 61 is a front view of one embodiment of the fulcrum member.
Figure 62:
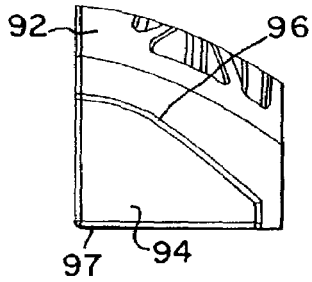
FIG. 62 is a side view of the fulcrum member shown in FIG. 61.
Figures 68, 69, 70:
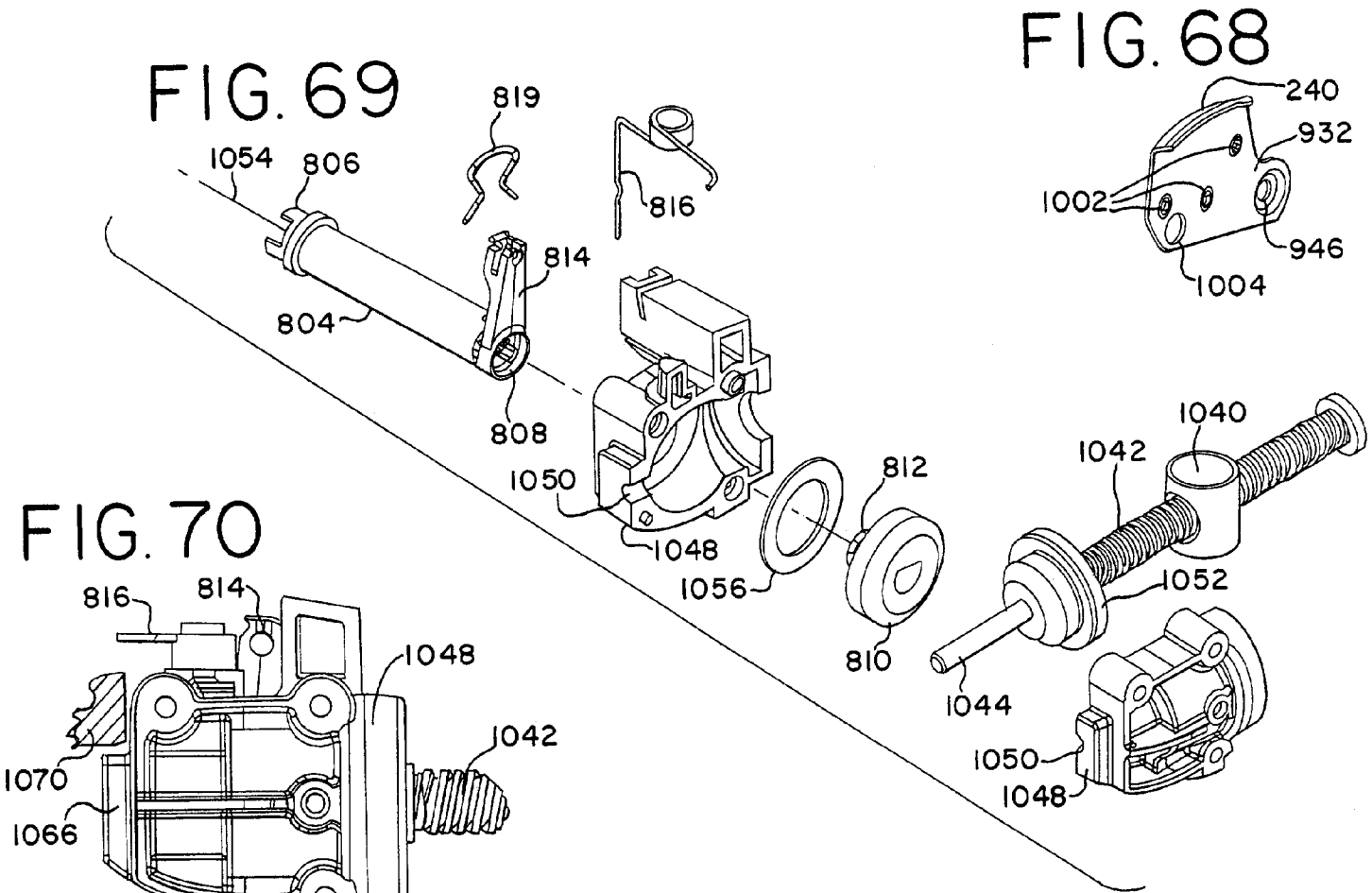
FIG. 68 is a perspective view of a tilt housing guide member.
FIG. 69 is an exploded perspective view of an actuation mechanism.
FIG. 70 is a side view of a gear housing.

Referring to the embodiment of the adjust mechanism for the support column shown in FIGS. 60 and 69, the tube 22 (which is rotated 180 degrees in FIG. 60) has a flared end 802. The end 802 of the tube is configured to matingly engage a first end 806 of a pivot member 804. The pivot member 804 has a second end 808 that is rotatably received on a hub 812 of gear 810. A clip 819 secures the end 808 to the hub 812. The pivot member includes an arm 814 that extends perpendicular from a tube portion of the pivot member. The arm includes an end portion that engages end of the cable 18. A spring 816 biases the pivot member to a return position. In operation, the user moves the paddle 24, which rotates the tube 23 and the pivot member 804. As the arm 814 of the pivot member is moved, it moves the cable 18 relative to the guide, and thereby actuates the support column.

Referring to FIGS. 11 and 12, a base 26, preferably a five arm base with casters, is mounted to the bottom of the support column 12 in a conventional manner, although one of skill in the art would understand that other support columns and bases can be used to support the housing, including fixed height support columns and non-rolling bases, including for example a base configured with glides.

With the chair being generally described, the various features of the armrests, the seat, the backrest and the tilt control assembly, along with various controls therefore, will be described in more detail below.

Armrest Assembly:

Referring to FIGS. 1, 2 and 58–60, one preferred embodiment of an armrest assembly 400 is shown as having a lower portion 402 and an upper portion 404. The lower portion 402 includes a lower support member having a laterally extending, and substantially horizontal portion 406 and an upper spine portion 408 extending upwardly and outwardly from the horizontal portion 406. The spine portion 408 is preferably curved and defines a curvature substantially in a plane substantially parallel to the torso of the user. In one preferred embodiment, shown in FIGS. 1 and 2, the spine 408 has a lower curved portion 410 and an upper curved portion 412, with the upper curved portion having a smaller cross-section, which is preferably rectangular, than the lower curved portion. Preferably, the lower portion is made of 380 cast aluminum or any other suitably strong material, such as metal, including steel, or fiberglass, plastic, composites and other similar materials.

As shown in FIGS. 1, 2, 71 and 87, a pair of sleeve members 414 are disposed on the upper curved portion 412 and define a cross-section substantially the same as the lower curved portion. Referring to the embodiment of FIGS. 58–59 and 87, notches 413 locate the sleeve members 414 on the curved portion 412 by way of a locator tab 415. It should be understood that the sleeve members can be made as a single member that is disposed over the end of the spine 408.

As best shown in FIGS. 13 and 58–60, the ends of the lower horizontal portions 406 extend through openings 306 in opposite sides of a back support 304 and are secured, preferably fixedly (for example by welding), one to the other and/or to the back support member. Alternatively, the lower portions can be moveably secured to and supported by the back support, so as to allow them to move inwardly and outwardly in the lateral direction. In either embodiment, the lower portions 402 of the armrests form part of the back support 304. The lower portions of the armrests can be configured in any number of shapes, and provide different mounting pivot locations for the seat. For example, the shape and size of the armrest can be varied to provide different mounting arrangements and locations for the seat. Alternatively, a single modular armrest can be configured with a plurality (meaning two or more) mounting arrangements on the same member. In the preferred embodiment, the spine portion of the back support 304 can be made as a modular element, with the overall configuration of the back support being quickly and easily reconfigured simply by providing a different lower portion of the armrest.

Figure 1:
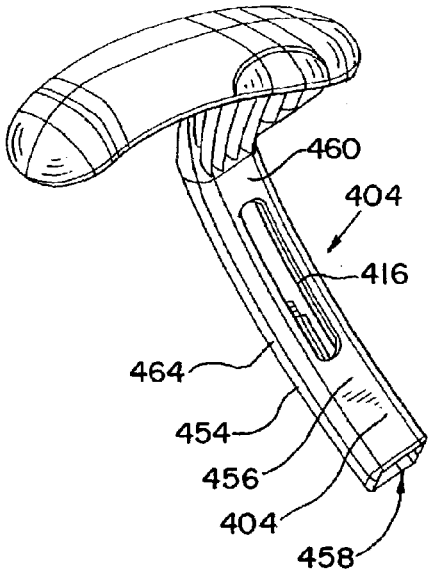
FIG. 1 is a perspective view of an armrest assembly.
Figure 15:
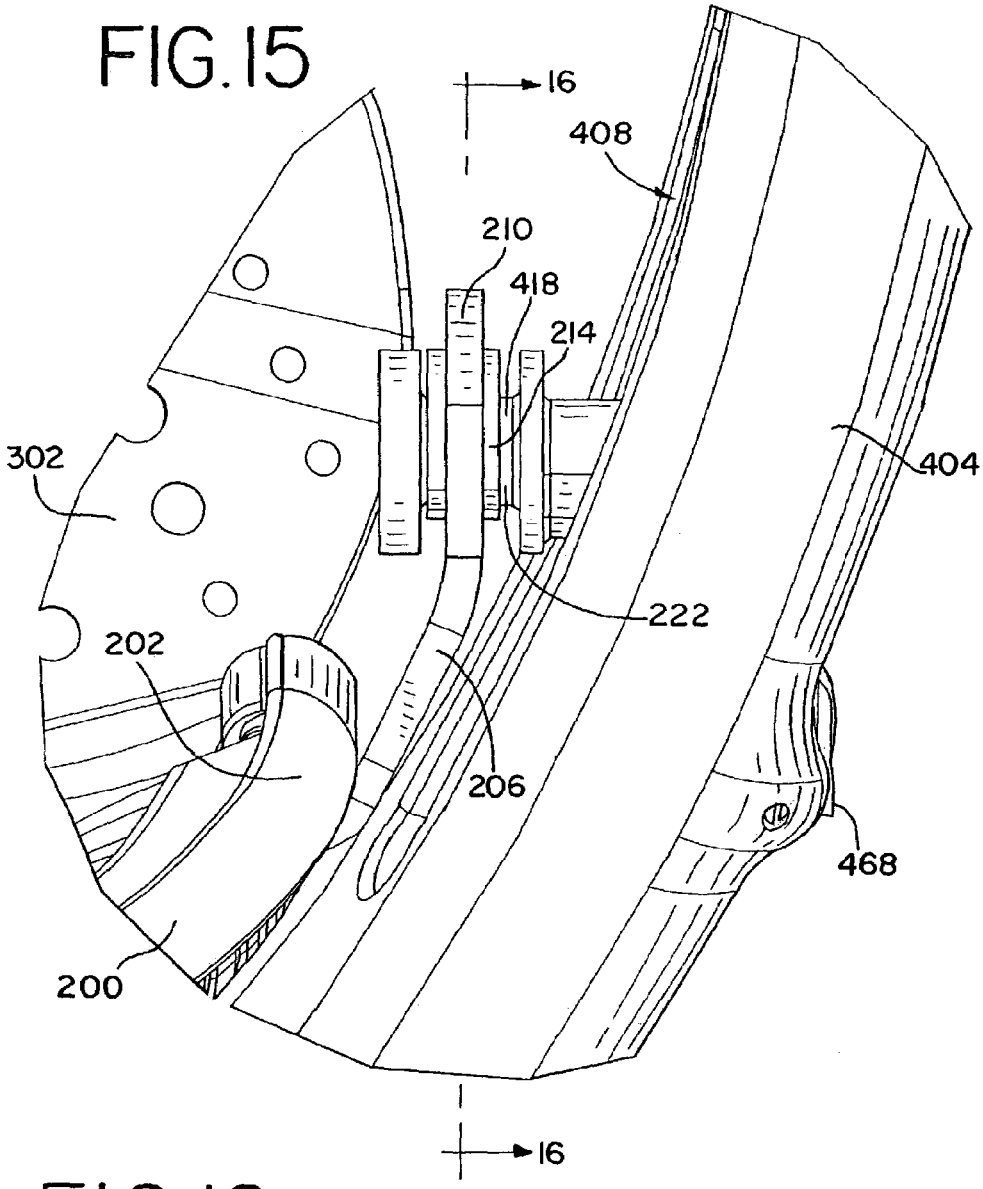
FIG. 15 is a partial enlarged front view of the seat connected to the armrest.
Figure 71:
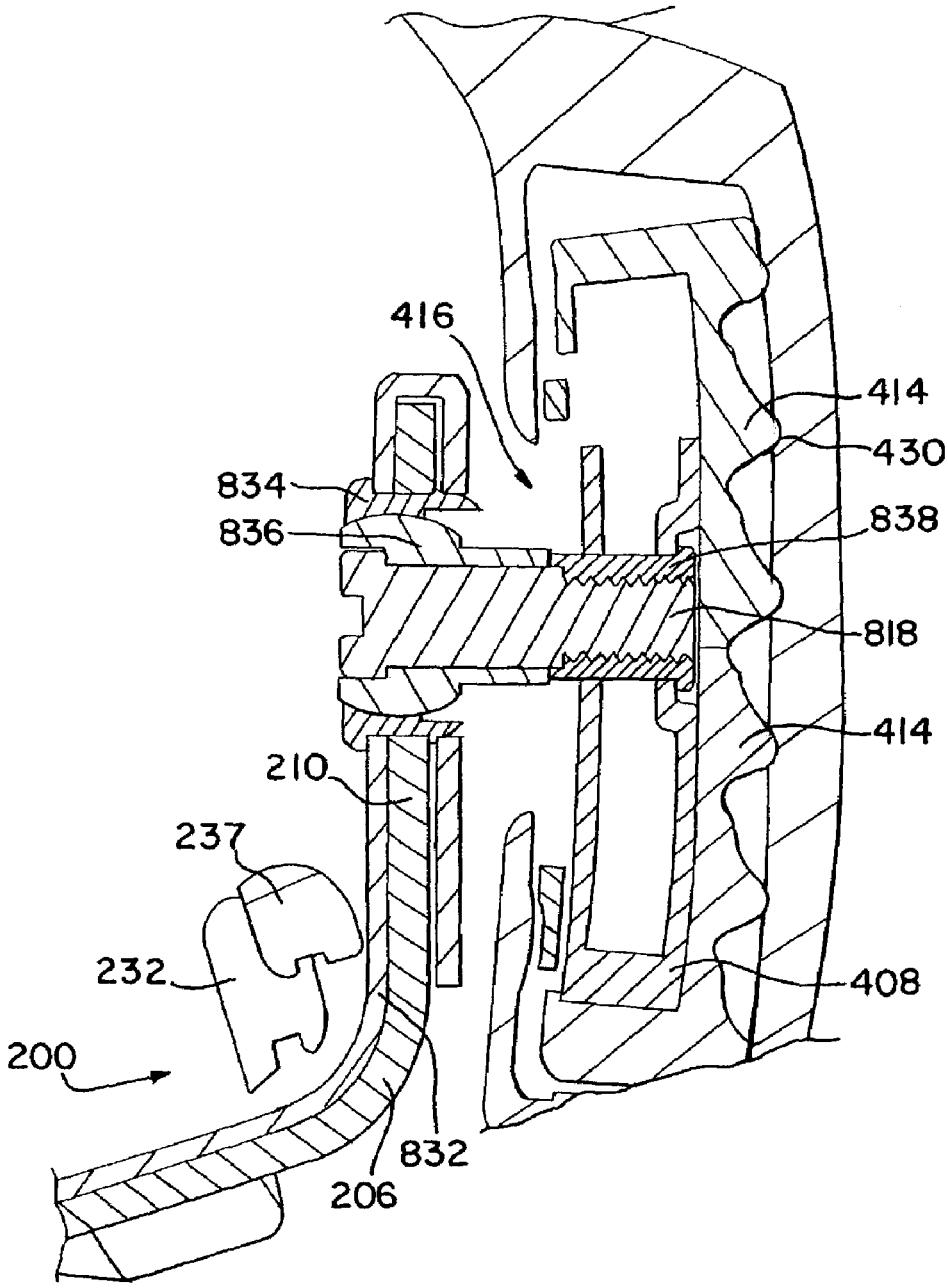
FIG. 71 is a cross-sectional view of one embodiment of the connection between the seat and armrest.

Referring to the embodiments shown in FIGS. 1 and 71, an opening 416 is formed through the upper curved portion 404 and is shaped to receive a pivot member 418, 818, which secures the seat 200 to the spine 408, as shown in FIGS. 15 and 71.

Figure 2:
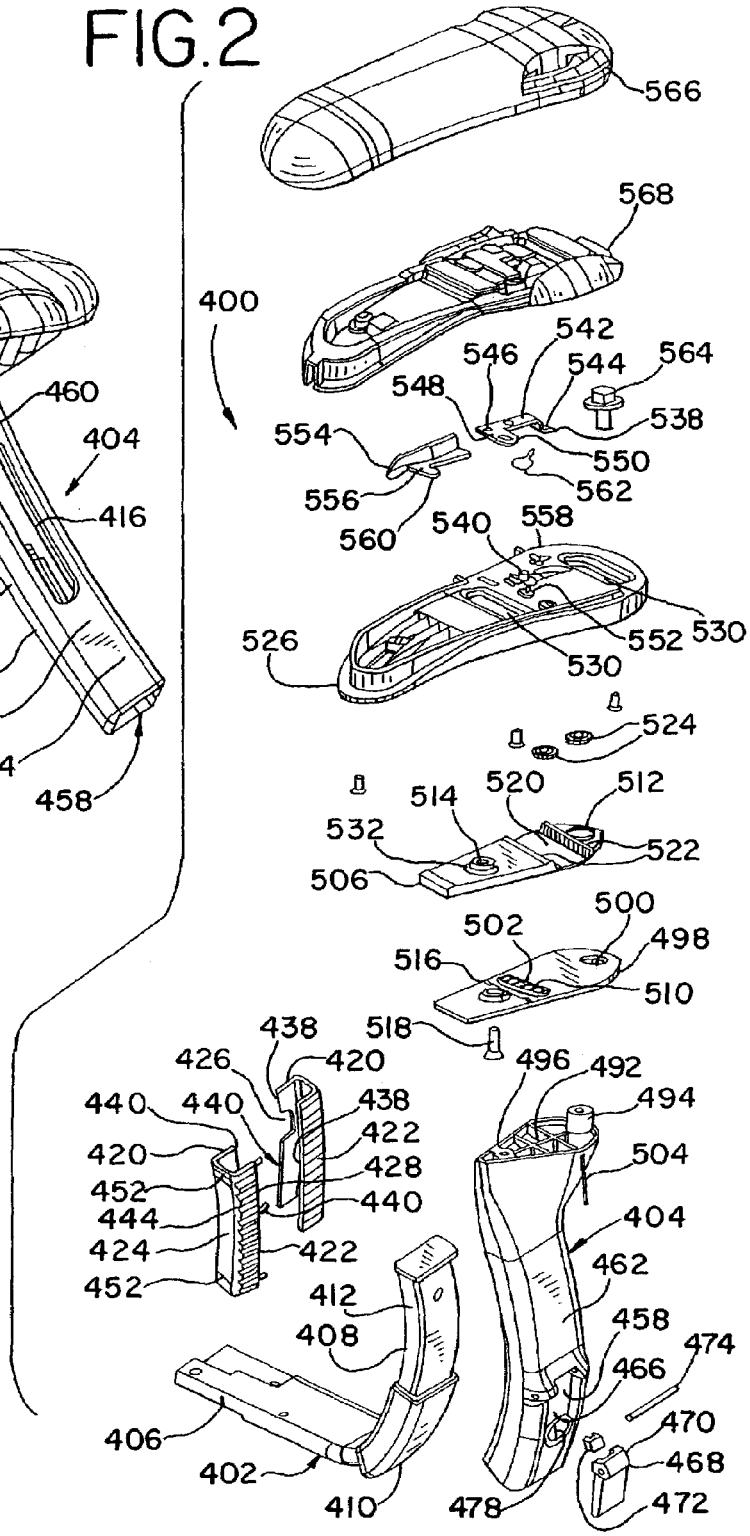
FIG. 2 is an exploded perspective view of one embodiment of an armrest assembly.
Figure 87:
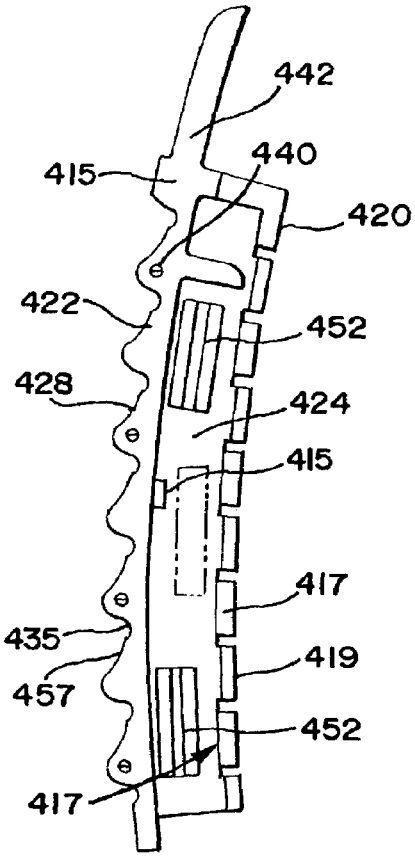
FIG. 87 is front view of an armrest sleeve member.

Referring to FIGS. 2 and 87, the sleeve members 414 are preferably U-shaped, having an inner and outer wall 420, 422 joined by an end wall 424. In the embodiment shown in FIG. 2, a cut-out 426 in the inner wall is shaped to receive the pivot member 418 once the sleeve members 414 are installed on the upper portion of the spine. Referring to the embodiment of FIG. 87, the inner wall is formed from a plurality of flexible tab members. Some of the tab members 417 have an inner surface that is raised above the surface of other of the tab members 419. The tab members are biased against the curved portion 412 and take up the tolerances.

Figure 4:
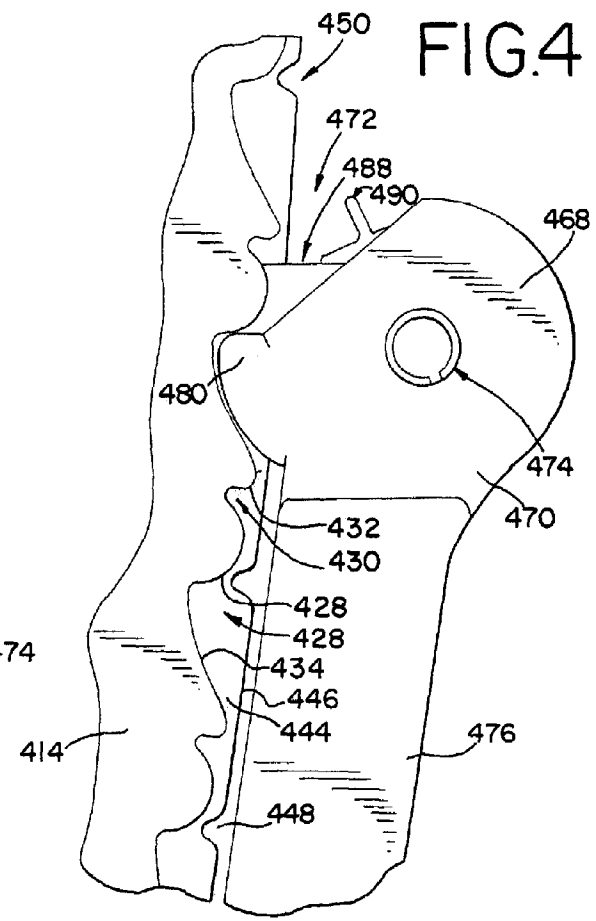
FIG. 4 is an enlarged partial side view of the lever and index member of FIG. 3 engaging a rack.
Figure 5:
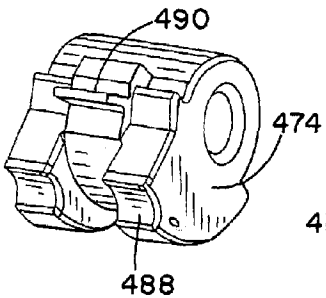
FIG. 5 is a perspective view of an index member.
Figure 3:
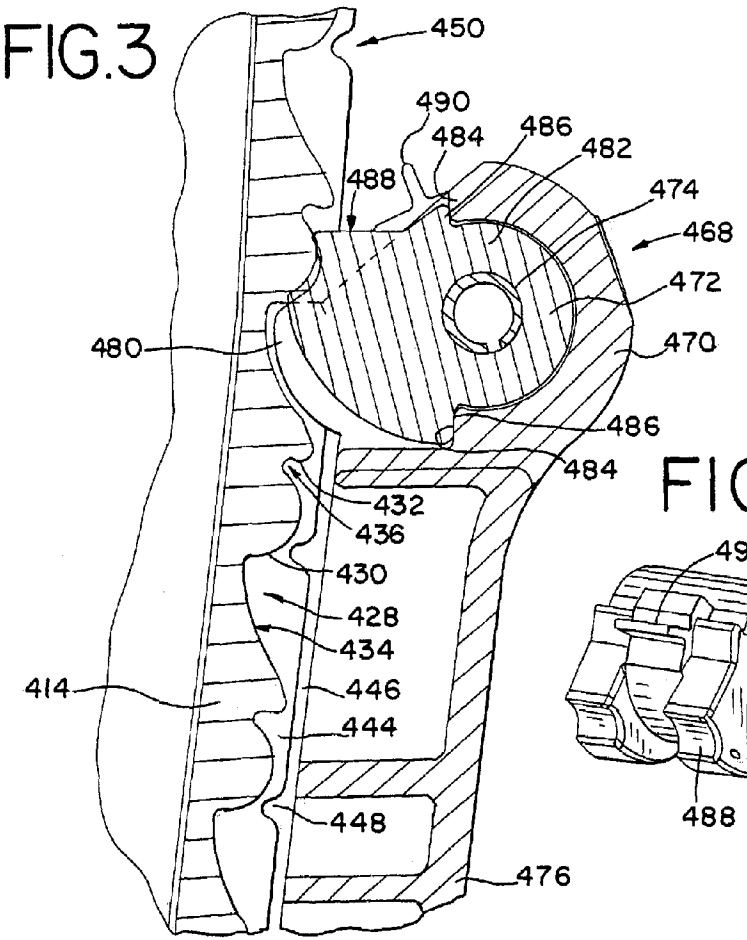
FIG. 3 is an enlarged partial cross-sectional view of a lever and index member engaging a rack.

Referring to FIGS. 2–4, 71 and 87, a rack 428 is formed on the outer wall 422. The term "rack" as used herein broadly means a series of engageable elements, including for example and without limitation, teeth, grooves, slots, openings, protuberances, etc. Referring to FIGS. 3 and 4, the profile of the rack 428 includes a plurality of curved engagement portions 430, and a plurality of teeth portions 432 interspaced between the curved portions, with a plurality of sloping recesses 434 and slots 436 defining the profile of the rack, which provides unique positions for positive latch engagement.

Referring to FIGS. 71 and 87, the profile includes a plurality of first and second recesses 435, 437. Preferably, the profile extends laterally across the entirety of the face of the outer wall 422. In one preferred embodiment, the sleeves are made of acetal.

Referring to FIGS. 2 and 87, one of the sleeve members 414 (female) has a plurality of recesses 438 formed in the end of the free edge 442 of the inner and outer walls, while the other sleeve (male) has a plurality of protuberances 440 extending from the end of the free edge 442, with the protuberances 440 shaped to be received in the recesses 438 when the free edges 442 are abutted as the sleeve members 414 are installed on the spine 408. In this way, the sleeve members 414 are prevented from moving longitudinally relative to one another along the spine.

Referring to FIGS. 3 and 4, in one preferred embodiment, the sleeve members 414 each include a flange 444 formed along the free edge of the outer wall, with the recesses or protuberances formed in the face of the flange. The outer edge 446 of the flange includes a plurality of indexing notches 448 that form a rack 450 and are spaced longitudinally along the flange approximately the same distance as the engagement portions 430 of the rack 428.

Referring to FIG. 2, the sleeve members 414 each include a plurality, meaning two or more, bearing pads 452 on the end walls and inner walls that extend outwardly from the wall and slidably engage the curved upper members 404. Alternatively, the sleeves can include roller bearings that engage the curved member.

In one preferred embodiment, the radius of the inner surface of the lower curved portion 410 and of the inner wall of the sleeve members 414 is approximately 13.78 inches, while the radius of the outer surface of the lower curved portion 410 and of the outer wall of the sleeve member is approximately 14.68 inches. Of course, it should be understood that other radii would also work, and that preferred radius is between about 12 and about 16 inches.

Referring to FIGS. 1, 2, 15 and 83, the upper portion 404 forms a stem 454 that includes a housing 456 forming a cavity 458, which is shaped to receive the curved spine 408 and sleeve member 418. The cavity 458 is defined by an inner and outer wall 460, 462, and a pair of end walls 464. The stem 454 has approximately the same curvature as the spine 408, such that it can slide therealong without binding. For example, in one preferred embodiment, the radius of the inner surface of the outer wall 462 of the cavity is approximately 14.73 inches, and preferably between about 12 and 16 inches. An elongated opening 416, or slot, is formed in the inner wall 460 and is shaped to receive the pivot member 418, such that the stem 454 can be moved relative to the spine 408 without interfering with the pivot member. An opening 466 is also formed in the outer wall 462 so as to expose the racks 428 of the sleeve members disposed on the spine.

Figure 83:
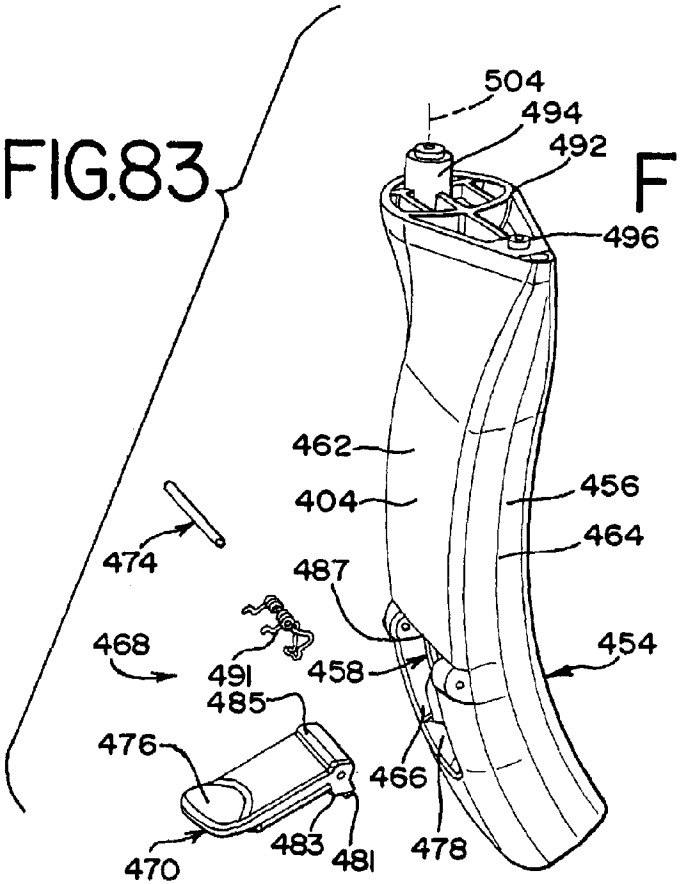
FIG. 83 is a partial exploded perspective view of one embodiment of an armrest assembly.

Referring to FIGS. 2–4, 83 and 85, a latch mechanism 468 is pivotally secured to the outer wall 462 of the stem and is received in the opening 466. Referring to the embodiment of FIGS. 2–4, the latch mechanism 468 includes a lever member 470 and an index member 472 pivotally mounted to the stem 454 with a pivot pin 474 at a substantially horizontal pivot axis. The index member 472 is nested or pocketed in the lever member 470, as shown in FIGS. 3 and 4. It should be understood that the lever and index member can be integrally formed as a one-piece member. In the embodiment of FIG. 83, the index member is omitted. Referring to FIGS. 2 and 83, the lever member 470 includes a grippable handle portion 476 that extends downwardly from the pivot axis and is nested in a recess 478 formed in the stem. The recess 478 extends below the end of the lever so as to allow the user to insert a finger and grip or lift the lever member 470 from an engaged position to move it to a disengaged position. Referring to FIGS. 3, and 4, the lever member 470 further includes an engagement portion 480 that extends inwardly and engages one of the curved engagement portions 430 of the rack when the lever is in the engaged position. The engagement portion has a curved surface that translates relative to the sloping surface of the recess 434 as the lever is moved between the engaged and disengaged positions. The lever has a cavity 482 shaped to receive the index member 472 and includes a pair of shoulders 484 that mate with and abut corresponding shoulders 486 on the index member, such that the index member is pivoted about the pivot axis 474 with the lever member.

Figure 85:
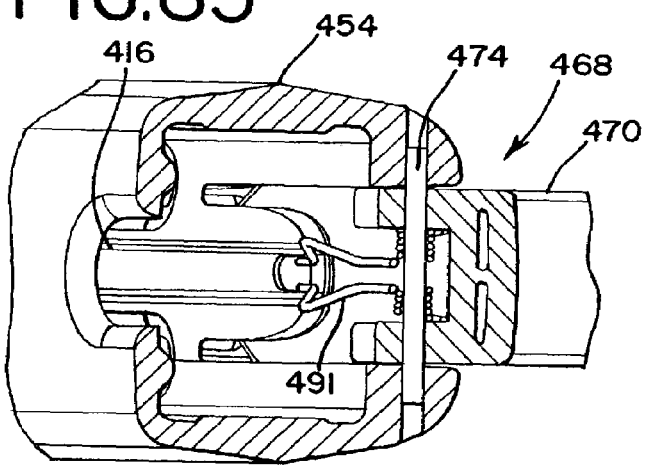
FIG. 85 is a cross sectional view of one embodiment of an armrest assembly.
Figure 86:
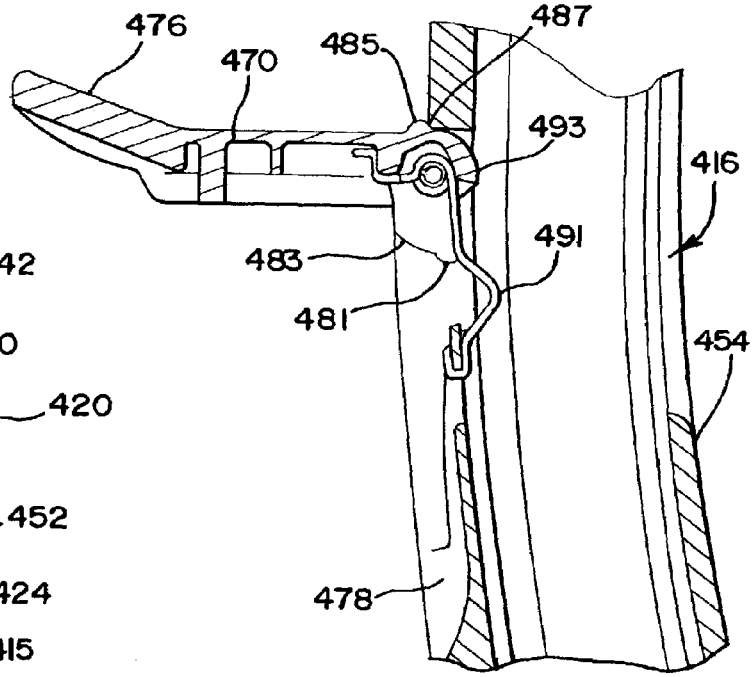
FIG. 86 is a cross-sectional view of one embodiment of an armrest assembly.

Referring to FIGS. 83, 85 and 86, a primary engagement portion 481 is shaped to be received in the recess 435, while a secondary engagement portion 483 is received in the recess 437. The lever further includes a stop portion 485 that engages an upper edge 487 of the stem when the lever is in the unlatched position. A spring 491 is disposed about the pivot pin 474 and is engaged between the lever 470 and the stem 454 so as to bias the lever to an unlatched position. The lever 470 acts as an over-center toggle, such that it snaps into the latched position when it is moved into engagement with the rack. A portion of the lever and/or a portion of a spring can index with the rack as the upper arm portion is moved to the desired position.

Preferably, the lever 470, sleeve members 414 and stem 454 are made of a SG95 or SG200 Urethane, 79–80D Durameter. Alternatively, those components can be made from various plastics, metals, elastomers, composites, fiberglass, etc.

Referring to the embodiment of FIGS. 2 and 3, the index member includes a bumper portion 488 having a concave surface shaped to engage the curved portion 430 when the lever is in the engaged position. Preferably, the index member 472 is made of 2140 Urethane, 55–65D Durameter, although it should be understood that it can be made of other plastics, metal, fiberglass, rubbers, composites and the like, or combinations thereof. The index member 472 further includes a flexible, resilient indexing finger 490 that extends outwardly from the index member. The indexing finger 490 is disengaged from the rack 450 when the lever is in the engaged position. As the lever 470 is moved to the disengaged position, the indexing finger 490 is pivoted into abutment with the flange 444 of the sleeve, and selectively engages the notches 448 of the rack 450 as the stem 454 is moved relative to the spine 408. The indexing finger 490 will selectively engage one of the notches 448 as the lever is moved from the engaged to the disengaged position and before the stem is moved relative to the spine. As the stem is moved relative to the spine, the indexing member 472 successively, selectively engages the notches 448 and provides an audible indexing sound to indicate to the user that an available vertical position has been selected. The lever 470 can then be pivoted from the disengaged position to the engaged position to again secure the stem 454 to the spine 408 and prevent movement therebetween.

It should be understood that the racks could be formed on the stem, and with the lever and/or indexing members pivotally mounted to the spine.

Figure 6:
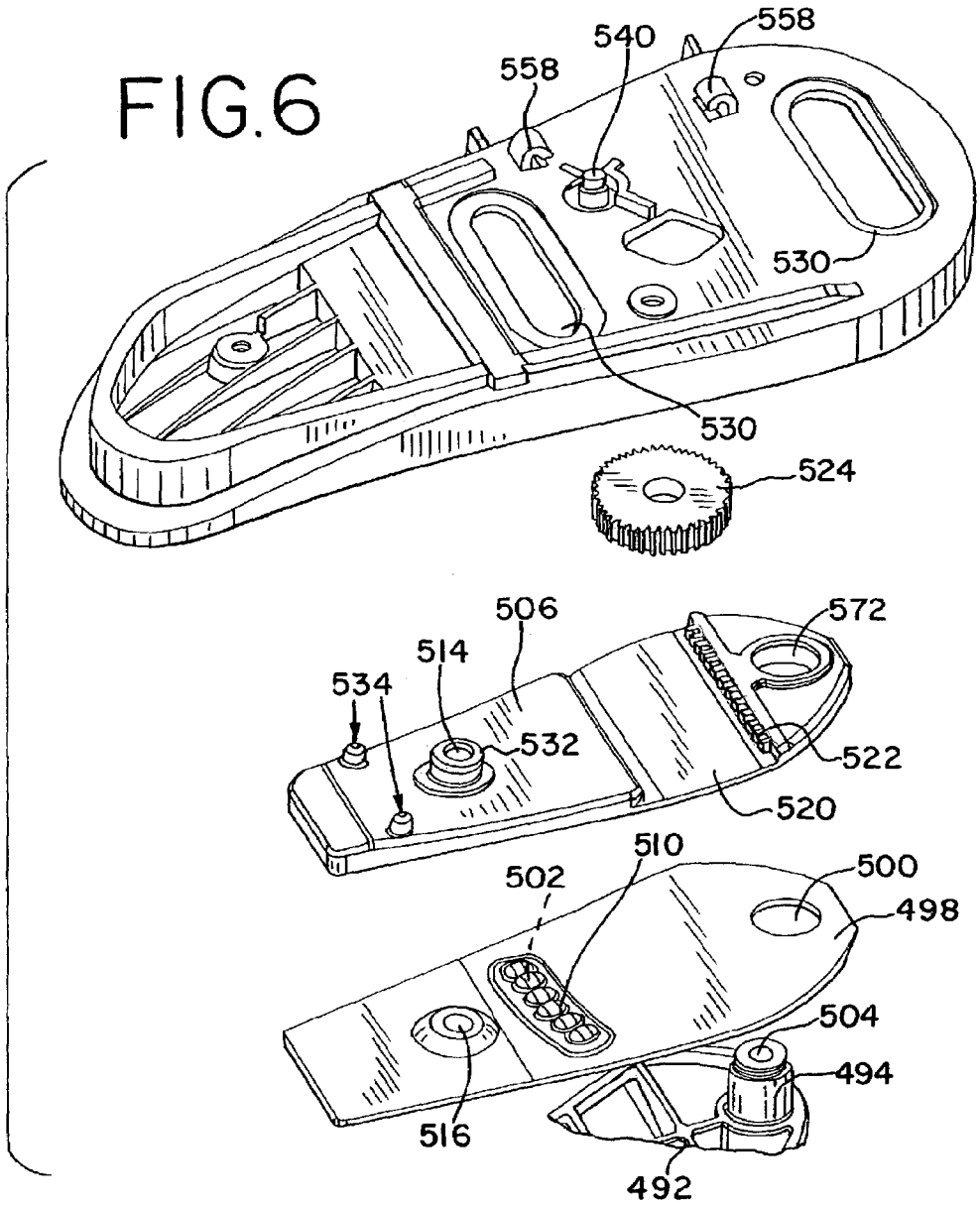
FIG. 6 is an exploded top perspective view of one embodiment of an upper portion of armrest assembly.
Figure 7:
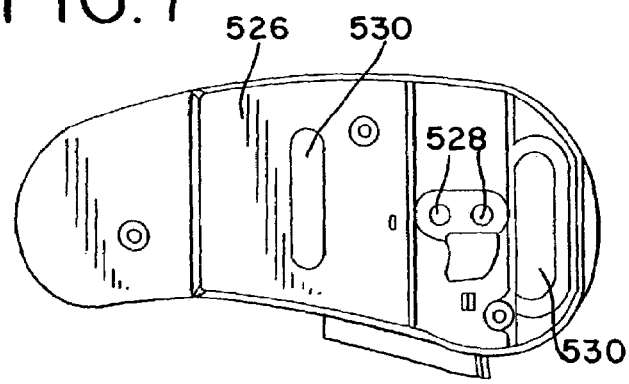
FIG. 7 is a bottom view of one embodiment of an armrest support.

Referring to FIGS. 1, 2, 6–10 and 83, the upper portion 404 of the armrest assembly provides lateral and pivotable adjustment of an armrest. Referring to FIGS. 2, 6 and 83, the upper end of the stem forms a mounting platform 492, which has a guide member 494, or pivot member, extending upwardly therefrom and defining a substantially vertical pivot axis 504. The term "platform" as used herein means any support structure or surface, and includes, but is not limited to, a substantially flat, horizontal member or surface, or platelike member. In addition, a protuberance 496, or detent extends from the mounting platform 492 at a location spaced from the guide member 494. The detent can be spring loaded.

Referring to FIGS. 2, 6–10 and 84, a support platform 498 includes an opening 500 that is shaped to receive the guide member, with the platform disposed on the guide member at the opening such that the platform can pivot about the pivot axis. Referring to the embodiment of FIGS. 2 and 6–10, the platform 498 includes a plurality of recesses 502 formed on a bottom surface thereof and spaced from the opening so as to be aligned with the protuberance. The plurality of recesses 502 form an array thereof having a curvature generally centered around the pivot axis 504.

Figure 84:
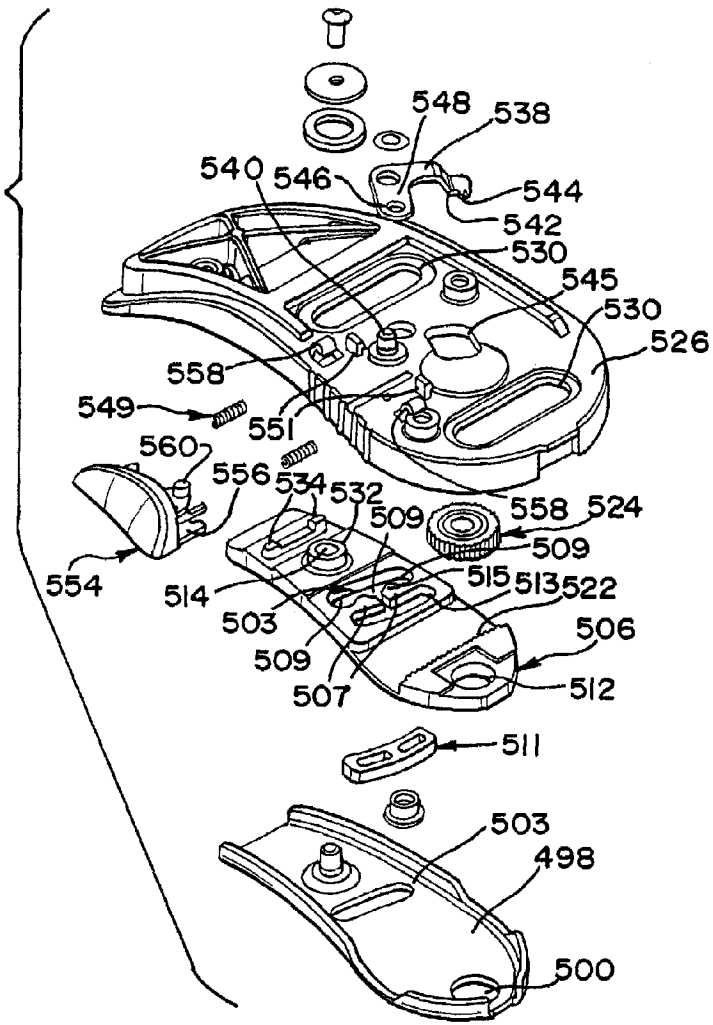
FIG. 84 is an exploded perspective view of one embodiment of an upper portion of an armrest assembly.

In the embodiment of FIG. 84, the protuberance 496 extends through an opening 503 formed in the platform and is indexed in a slot 505 formed in a platform 506 by a pair of arms 507 that have end portions 515 that are shaped to define three openings 509. Of course, more openings could be formed and defined by the slot and arms. A rubber or elastomeric spring 511 is disposed in a slot 513 formed opposite slot 505. The spring 511 biases the arms 507 against the protuberance.

In operation of the embodiment shown in FIGS. 2 and 6–10, the platform 498 is moved or pivoted about the pivot axis 504 relative to the mounting platform 492, with the protuberance 496 indexing with one of the plurality of recesses 502 so as to locate the platform 498 relative to the mounting platform 492 in a plurality of pivot positions corresponding to the plurality of recesses. In the operation of the embodiment shown in FIGS. 84, the platform is moved or pivoted about the pivot axis 504 relative to the mounting platform 492, with the protuberance 496 indexing with one of the plurality of openings 509 so as to locate the platform 498 relative to the mounting platform 492 in a plurality of pivot positions corresponding to the plurality of recesses. A bearing member can be disposed on the protuberance, with the bearing member indexing with the openings.

It should be understood that the location of the recesses (or openings) and protuberance can be reversed, with the protuberance extending downwardly form the platform and with the array of recesses or openings formed in the mounting platform on the top of the stem. Likewise, it should be understood that an array of protuberances could be provided on one or the other of the platforms and which mate with a recess.

Referring to FIGS. 2 and 84, the first platform 498 is secured to another second platform 506. As shown in one embodiment of FIG. 8, the platform 506 has a recess formed in a bottom portion thereof that is shaped to receive the raised indentations 510 that form the array of recesses 502 on the bottom side of the platform. Referring to FIGS. 2 and 84, the platform 506 has an opening 512 formed on one end thereof that is shaped to receive the guide member 494. A second opening 514, 516 is formed on an opposite end of each of the platforms 506, 498. Referring to FIG. 2, fastener 518 extends through the second openings and secures the platforms one to the other. Alternatively, a boss can be formed on the platform 498, with the boss extending into a boss formed in platform 506 and through opening 514. A fastener, and one or more washers, extends downwardly through the platform 506 and is engaged with the boss to secure the platforms 498 and 506 together.

In a first embodiment of the platform 506, shown in FIG. 2, the platform includes a recess or channel 520 formed across an entire width thereof. A pair of spaced apart and parallel linear gears 522, or racks, define the opposite side walls of the channel. An armrest support 526, shown in FIGS. 2 and 7, includes a pair of axles 528 that define a pair of spaced apart axes of rotation. A pair of pinion gears 524 are mounted to the armrest support on the axles 528 and are disposed in the channel 520, such that each of the pinion gears mesh with each other and one of the linear gears 522 respectively.

Figure 8:
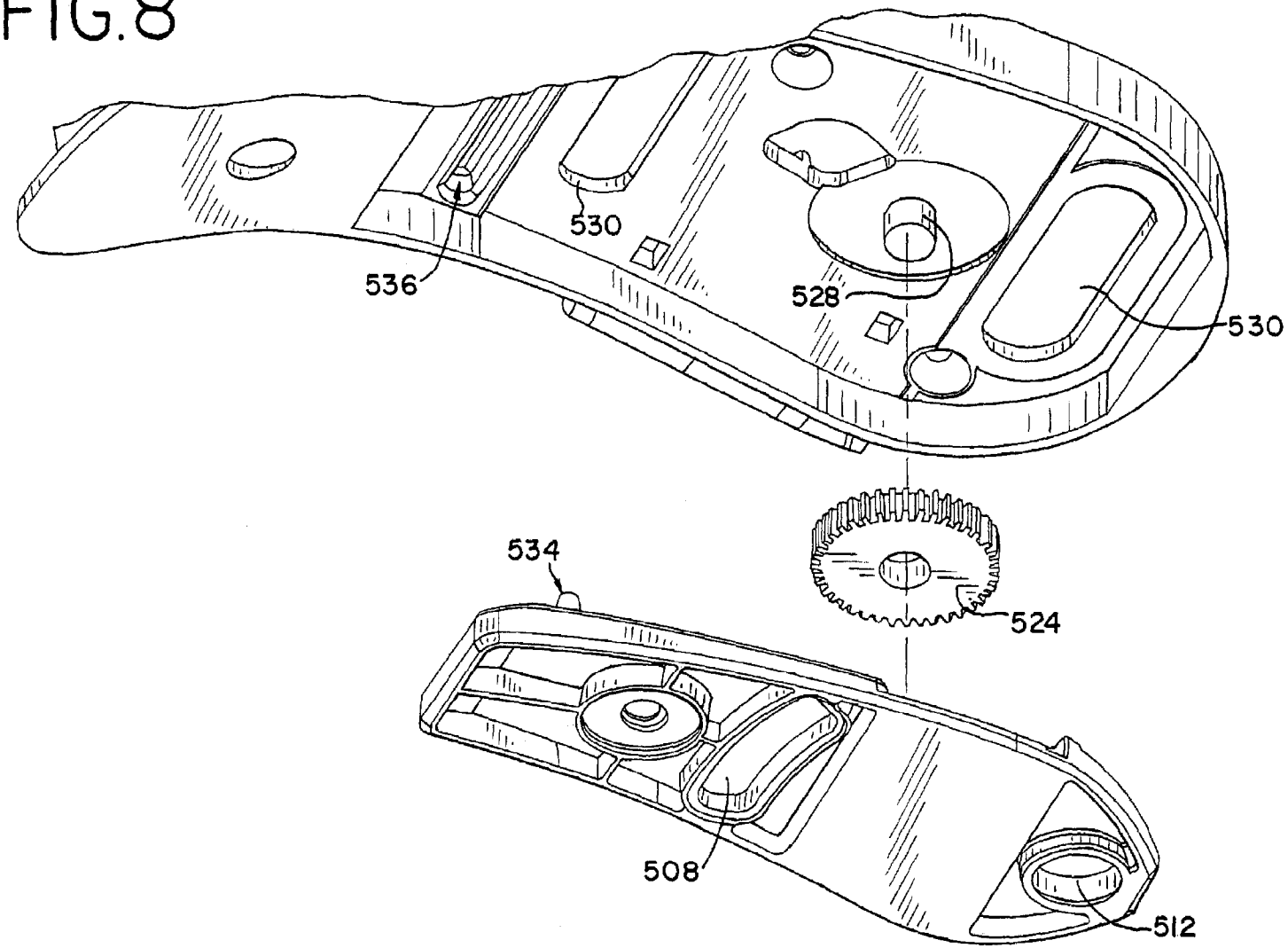
FIG. 8 is an exploded bottom perspective view one embodiment of a portion of an upper portion of an armrest assembly.

In a second embodiment, shown in FIGS. 6, 8 and 84, the platform has only a single linear gear 522, with an opposite wall of the channel 520 being preferably substantially smooth. The armrest support has only a single axle 528 defining an axis of rotation. A single pinion gear 524 is rotatably mounted on the axle 528 within the channel and meshes with the linear gear 522.

In either embodiment, as shown in FIGS. 2, 6, 8 and 84, the armrest support 526 includes a pair of spaced apart and substantially parallel tracks 530, shown as slots, formed therethrough. One of the tracks 530 receives the guide member 494 extending upwardly from the stem through the platforms 498, 506, while the other receives a guide member 532 formed on an upper surface of the platform 506, and through which the fastener 518 passes to secure the platforms 498, 506. In operation, the user moves the armrest support 526 laterally relative to the platform 506, such that in one preferred embodiment, the pinion gears 524 mesh with each other and with the linear gears 522, or in another preferred embodiment, the single pinion gear 524 meshes with the single linear gear 522, as the guide members 494, 532 ride in the tracks 530. The interaction between the pinion gear(s) 524 and linear gear(s) 522 provides a firm solid feel as the armrest support 526 is moved in the lateral direction and is guided by the guide members riding in the tracks. In the embodiment of FIGS. 6, 8 and 84, the platform 506 includes an additional pair of guides 534, configured as posts, that extend upwardly therefrom and are received in a track 536 or channel formed in the armrest support 506.

It should be understood that the various guide members and tracks could be formed in either the platform or armrest support. Likewise, the channel and linear gear(s) could be formed in the armrest support, with the pinion gear(s) secured to the platform. Also, it should be understood that the upper and lower platforms 498, 506 can be made as a single, one-piece member, with the recesses or protuberances formed on one side thereof, and with the channel and linear gear(s) formed on the other side thereof.

Figure 9:
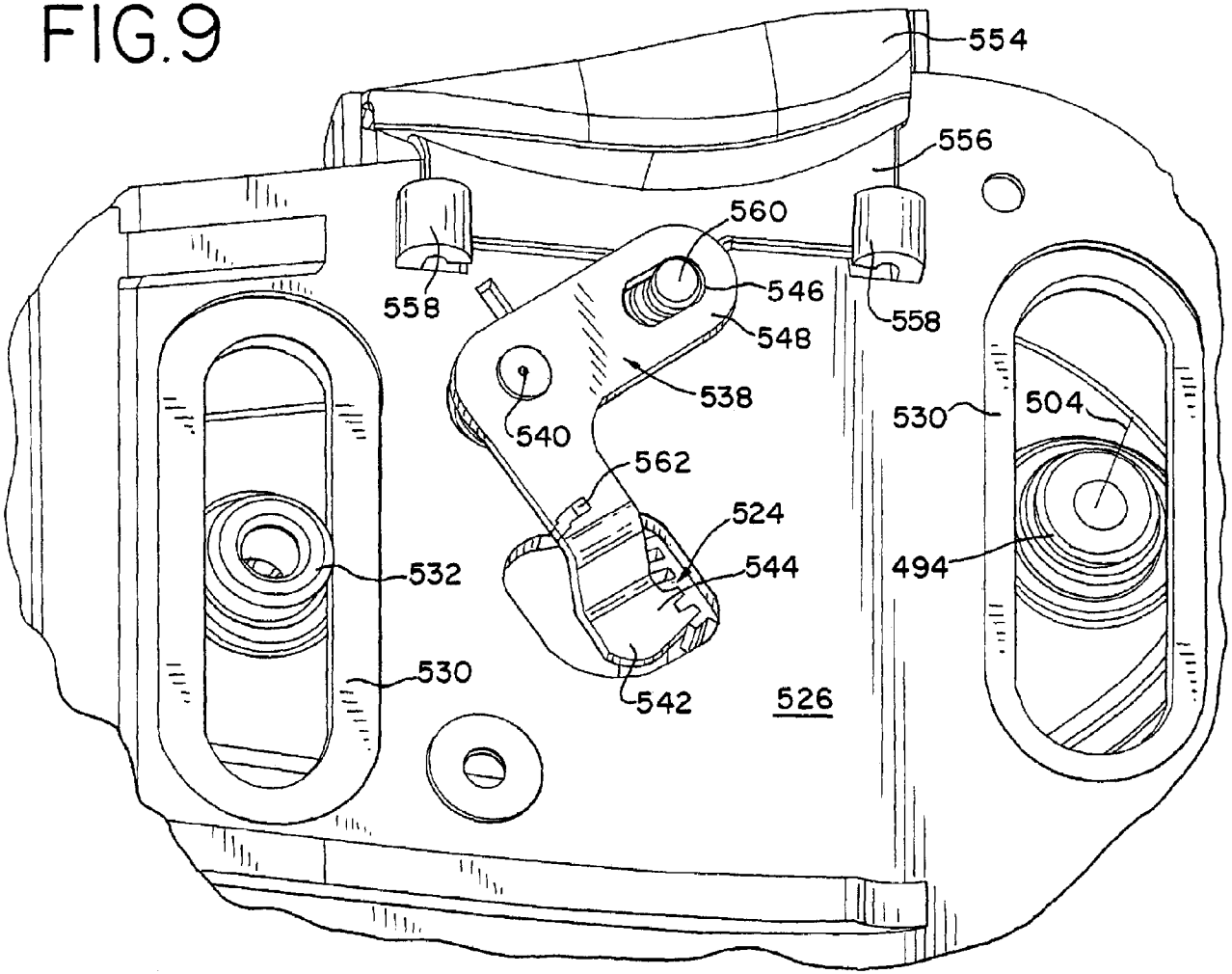
FIG. 9 is an enlarged partial top perspective view of one embodiment of a portion of an upper portion of an armrest assembly.
Figure 10:
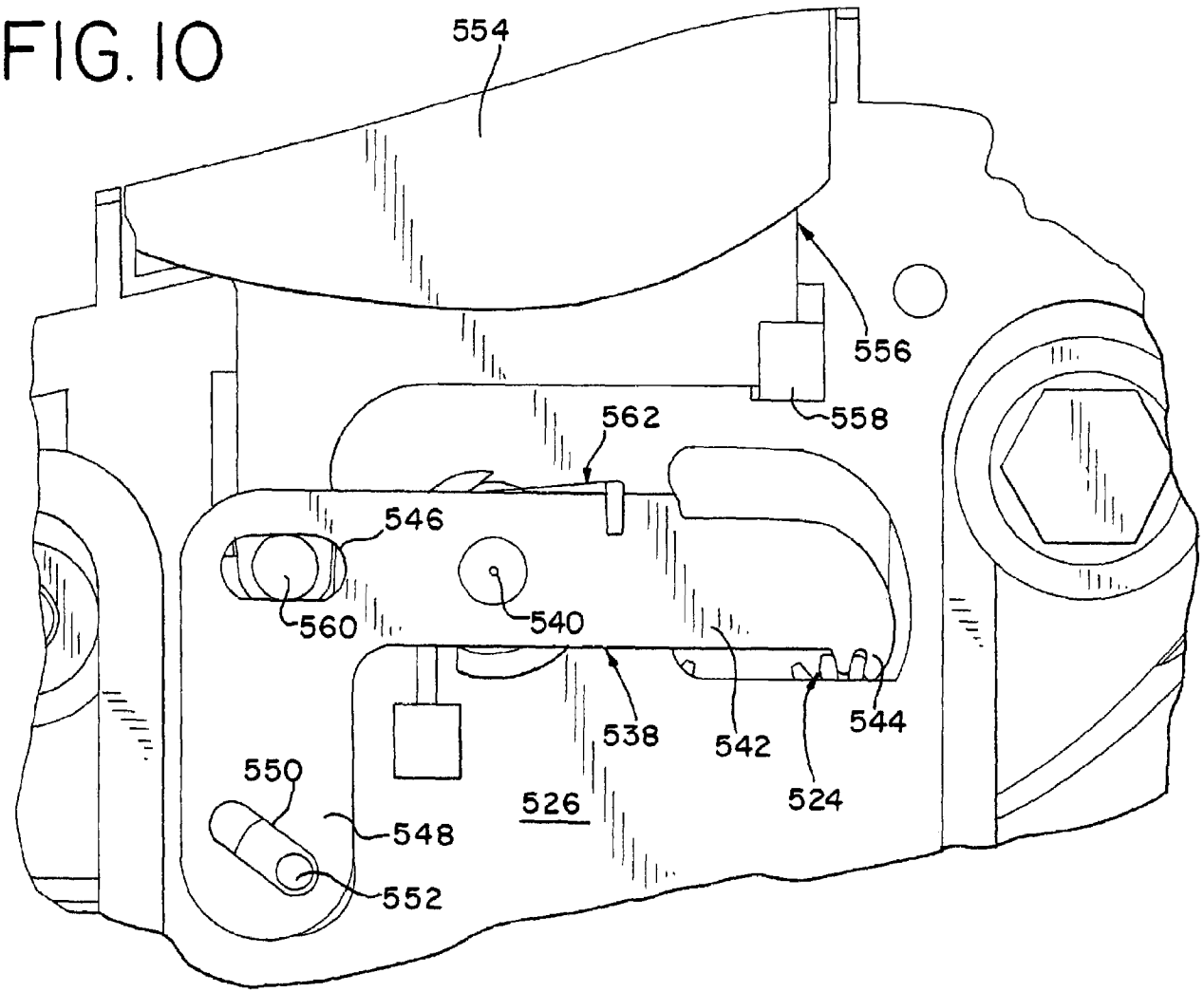
FIG. 10 is an enlarged partial top perspective view of another embodiment of a portion of an upper portion of an armrest assembly.

Referring to FIGS. 2, 9, 10 and 84, a pawl member 538 is shown as being pivotably mounted to the armrest support 526 about a pivot axis 540. The pawl member can be secured to the pivot member 540 with a retainer member. In the embodiment of FIGS. 2 and 10, the pawl 538 includes a first arm 542 having an end portion 544 defining one or more teeth or engagement portions that are shaped to engage one or more teeth on one of the pinion gears 524. Preferably, the pawl is pivotally mounted to a top surface of the support 526, with the end portion 544 extending through an opening 545 in the support to engage the one or more teeth on the pinion gear(s). The pawl further includes an opening 546, elongated or circular, formed opposite the end portion and a second arm 548 extending substantially perpendicular to the first arm. Referring to the embodiment of FIG. 10, a track 550 or slot having a radius about the pivot axis 540 is formed in an end portion of the arm 548 and is shaped to receive a post or guide 552 extending upwardly from the armrest support.

A push button 554 includes a flange portion 556 that is slideably mounted in a pair of tabs that form a track 558. The button has an arm extending from the flange that includes a post 560 received in the opening 546 of the pawl. A spring 562 is mounted to the armrest support and biases the end portion 544 of the pawl into engagement with at least one of the teeth on at least one of the pinion gears 524. Alternatively, or in combination therewith, a pair of springs 549 bias the push button away from the platform as they engage a pair of backstops 551.

In the embodiment of FIGS. 9 and 84, the pivot axis is formed at the junction of the first and second arm 538, 542, with the post 560 engaging the opening 546 or track in an end portion of the arm 548.

In the operation of either embodiment, the user pushes the push button 554 inwardly as it slides within the track 558 so as to move the post member 560 laterally inward. The post member 560 rotates the pawl 538 against the force of the spring 562, 549 about the pivot axis 540 and moves the end portion 544 thereof away from the teeth of the pinion gear(s) 524 to a disengaged position. When the desired lateral location of the armrest support is reached, the user releases the button 554, thereby allowing the spring 562, 549 to bias the pawl 538 to an engaged position with at least one of the pinion gear(s) 524. In the engaged position, the pawl 538 prevents the pinion gear(s) 524 from rotating about the axis, so as to prevent the armrest support 526 from being moved in the lateral direction.

It should be understood that a lever or actuator other than the push button can be employed to move the pawl from the engaged to disengaged position. Likewise, it should be understood that the pawl can be moved along a linear, rather than a rotational, path between the engaged and disengaged positions.

Referring to FIG. 2, a fastener 564 secures the armrest support 526 and the platforms to the guide member 494 and stem 454. In this way, the armrest support 526 pivots with the platforms 498, 506 about the guide member 494 as the armrest support is moved to the desired pivot position. A pad 566, preferably foam, and substrate 568 are secured to the armrest support with various fasteners and/or adhesive. The pad also can include various gels or other fluids and/or gases to provide a comfortable feel to the user's arm, which rests thereon. Preferably, the push button, or other actuator, is received in an opening or recess formed in the pad, and is configured with an outer contour shaped to mate with the outer contour of the pad.

Backrest:

Referring to FIGS. 11–13 and 23–32, a first embodiment of a backrest 300 includes a backrest frame member, or back support member 304, and a back member 302. The support member 304, otherwise referred to as a frame member, includes a lower support member 308 having a pair of forwardly extending arms 310 that are pivotally connected to the tilt control housing 10.

Figure 40:
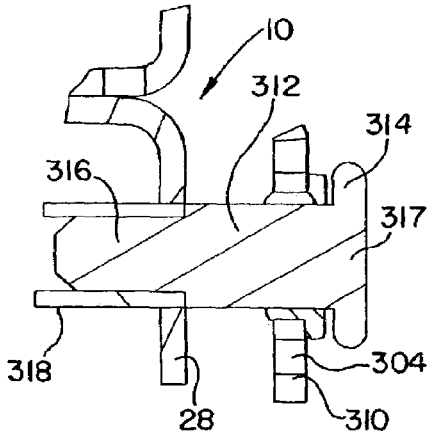
FIG. 40 is a partial cross-sectional view of the back support connected to the tilt control housing.
Figure 50:
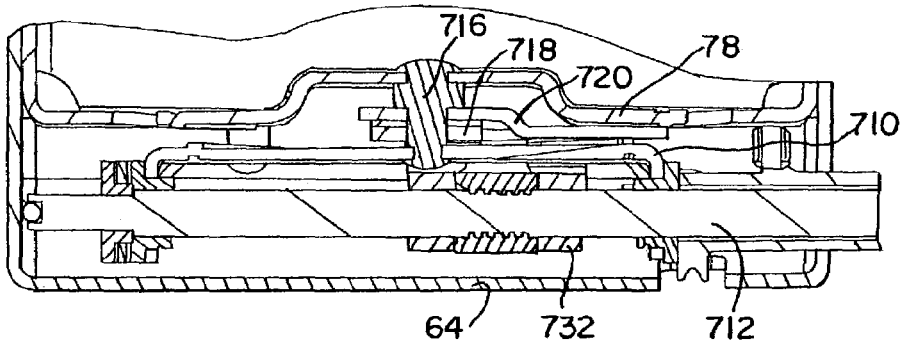
FIG. 50 is cross-sectional view of the linkage assembly for the fulcrum member.
Figure 58:
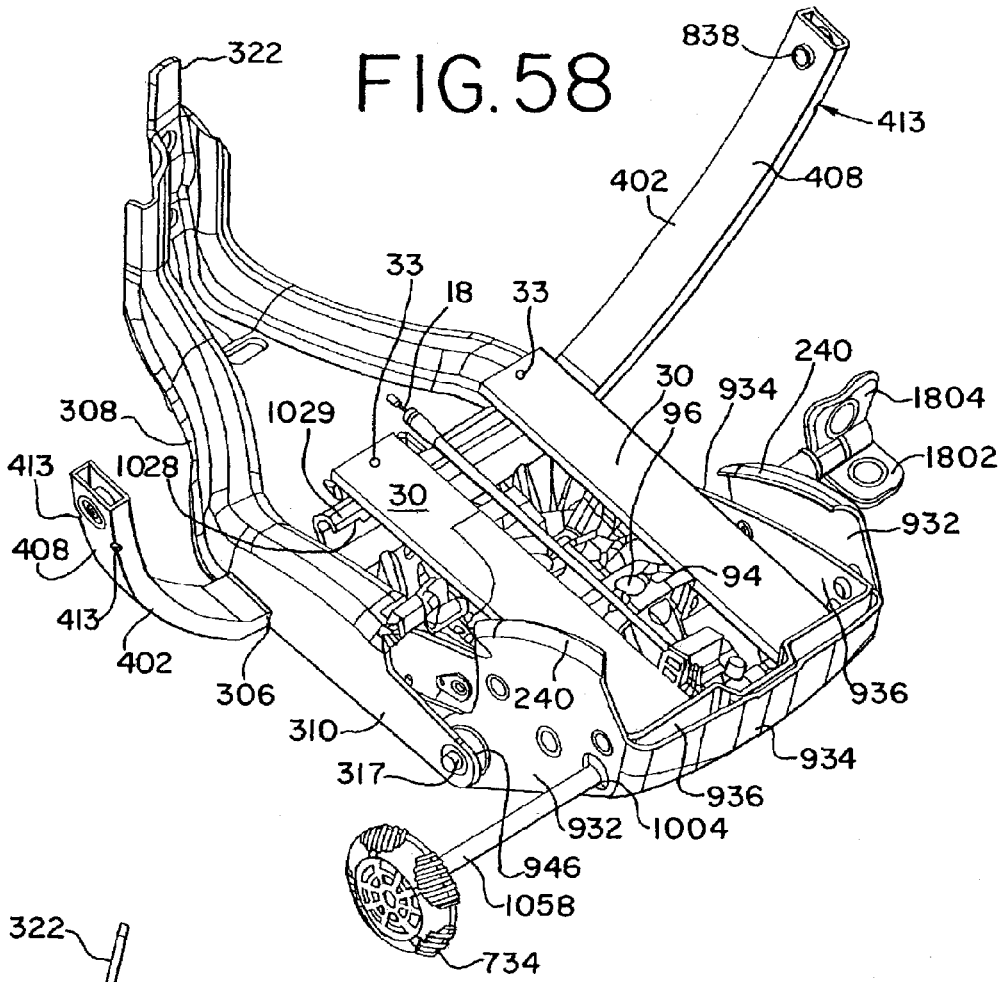
FIG. 58 is a perspective view of one embodiment of a tilt assembly and back support with the springs in a disengaged position.

As best shown in FIGS. 40, 58 and 60, the arms 310 are preferably supported on a pivot member 317. Referring to FIG. 50, in one preferred embodiment, the pivot member 317 has a pivot portion 312 having a first diameter, a flange 314 formed on one end thereof and an insert portion 316 having a second diameter less than said first diameter. The flange 314 or head engages or traps the lower support member arm 310. The insert portion 316 is press fit into a pivot tube 318 with an interference fit. The pivot tube 318 extends through an opening formed in the side wall 28 of the housing. As the insert portion 316 is press fit into the tube 318, it deforms or swages the ends of the tube against the side wall 28 to form a fixed joint therebetween, but allowing the support member 304, and in particular the arms 310, to freely pivot on the pivot portion 312 of the insert member. In this way, a simple press-fit operation secures the back support member 304 to the housing 10. Of course, it should be understood that other seating components, such as the seat, could also be secured to the back support or housing in this manner. The pivot portion 312 of the pivot member can be lengthened to accommodate springs as further explained below.

Referring to FIGS. 13, 43 and 58–60, the lower support member 308 further includes a pair of openings 306 that receive the lower portions of the armrest as previously explained. In the embodiment shown in FIGS. 13 and 43, the lower support member 308 further includes a support member 320 extending laterally and substantially horizontally between opposite sides thereof for engagement with a pair of leaf springs 30, as will be explained in more detail herein below.

As shown in FIGS. 23, 39, 43, 58–60, 73 and 88, a rear portion of the lower support member forms an upwardly extending arm 322. An upper support member 324, or spine, has a lower end 326 that mates with and is secured to the arm 322 with a pair of fasteners 327. A cover can be disposed over the fasteners to provide a smooth, aesthetic appearance. By making the support member 304 in two-pieces 308, 324 the backrest can be disassembled and the chair can be shipped in a smaller package. In particular, the arm 322 of the lower backrest support preferably does not extend upwardly above the uppermost surface of the armrests, such that the base, seat and armrests can be compressed to a relatively short height. In turn, the backrest 300 can be easily assembled by the end user with a pair of fasteners. Moreover, the backrest can be made offline, if desired. As shown in FIGS. 24, 25, 73 and 88, the lower end 326 of the spine flares outwardly and defines a pair of opposite landings 328 that mate with the back member 302.

Figure 32:
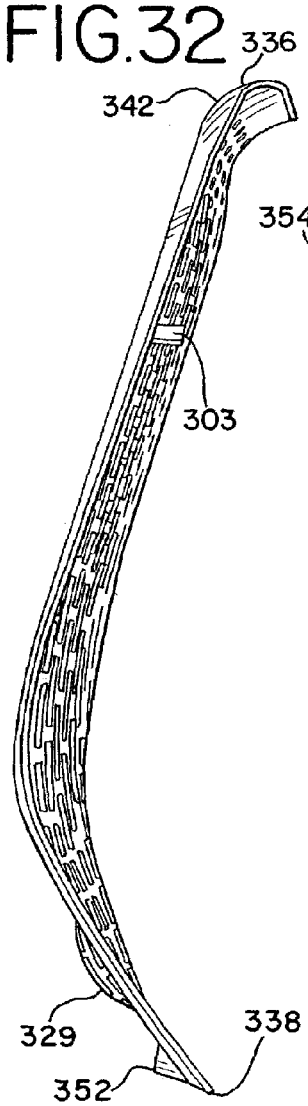
FIG. 32 is a side view of the back member.
Figure 73:
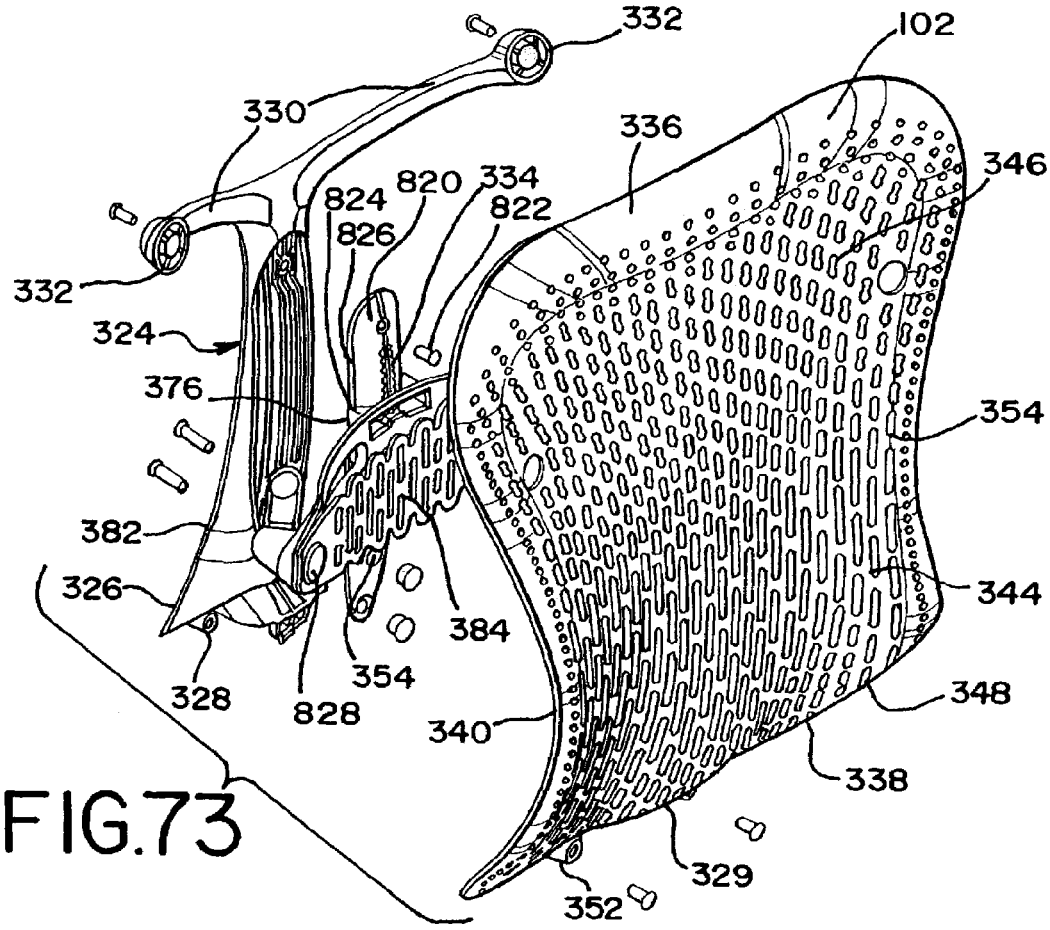
FIG. 73 is an exploded perspective view of a backrest assembly.
Figures 88, 89, 90:
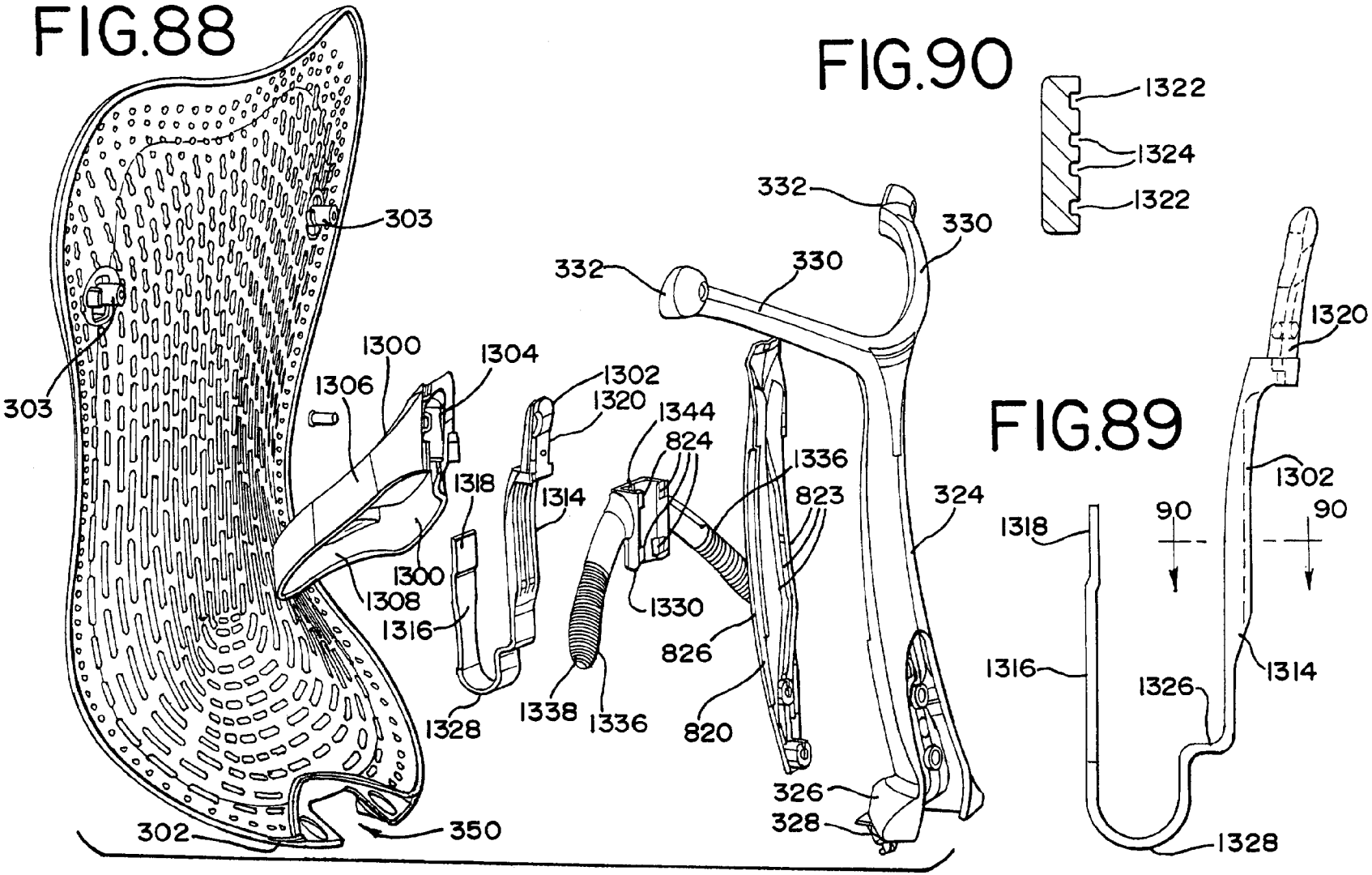
FIG. 88 is an exploded perspective view of a backrest assembly.
FIG. 89 is a side view of a back support member.
FIG. 90 is a cross-sectional view of the back support member taken along line 90-90 of FIG. 89.
Figure 91:
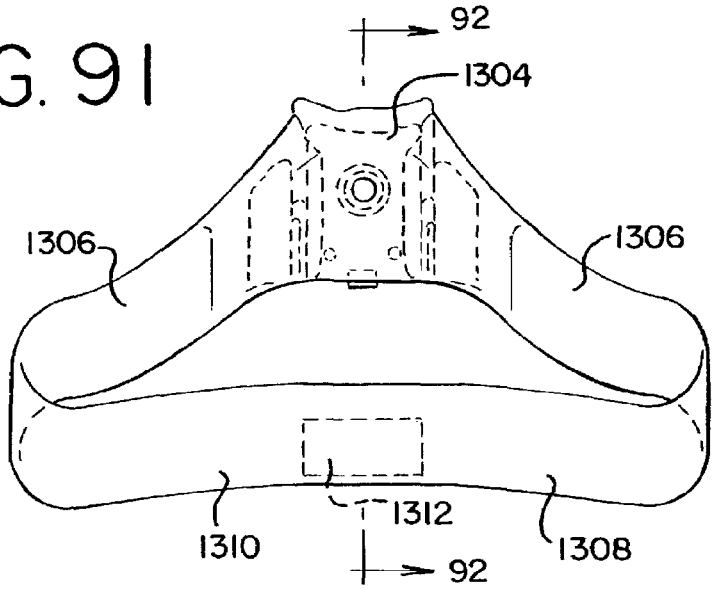
FIG. 91 is a front view of a back support member.

The spine 324 extends upwardly and has a pair of arms 330 that extend upwardly and outwardly from an upper end thereof. The ends of the arms each have a pad 332 that is secured to the back member 302 with a fastener. In particular, as shown in FIGS. 32 and 88, a boss 303 extends from the rear of the back member and supports the pad and receives the fastener. A front surface of the spine has a rack 334, or a plurality of notches formed thereon. The spine is preferably made of aluminum, steel, fiberglass, composites, plastic, or some other rigid but resilient material. As shown in the embodiment of FIGS. 73 and 88, the rack 334 is formed on a lumbar support insert 820, which is secured to the front side of the spine with a plurality of fasteners 822. The lumbar support insert 820 and spine can be made of various materials, such as Capron 8233G—33% Glass Filled Nylon 6.

Figure 78:
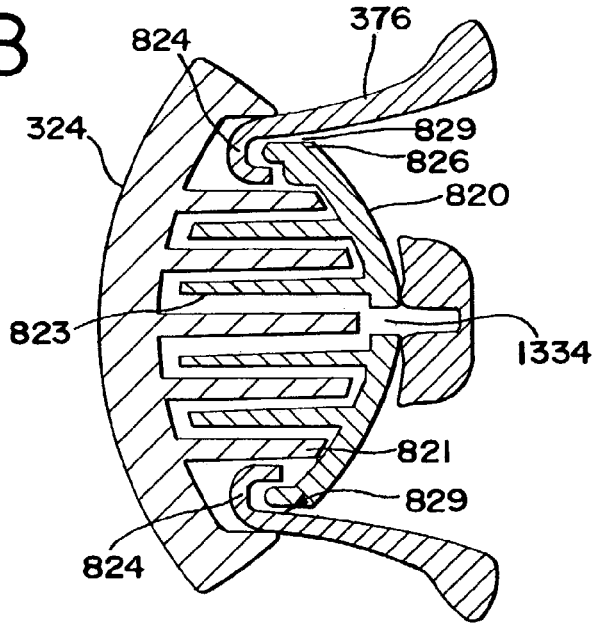
FIG. 78 is a cross sectional view a back support member.

Referring to FIGS. 73, 78 and 88, in one preferred embodiment, the spine 324 has a plurality of forwardly extending fins 821, while the lumbar support insert 820 has a plurality of rearwardly extending fins 823 that are shaped to be inserted or nested in the spaces formed between the plurality of fins 821. In this way, the spine and insert are very strong and resistant to bending, yet provide substantially torsional flexibility. In addition, the two pieces can be easily made from molded plastic, with thinner walls and less material. In addition, the insert 820 and spine 824 can be spaced apart along the sides thereof to form a gap.

Referring to FIGS. 23, 28–32, 73, 74, 88 and 95–96, the back member 302 is preferably made of a resilient, compliant material, including various polymeric or plastic materials. For example, in one preferred embodiment, the back member is molded of a polypropylene 76523 Montel Profax material. The back member 302 has a top 336, a bottom 338 and opposite, curvilinear sides 340. The sides 340 preferably have a concave, or hour-glass shape. The top 336 of the back member is preferably curved and has a convex front, body-supporting surface 342 along a peripheral portion thereof.

Figures 28, 29, 30:
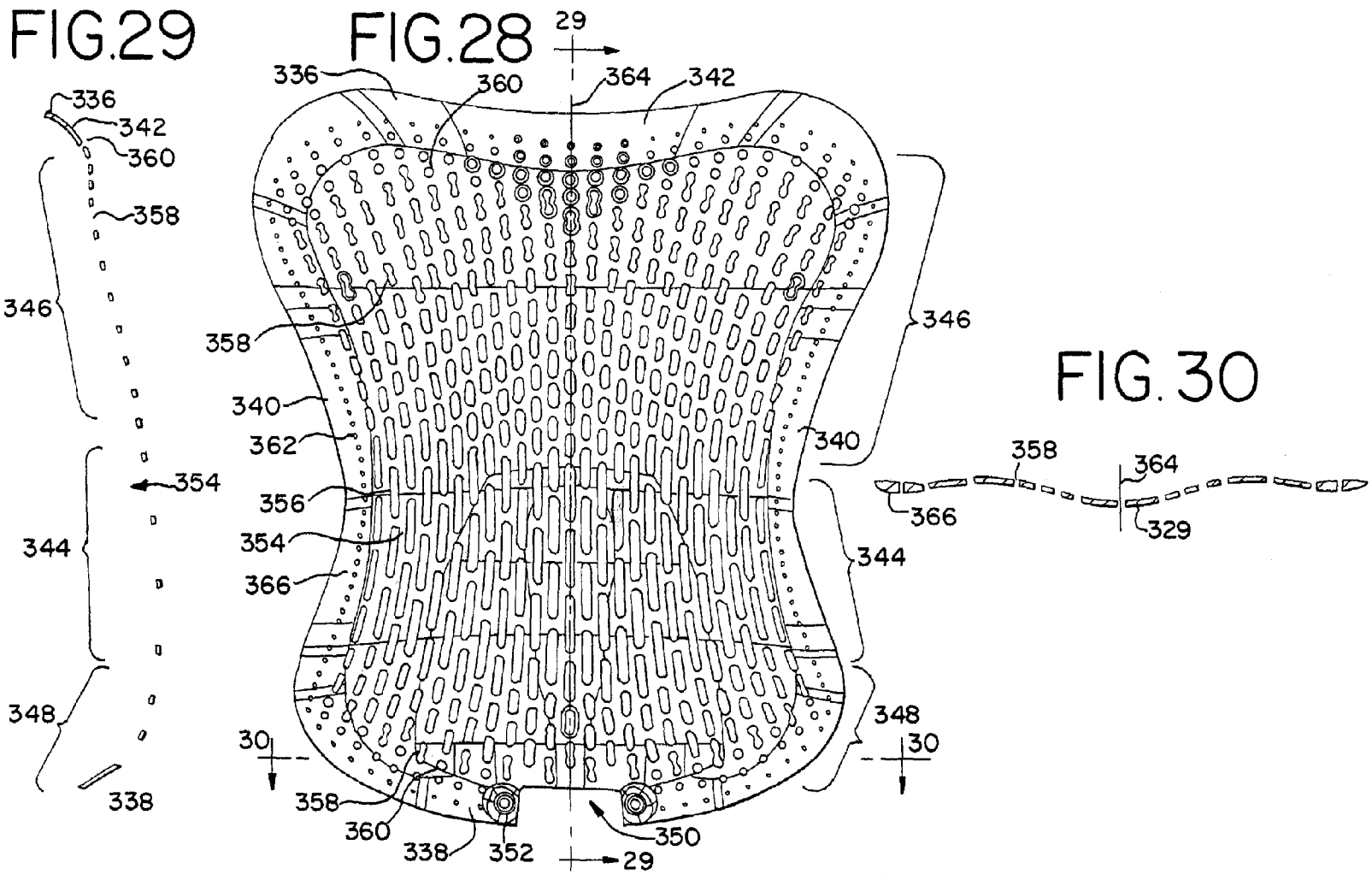
FIG. 28 is a front view of a back member.
FIG. 29 is a cross-sectional view of the back member taken along line 29-29 of FIG. 28.
FIG. 30 is a cross-sectional view of the back member taken along line 30-30 of FIG. 28.
Figure 31:
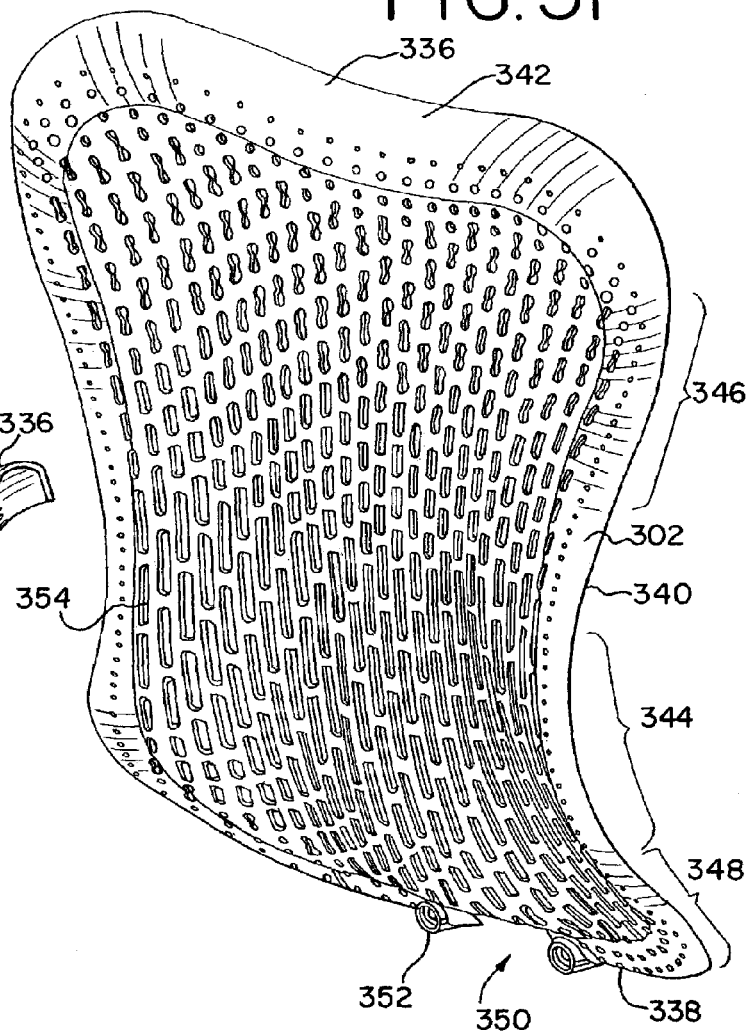
FIG. 31 is a perspective view of the back member.

The back member has a lumbar region 344, a thoracic region 346 and a lower region 348. The lower region includes a cut-out 350 shaped to be received on the lower end 326 of the spine, with a pair of bosses 352 positioned to mate with holes formed in the landings 328. The lower region also includes a sacral support 329, formed by a forwardly extending portion at the center of the lower region, as shown in FIGS. 32, 30 and 73. A pair of fasteners secure the bottom of the back member 302 to the landings 328. The back member 302 has a plurality of openings 354 formed therethrough. Preferably, an array of openings in the lumbar region 344 are elongated in the longitudinal direction, which runs between the top and the bottom of the back member. The openings 354 are preferably staggered. For example, in one preferred embodiment, adjacent vertical columns of openings are offset in the vertical direction, such that the openings in adjacent columns are not horizontally aligned.

As with the lumbar region 344, the thoracic region 346 also includes an array of staggered elongated openings 354. Preferably, the elongated openings formed in the thoracic region are not as elongated, on average, as the openings in the lumbar region. This means, of course, that an occasional opening, or plurality of openings, in the thoracic region can have a greater elongation than an opening or plurality of openings in the lumbar region.

Likewise, the lower region 348 has an array of staggered elongated openings 354 formed therein, again, with an average elongation less than that of the lumbar region.

Figure 74:
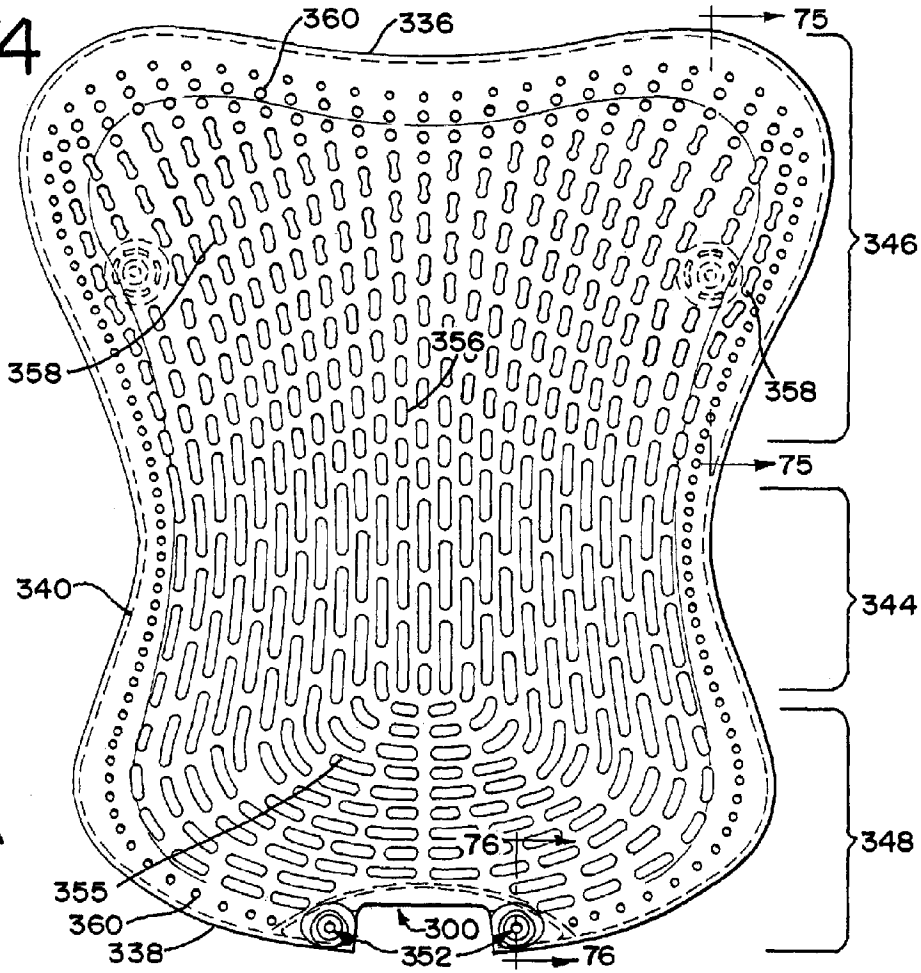
FIG. 74 is front view of a back member.
Figure 75:
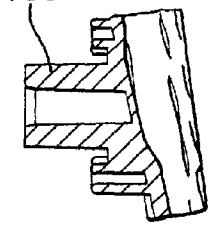
FIG. 75 is a partial cross-sectional view of a back member taken along line 75-75 of FIG. 74.
Figure 76:
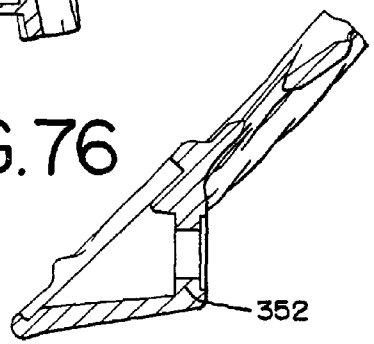
FIG. 76 is a partial cross-sectional view of a back member taken along line 76-76 of FIG. 74.

Referring to FIGS. 74, in one alternative embodiment, the elongated openings 355 in the lower region transition from a longitudinal orientation to a lateral orientation, with the transition being made progressively lower as it moves from a center line outboard, so as to form a generally triangular region of lateral openings. Some of the openings are curved to make the transition.

The elongated openings in the lumbar region and the adjacent transition areas of the thoracic and lower regions are preferably obround 356. The shapes of the openings then transition from the obround shape to a peanut-shaped opening 358 as the location thereof moves upwardly and downwardly from the lumbar region, and then eventually the peanut-shaped openings are closed at a middle thereof to form substantially circular openings 360 adjacent the top and bottom of the back member. In addition, smaller circular openings 362 are formed along the opposite sides of the back member, including at the lumbar region, and around the entire peripheral portion of the back member. In the embodiment of FIG. 74, the openings in the lower region do not transition to a peanut shape, but rather preferably stay obround, with an outer perimeter of circular openings 362.

Figure 77:
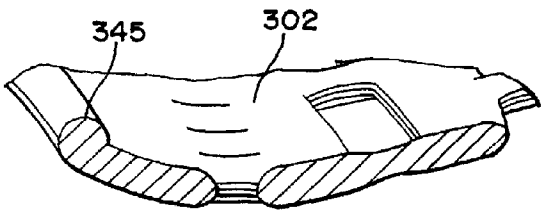
FIG. 77 is a partial cross-sectional view of a portion of a back member.

The back member 302, especially in the lumbar region, also preferably has a first thickness along the center line 364 thereof, and a second thickness at the peripheral sides 366 thereof, with the second thickness being greater than the first thickness, as shown for example in FIG. 30. For example, in the lumbar region, one preferred first thickness is about 2 mm, and one preferred second thickness is about 3 mm. As shown in FIGS. 29 and 32, the back member is preferably bowed forwardly at the lumbar region 344. As shown in FIG. 77, the edge of the back member preferably is formed as a bead 345. The back member is preferably formed by molding.

Figure 24:
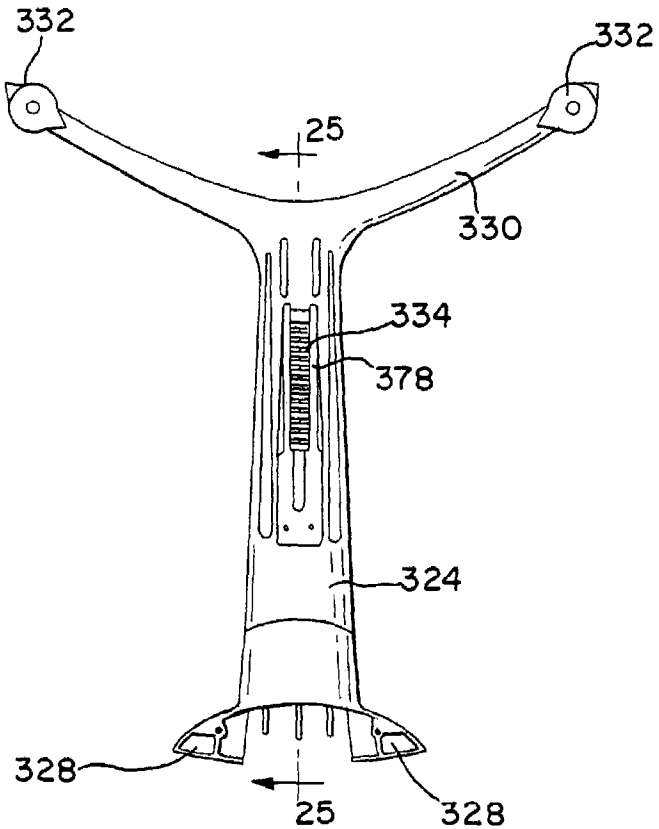
FIG. 24 is a front view of a backrest frame member.
Figure 27:
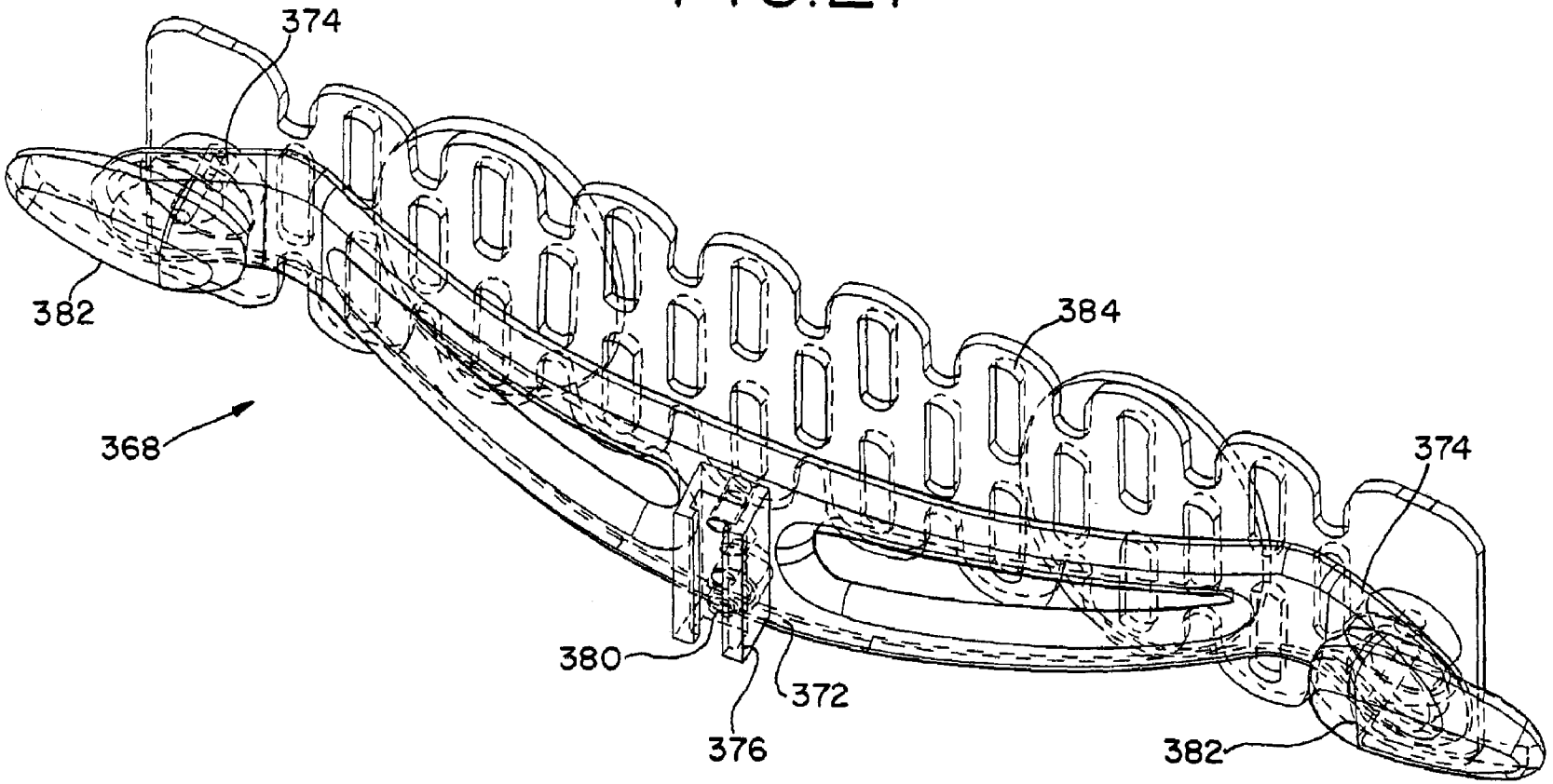
FIG. 27 is a rear perspective view of a lumbar support.

Referring to FIGS. 27, 72, 73 and 79, a first back support configuration includes a lumbar support 368 having a lumbar frame member 370, configured as a bow spring having a center portion 372 and opposite ends 374. The center portion 372 includes a guide member 376 that interfaces and slides on a track 378 formed along a portion of the length of the spine, as shown in FIG. 24.

Figure 72:
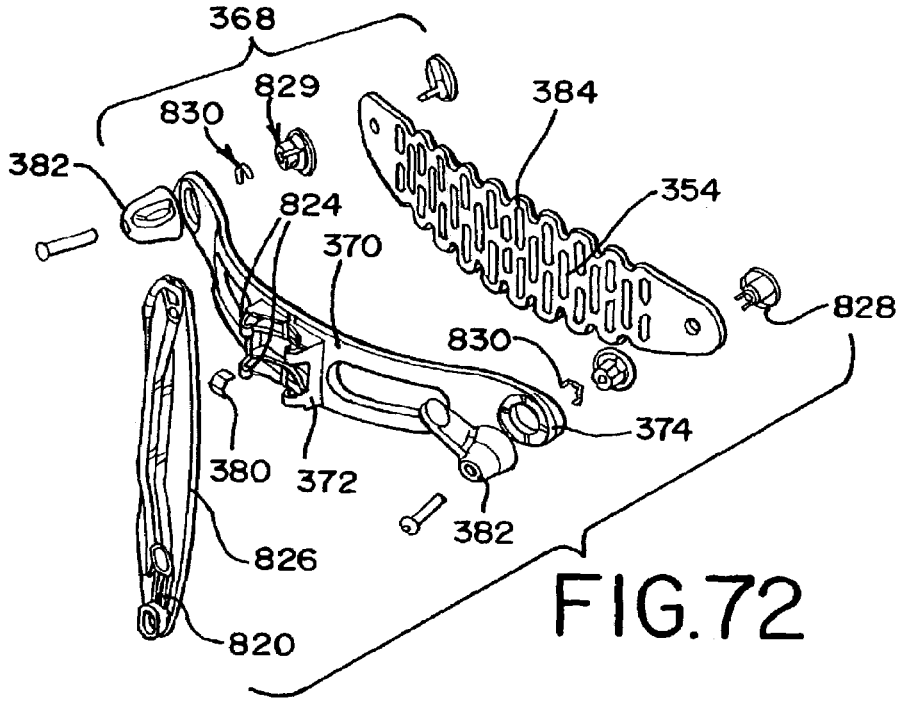
FIG. 72 is an exploded perspective view of a lumbar support assembly.

In the embodiment shown in FIGS. 72, 73 and 78, the guide 376 includes a plurality of hook members 824 that engage and slide along the sides 826 of the lumbar support insert 820. Preferably, the hook members 824 extend through the gap 829 formed between the spine 324 and the insert member 820. In one preferred embodiment, the center portion 372 or guide member further includes a spring detent 380 that is engaged with the rack 334 to releasably secure the lumbar support 368 in a plurality of vertical positions. Other devices, such as set screws, pawl mechanisms, latches, friction cams and the like can be used to secure the lumbar in various positions.

Figure 79:
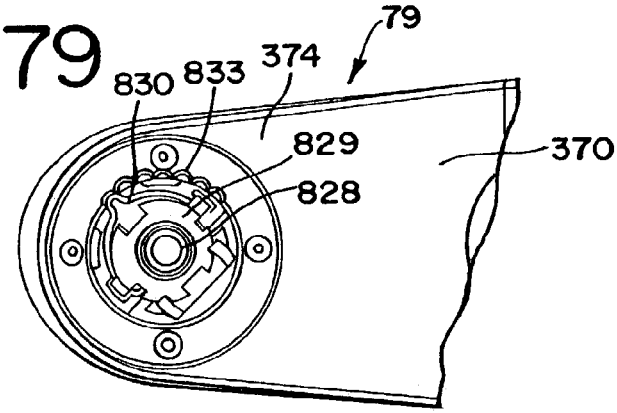
FIG. 79 is a partial rear view of a lumbar support member.

Referring to FIGS. 72, 73 and 79, a knob 382 is rotatably mounted in each end of the bow member. The knob 382 includes a mounting arrangement, such as a retainer 829 having an opening offset from the axis of rotation of the knob. A lumbar belt 384 extends between the end portions 374 and is secured to the knobs 382 with a fastener 828 at the offset opening. The belt engages and supports a rear surface of the back member. The knobs 382 can be rotated, which rotates the fasteners 828, to thereby put the strap 384 in tension and increase the amount of lumbar support. The retainer 829 holds a detent 830 in engagement with a circumferential rack 833 formed along the inside of the opening in the bowed frame 370, such that the knob 382 can be indexed in a plurality of rotational positions.

The lumbar frame member and strap are preferably made of nylon, but can be made of other materials, such as metal, wood, composites, fiberglass, plastics and the like. The strap preferably includes a plurality of staggered, elongated openings 354 formed therethrough. One or more lumbar pads can be attached to the strap, or disposed between the strap and the back member.

Figure 92:
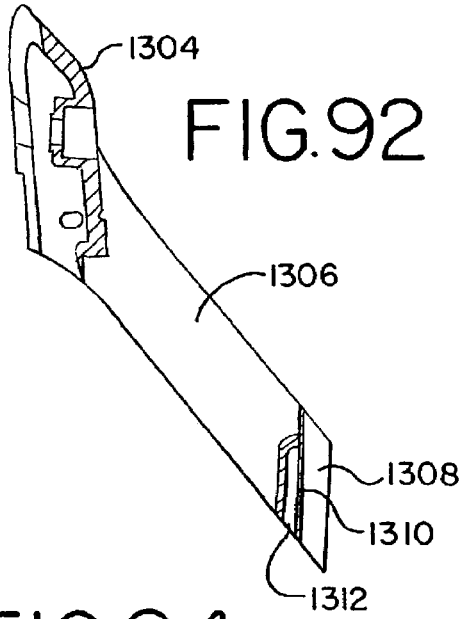
FIG. 92 is a cross-sectional view of the back support member taken along line 92-92 of FIG. 91.
Figure 93:
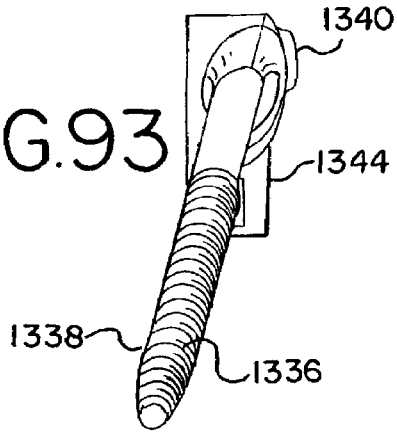
FIG. 93 is a side view of a back support fulcrum member.
Figure 94:
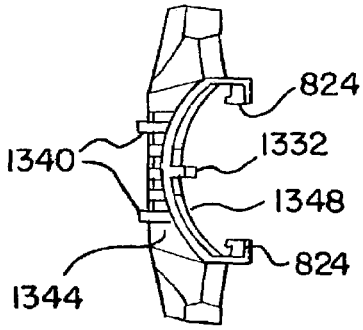
FIG. 94 is a partial top view of the back support fulcrum member shown in FIG. 93.
Figure 97:
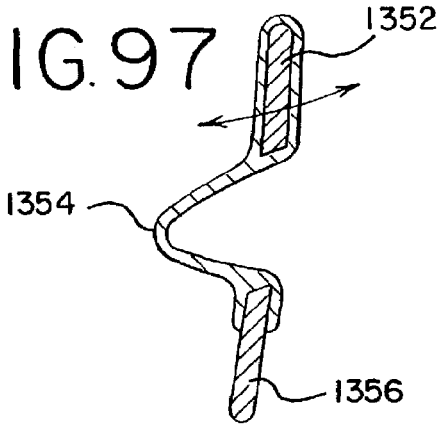
FIG. 97 is a partial cross-sectional view of the back member taken along line 97-97 of FIG. 96.

Referring to FIGS. 88–94, a second back support configuration includes a first support member 1300 and a second support member 1302. In one preferred embodiment, the first support member 1300 is formed as a loop having a base 1304, a pair of arms 1306 and a support band 1308 or belt extending between the two arms 1306. The support band has a forwardly facing surface 1310 that engages and supports a rear surface of the back member 302. A downwardly opening recess 1312 or pocket is formed in the middle portion of the belt, as best shown in FIG. 92. The recess 1312 forms a guide or track for a portion of the second support member 1302.

As best shown in FIGS. 88–90, the second support member 1302 has a J-shape, with a base arm 1314 connected to a support arm 1316 having an end 1318, which is shaped and configured to be received in the recess 1312 of the second support member. The bottom of the J-shaped support member 1302, or a curved portion 1328 forms a free end of the support member 1302. The end 1318 of the support arm is supported by the lumbar support 1300 as it slides vertically in the recess, so as to allow the first and second support members to function independently. At the same time, the loop supports the support arm 1316 laterally and in the fore/aft direction. Alternatively, the end 1318 of the support arm 1316 can remain unsupported, or it can be fixedly connected to the support member 1300, of lumbar support, or to the frame.

The base arm 1314 has an upper end 1320 disposed between the base of the first support member and the lumbar insert member. A fastener secures the first support member 1300 and the second support member 1302 to the insert member 820. The arms 1314, 1316 of the second support member, once installed, function as a cantilevered spring, which is supported at ends 1302 and 1318 and has free end 1328. The base arm 1314 has a plurality of longitudinally extending and rearwardly facing grooves 1322, 1324, which define a plurality of ridges. The base arm 1314 also has a step 1326 formed at the bottom thereof, which is connected to the curved portion 1328 that transitions to the support arm 1316 and provides additional flexibility between the arms 1314 and 1316. In this way, the overall support member 1302, including both arms acting in concert, functions as a cantilevered spring, while the individual arms 1314, 1316 act as individual springs that provide additional independent flexibility.

Referring to FIGS. 78, 88 and 93–94, a fulcrum member 1330 is disposed between the insert member 820 and the base arm 1314 of the second support member. The fulcrum member includes a base portion 1344 forming a cavity 1348 that substantially surrounds and conforms to the forward surface of the insert member 820. The base portion includes a plurality of hook members 824 that engage and slide along the sides 826 of the lumbar insert support member 820. Preferably, the hook members extend through the gap 829 formed between the spine and the insert member. In one embodiment, the fulcrum member further includes a detent or latch member that engages the rack to releasably secure the fulcrum member in a plurality of vertical positions. Alternatively, or in combination, the fulcrum includes a guide member 1332 or ridge formed in the cavity 1348 that rides in a groove 1334 formed in the spine insert member. In one embodiment, the fulcrum member includes a pair of handles 1336. The handles extend outwardly and downwardly and include a grippable portion 1338, formed form example as a plurality of annular ridges, on the ends thereof. The front portion of the fulcrum member include a pair of guide members 1340 or tabs that ride in the outer channels 1322 formed in the base support arm. The fulcrum, first support member and second support member are preferably made of one or more types of plastic, such as nylon or glass-filled nylon, but can be made of other materials, such as metal, wood, composites, fiberglass and the like.

It should be understood that in an alternative embodiment, one or all of the sacral support member, the lumbar support member and the fulcrum member can be connected to the back member and engage the frame.

In operation, the user grips one or both of the fulcrum handles 1336 and moves the fulcrum in the vertical direction to a desired position. As the fulcrum is lowered, it shortens the cantilevered length of the support member 1302, i.e., the distance between the fulcrum and the bottom curved portion 1328, and the arms 1314, 1316 in particular, and provides a firmer, more rigid support for the lower region 348 of the back member as it engages the rear surface thereof. The user can raise the fulcrum 1330 so as to provide a greater cantilevered length, which in turn provides more flexibility of the support member and a corresponding less rigid support of the back member in the lower region.

Figure 96:
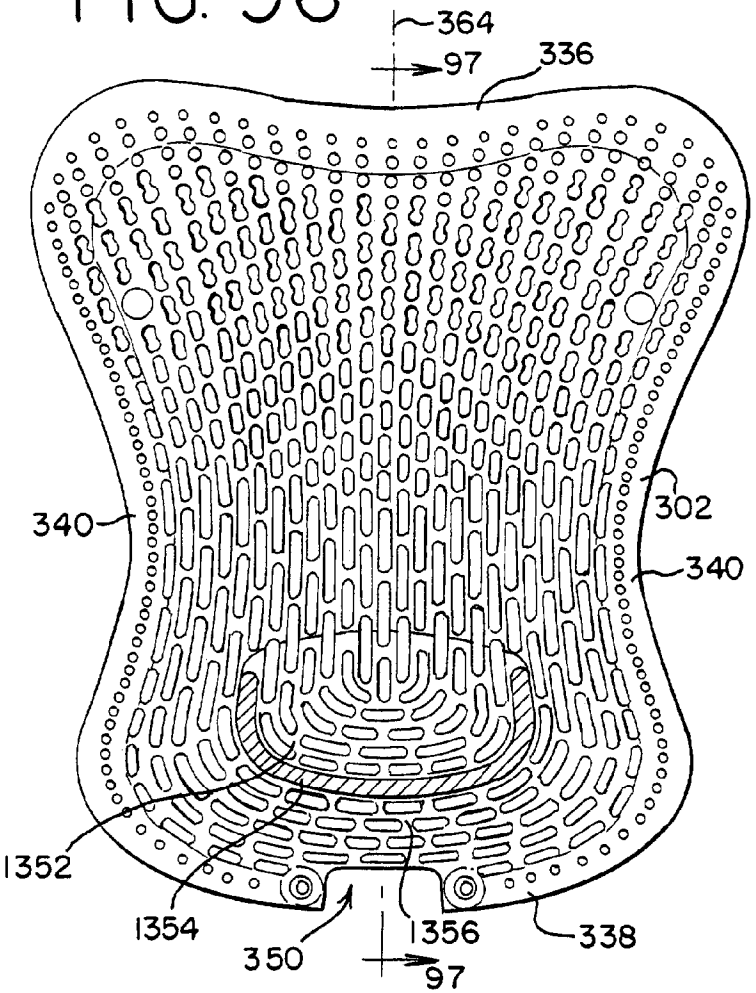
FIG. 96 is a front view of the back member shown in FIG. 95 with a hinge portion overmolded thereon.
Figure 95:
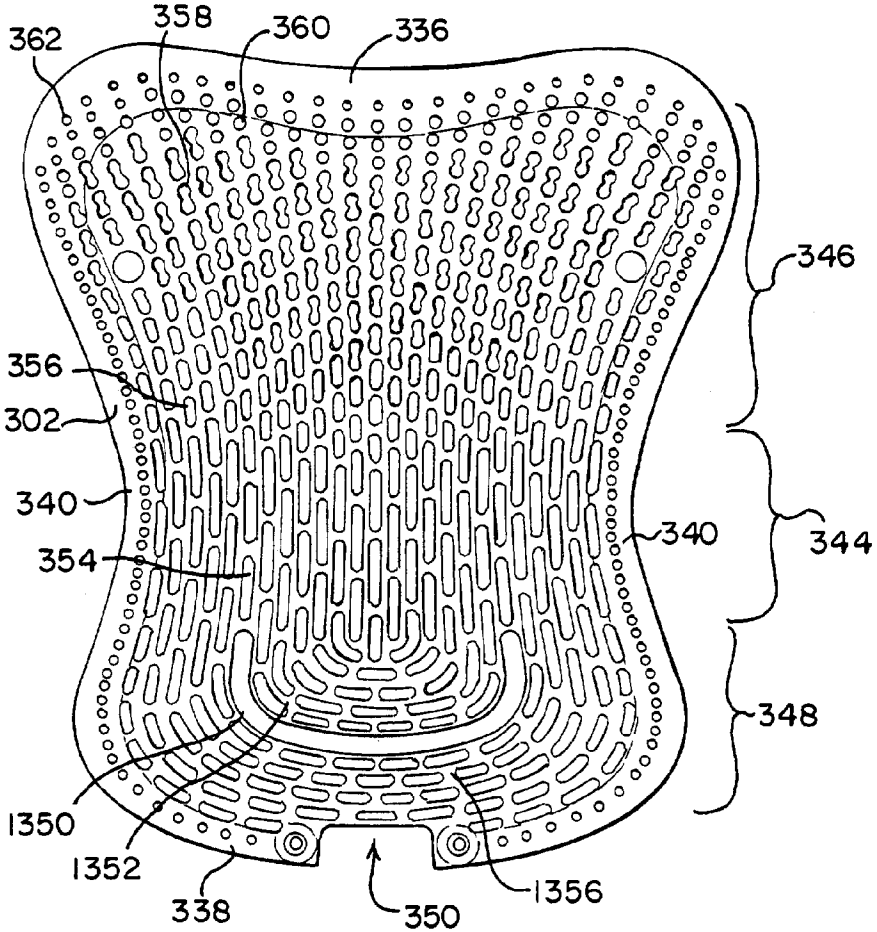
FIG. 95 is front view of a back member with a cut-out therein.

Referring to FIGS. 95 and 96, the back member 302 can be modified to improve the flexibility of the lower region thereof. In particular, a U-shaped cut-out 1350 can be made in the lower region, for example along one row of openings 354 as they transition from the vertical to the horizontal. In this way, the lower region 348 is provided with a central flap 1352 or support region at the sacral region of the user's back, which is spaced from a firmer lower portion 1356. The back member is then inserted into a mold, wherein a hinge portion 1354 is overmolded on the back member over the cut-out so as to flexibly connect the flap 1352 with the lower portion 1356 of the back member. In one embodiment, the hinge 1354 is formed as a living hinge, with a bellows shape. Of course, it should be understood that the hinge can be in-molded in the original back member, which thereby avoids the cutting and overmolding operations. In addition, it should be understood that the back member can be provided with greater flexibility by providing a thinner material in certain regions, or by providing other hinge type devices, not limited to a living hinge or molded hinges. In this way, the flap portion 1352 of the lower region 348 of the back member being acted upon by the support arm 1316 of the first support member is provided with greater flexibility to move in response to the position of the support member 1302 as the fulcrum member is moved to a desired position. In one embodiment, the hinge is formed from an elastomeric material, such as a thermoplastic elastomer.

The configuration of the spine 324 and back member 302 provides many advantages. For example, the compliant back member 302, with its larger, or longer, openings in the lumbar region, and its lesser thickness along the center portion, allow that region to be more flexible, such that it can be formed and supported by the lumbar support and/or sacral support. In addition, the entire back is allowed to conform to the back of the user, and in particular at the edge portions thereof, and can flex about the center spine in torsion, which is made more flexible by way of the two-piece construction with nested fins, and also about the bowed lumbar region. In essence, the intelligence of the backrest is shared by the spine 324 and the back member 302. In this way, the backrest provides greater comfort than a backrest formed with a peripheral, and relatively stiff or non-compliant, frame. In addition, by securing the back member 302 to the arms of the spine at a location spaced below the top of the back 336, including at about 14 inches in one embodiment, and preferably between about 2 inches and about 12 inches, and more preferably between about 4 inches and about 8 inches, the top peripheral portion can flex in response to movement from the user's shoulder and neck and further avoids a "hammock" effect between the top and bottom of the backrest.

In addition, the spine member is in essence modular, or provides a mounting configuration, which allows the manufacturer to install various support configurations on the same spine. In this way, for example, different back supports can be configured to mount on the same spine to provide an adjustable lumbar support, or a lumbar support with an adjustable sacral support. Of course, other adjustment configurations would be suitable.

Referring to FIGS. 33–38, an alternative preferred embodiment of the backrest is shown. In this embodiment, the upper portion of the spine 324 is formed as a pair of opposite shoulder portions 386, or ears. The shoulder portions 386 preferably are formed as loops that extend upwardly, outwardly and forwardly from the center spine 324. Preferably, the outermost portion of the shoulders 386 extends forwardly the greatest amount and forms a forwardly facing and forwardly opening cavity or recess 388 with the center portion of the spine. The lower end of the spine 326 is mated with the lower support member as explained above. A lumbar support 368 is mounted to the forward face of the spine as explained above. The lumbar support is substantially the same as previously described, except that the lumbar belt or strap 384 has a greater height so as to provide a support over a greater vertical area.

Figure 33:
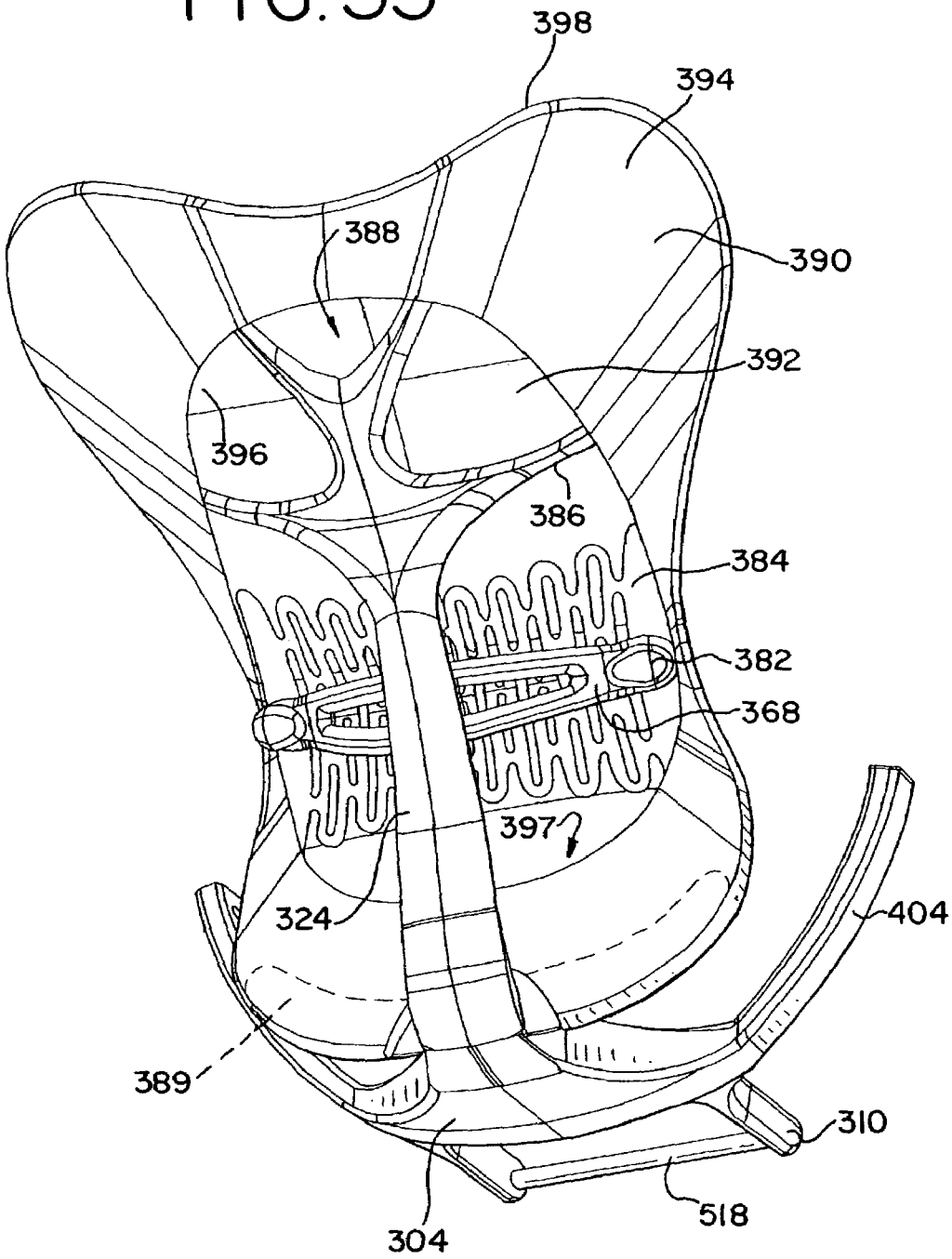
FIG. 33 is a rear perspective view of an alternative embodiment of a backrest.
Figure 35:
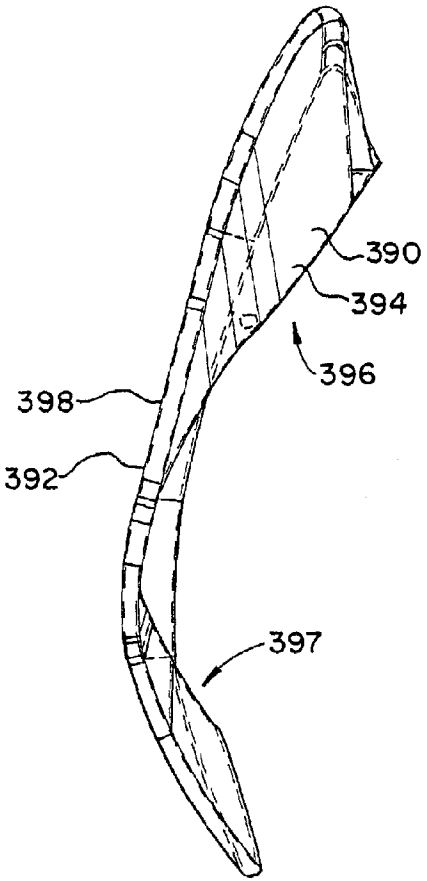
FIG. 35 is a side view of the back member shown in FIG. 34.
Figure 34:
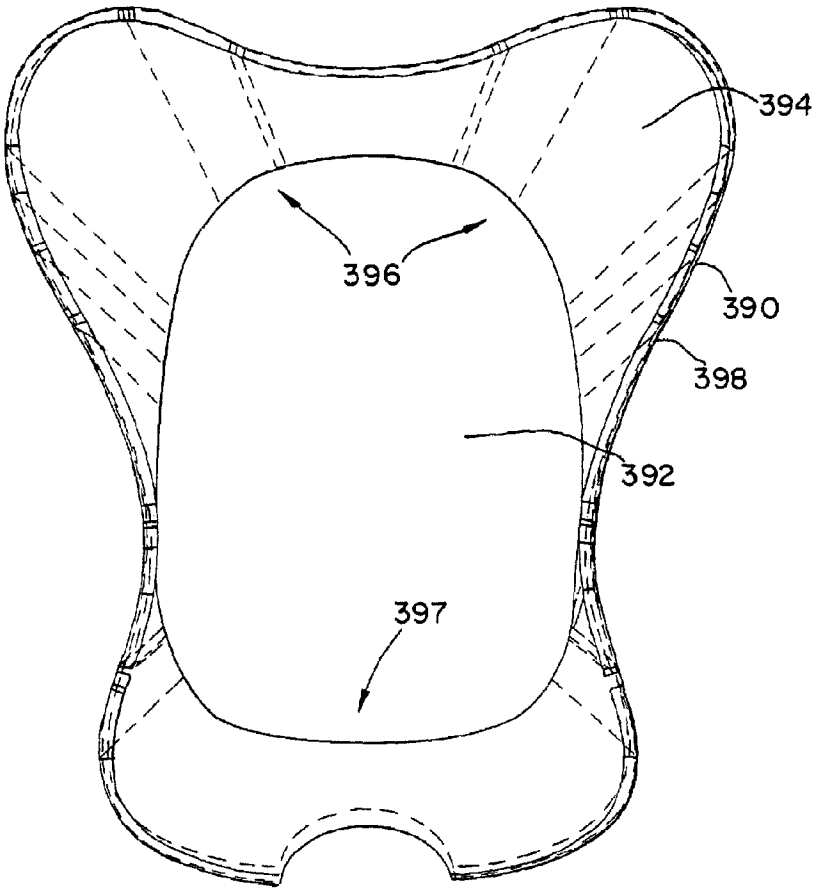
FIG. 34 is a rear view of a back member.
Figure 36:
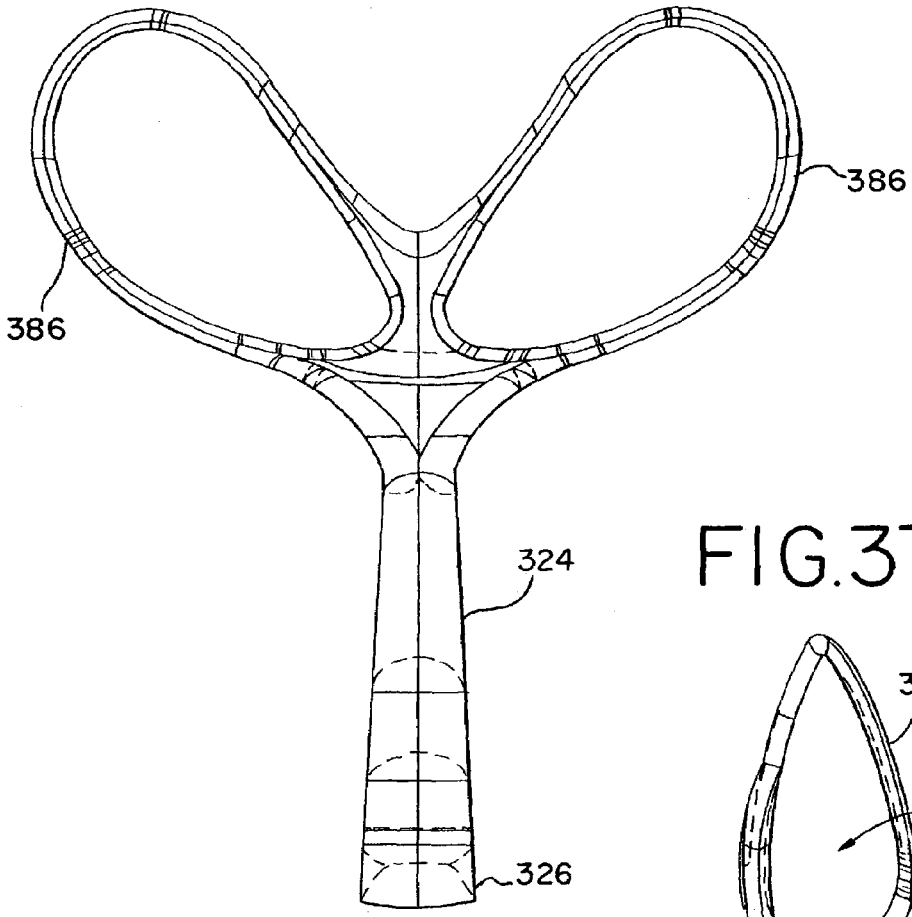
FIG. 36 is an alternative embodiment of a backrest frame member.
Figure 37:
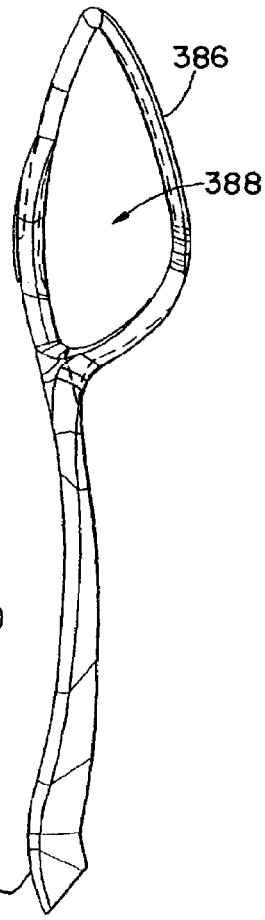
FIG. 37 is a side view of the backrest frame member shown in FIG. 36.
Figure 38:
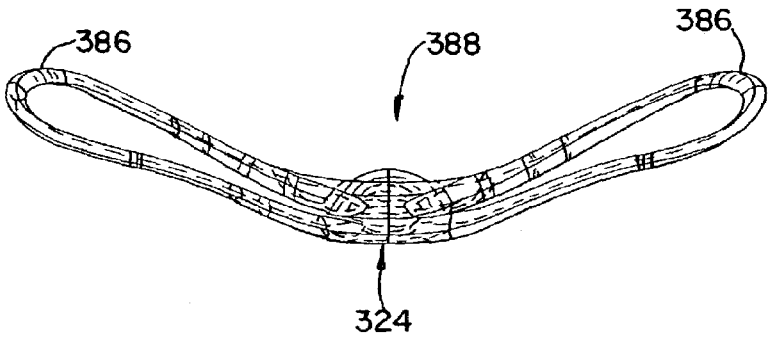
FIG. 38 is a top view of the backrest frame member shown in FIG. 36.
Figure 39:
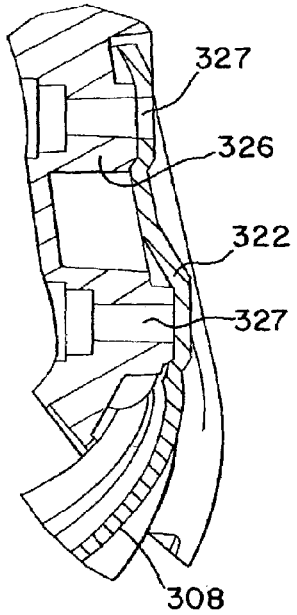
FIG. 39 is a partial cross-sectional view taken along line 39-39 in FIG. 23.

Referring to FIGS. 33–35, a fabric member 390 is shown as having a front web 392 with a front, body-supporting surface and a rear surface. The fabric member has a top, a bottom and opposite sides, which are preferably curved and have an hour-glass shape. The top preferably is curved slightly downwardly in the middle thereof between the shoulders. A rear web 394 is secured to the front web along a seam 398 that defines the periphery of the fabric member. The front and rear webs can be made of separate materials, or can be made from a single piece of material. The front and rear web form an upper and lower pocket 396, 397. The fabric member is preferably made of a polyester material, although it should be understood that it can be made of any type of flexible, woven, molded or non-woven materials, including various elastomeric materials and yarns.

The shoulder portions 386 of the frame member are received in the upper pocket 396, the periphery of which is shaped to mate with and conforms to outer periphery of the shoulder portions. A lower frame member 389 is disposed in the lower pocket 397 and is attached to the lower end of the spine 324. As the lower frame member is secured to the spine, the fabric member 390, and in particular the front web 392, is put in tension and is stretched tight between the lower frame member 389, the shoulder portions 386 of the upper frame member and the lumbar support 368. Because of the unique shape of the shoulder portions 386 and spine 324, the fabric member 390, and in particular the front web 392, is suspended in front of the cavity 388 and is free of contact on the rear side thereof along substantially the entire thoracic region, thereby providing the user with a unique suspension feel. In addition, the fabric is inexpensive to manufacture, and can be easily changed if damaged, or if a different aesthetic is desired. Moreover, the spine acts as a torsion spring, and the shoulder portions as springs, to provide a resilient feel to the user. The lumbar support 368 engages the rear side of the front web 392 and provides support for the user's lower back.

Seat:

Referring to FIGS. 11–17, 71 and 82, the chair includes a primary and an auxiliary seat support 202, 204. A pair of support brackets 206 are secured through slots 208 in the primary seat support. Each support bracket 206 includes a support member 210 that extends upwardly above the primary seat support 202 and the seating surface of the membrane 212 supported thereby. The support member 210 is secured to the armrest spine with the pivot member 418, 818, which extends through the opening in the stem. A cover 832 can be disposed over the seat support bracket. The pivot member 418, 818 is located at the approximate hip joint of the user, as further explained in U.S. Pat. No. 6,059,368, which is hereby incorporated herein by reference.

In a preferred embodiment, shown in FIG. 71, a socket member 834 is secured in the support member 210. A ball member 836 is disposed on the end of the pivot member 818, and is matingly engaged with the socket member 834, so as to allow rotation of the ball member relative to the socket member about multiple axes. The opposite end of the pivot member 818 is threadably engaged with a nut member 838, which is secured, preferably by welding, to the arm spine 408.

Figure 16:
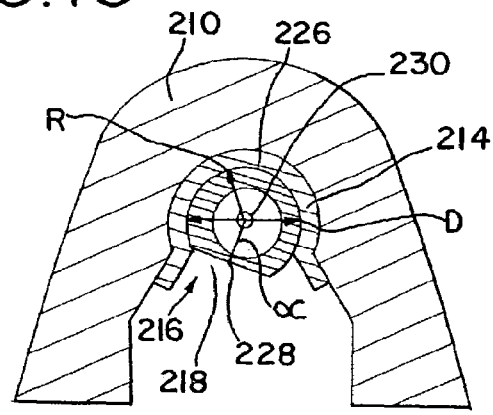
FIG. 16 is a cross-sectional view of the armrest and seat taken along line 16-16 of FIG. 15.
Figure 17:
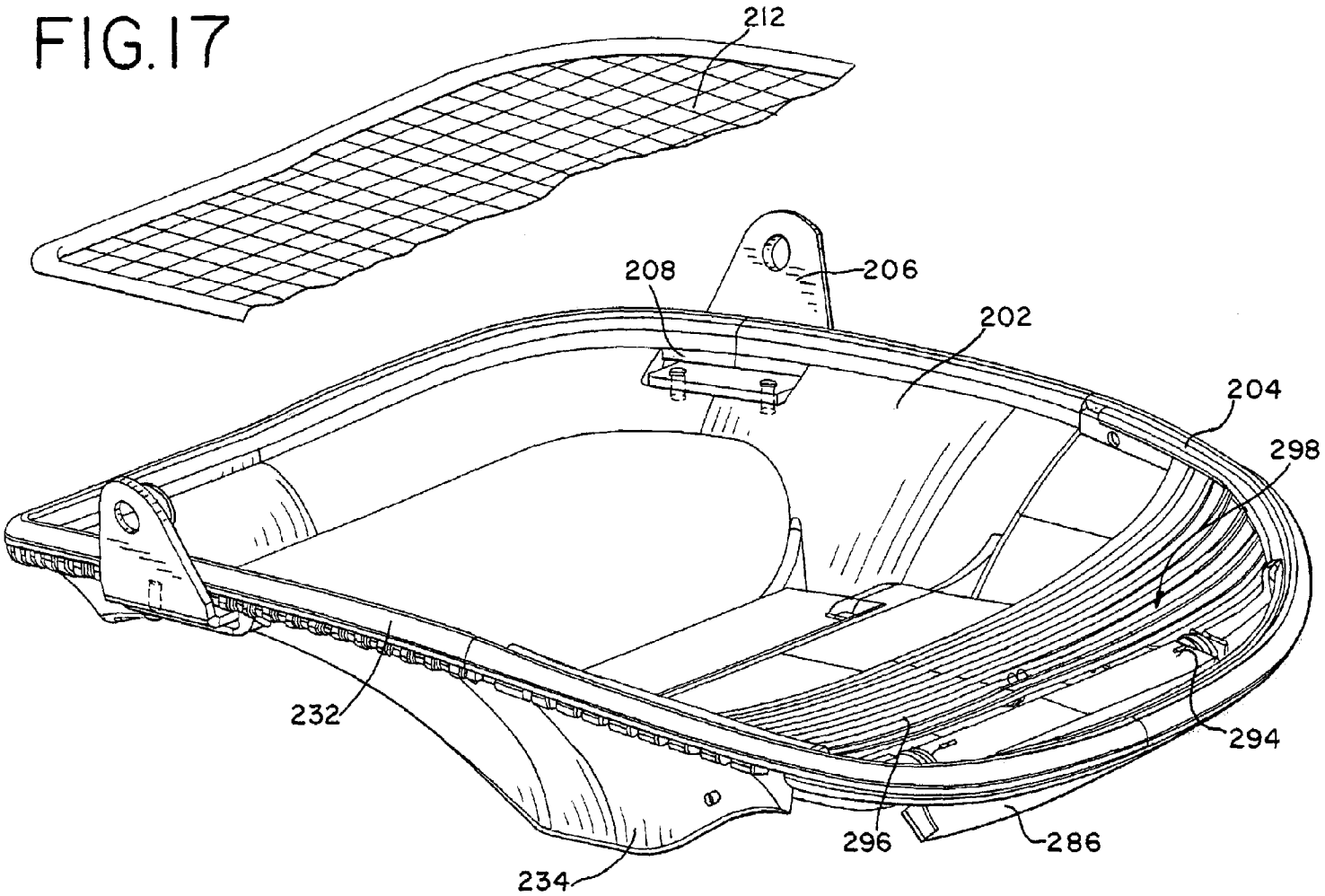
FIG. 17 is a top perspective view of one embodiment of a seat support assembly.

Referring to FIGS. 15 and 16, in one alternative preferred embodiment, a C-shaped bushing 214 is mounted in an opening 216 formed in the support member, preferably with a snap-fit. The bushing is preferably made of acetal. The pivot member 418 preferably includes a flat spot 218 and an outer circumferential surface 220. During installation, the seat is initially rotated such that axle 222 of the pivot member can slide through a mouth 224 of the bushing 214 by aligning the flat spot 218 substantially perpendicular to the mouth 224. The axle 222 has an outer arced pivot surface 236 and a key surface 228 defined by the flat spot 218. The pivot surface 226 is defined by a radius "r" from the center 230 of the axle, with the overall axle having a diameter "D" defined there across. The key surface is formed at a distance "d" from the center of the axle, which is preferably less than the radius, and preferably parallel to a plane through the center 230. Preferably, the distance between the key surface 228 and the center 230 is less the width of the mouth 224 minus the radius "r" of the axle such that the axle can be inserted through the mouth. Once the pivot member 418 is located in the bushing, the seat 200 can be rotated to its normal operating position, wherein the axle 222 is trapped by the bushing 214. In this way, the seat can be secured to the armrest without the use of any tools, and without having to tighten or manipulate any mechanical fasteners, which can be expensive and time consuming. Alternatively, the seat and armrest, or back support, can be coupled using any conventional pivot member. Conversely, it should be understood that the arrangement described herein can be used to secure any two components, not limited to the seat and back support, in a pivotal configuration.

Figure 80:
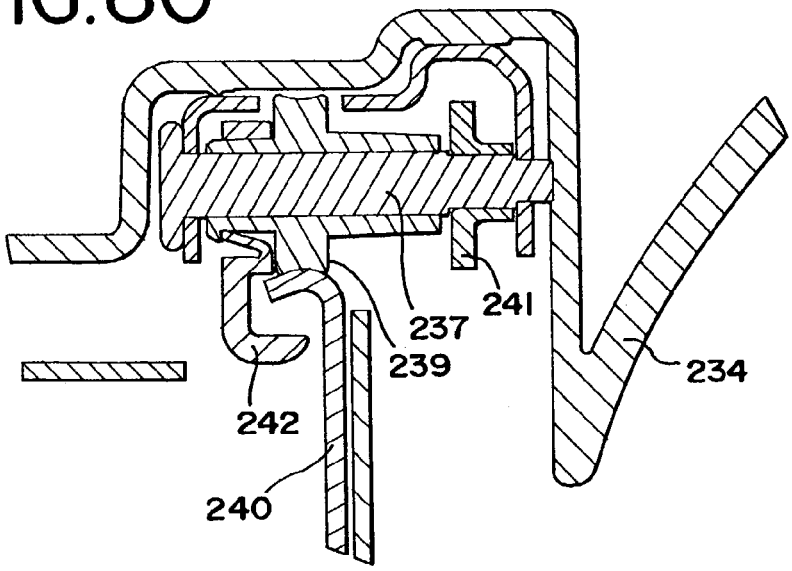
FIG. 80 is a partial cross-sectional view of the seat supported by the tilt control housing.
Figure 81:
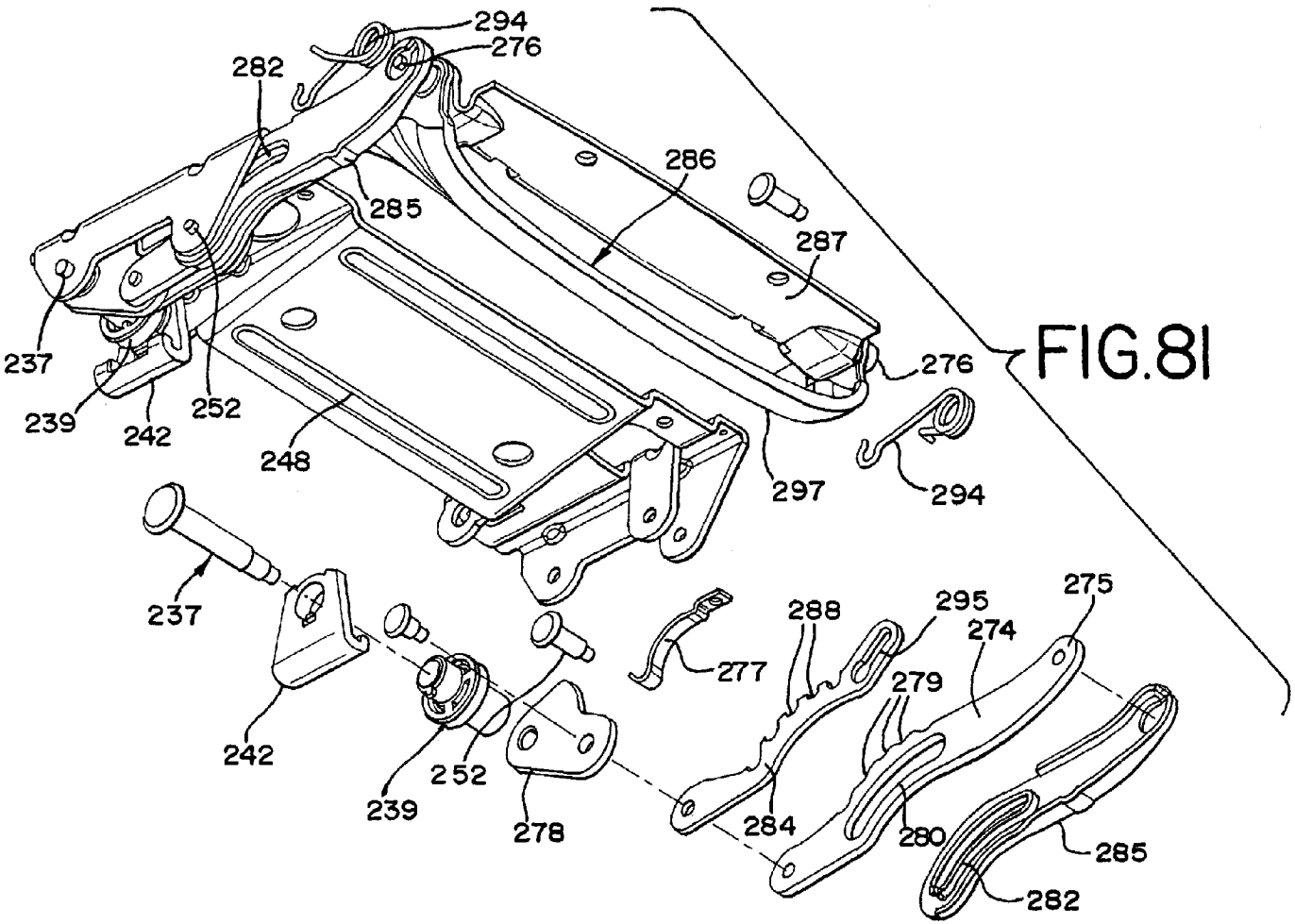
FIG. 81 is an exploded perspective view of a seat adjustment mechanism.

Referring to FIGS. 17–19, 41 and 82, the primary and auxiliary seat supports 202, 204 define a peripheral rim 232 that defines a generally open center. The primary seat support 202 includes opposite, downwardly extending, and inwardly sloping side support walls 234 that transmit the load from the seat support to the tilt control housing 10. In the embodiment of FIGS. 17–19 and 41, a pivot member 236 extends between the support walls. A pair of rollers 238 are rotatably mounted on the pivot member 236 adjacent each side wall. It should be understood that preferably the rollers can be pivotally mounted on the axle, the axle can be rotatably supported by the seat, or both. Alternatively, as shown in FIGS. 80 and 81, a pair of pivot members 237 are each inserted through a roller 239 and are mounted to a bracket 248. In particular, the pivot member includes a flange that engages one side of the bracket, while a nut 241 or fastener engages the other end as it is supported by the bracket. The primary support is secured to the bracket 248. In either embodiment, the rollers 238, 239 ride along a pair of tracks 240, shown as curved rails or fenders, formed on the tilt control housing as the chair is tilted rearwardly. As shown in the embodiment of FIGS. 20, 41, 80 and 81, a pair of hook members 242 are mounted on the pivot member and include downwardly extending hooks 244 that engage and slide along a lip portion 246 of the tracks as the rollers 238 ride on the tracks. It should be understood that the tracks could take other forms, and could be formed for example and without limitation as slots in the control housing side walls. Alternatively, the rollers or wheels can be rotatably mounted to the housing, and the track can be formed on the seat support. Alternatively, the rollers can be omitted altogether, with the respective members merely sliding relative to each other.

Figure 19:
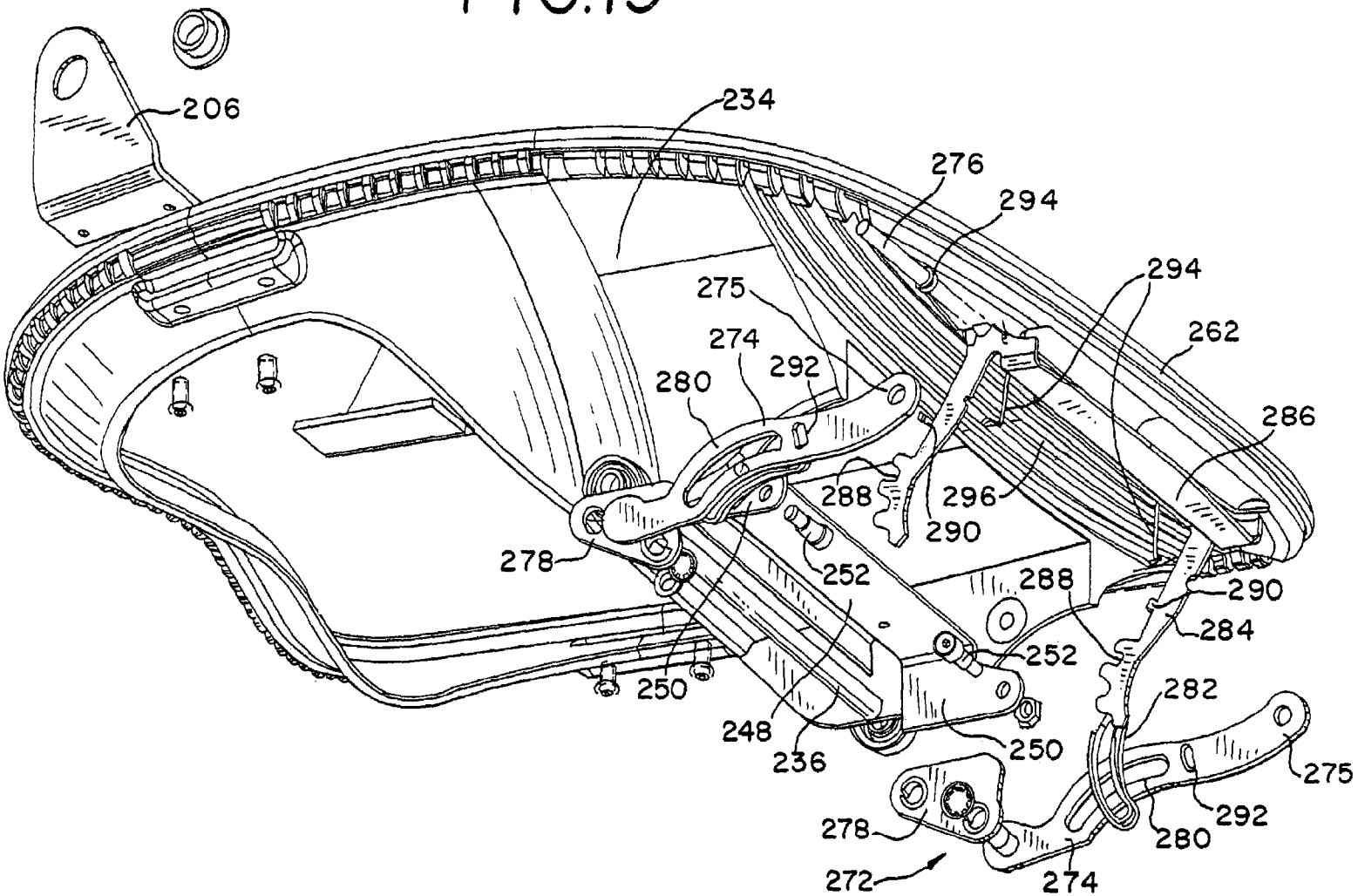
FIG. 19 is an exploded bottom perspective view of the seat support assembly shown in FIG. 17.
Figure 82:
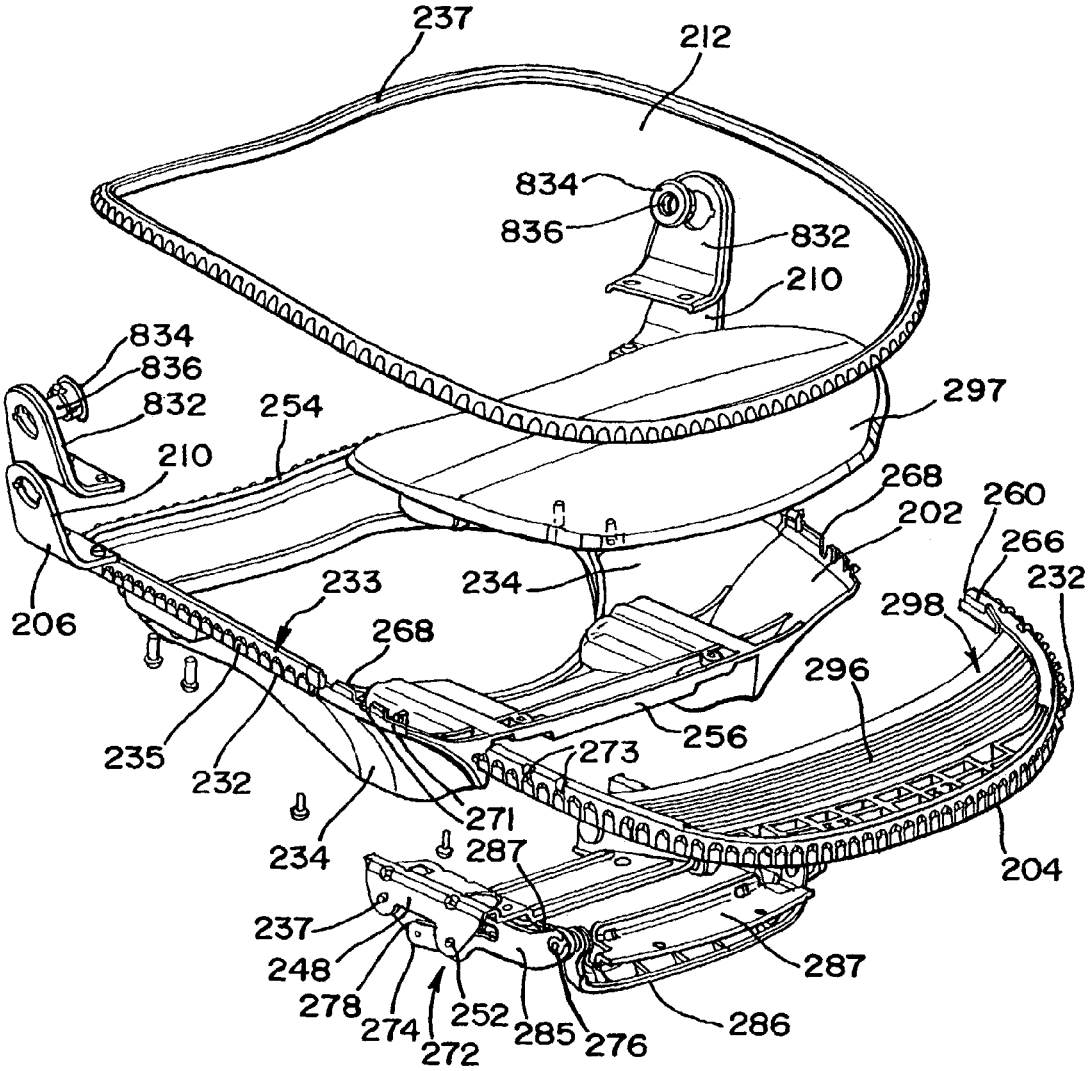
FIG. 82 is an exploded perspective view of one embodiment of a seat support assembly.

Referring to the embodiments of FIGS. 19 and 82, the bracket 248 extends between and is secured to the side walls 234. The bracket includes a pair of forwardly extending flange portions. A pair of guide members 252, configured as posts, are mounted to and extend laterally outward from the flange portions.

Referring to FIGS. 17–20 and 82, the primary seat support 202 includes a rear portion 254 and a front portion 256, and opposite sides 258. The auxiliary seat support 204 has a rear portion 260 pivotally mounted to the front portion 256 of the primary seat support 202 with a pair of pivot members 262 extending laterally outward from the ends of the rim portion of the auxiliary seat support, which pivot members are received in laterally facing openings formed in the rim portion of the primary seat support. Alternatively, a pair of tabs 271 on the primary seat support are snap fitted in a pair of openings 273 formed on the secondary seat support. The rim portion 232 includes an upper wall 266 that engages a support wall 268 extending forwardly from the pivot axis 270 on the primary seat support. In this way, the support wall 208 supports the rear portion 260 of the auxiliary seat support and carries the load from the user.

Figure 20:
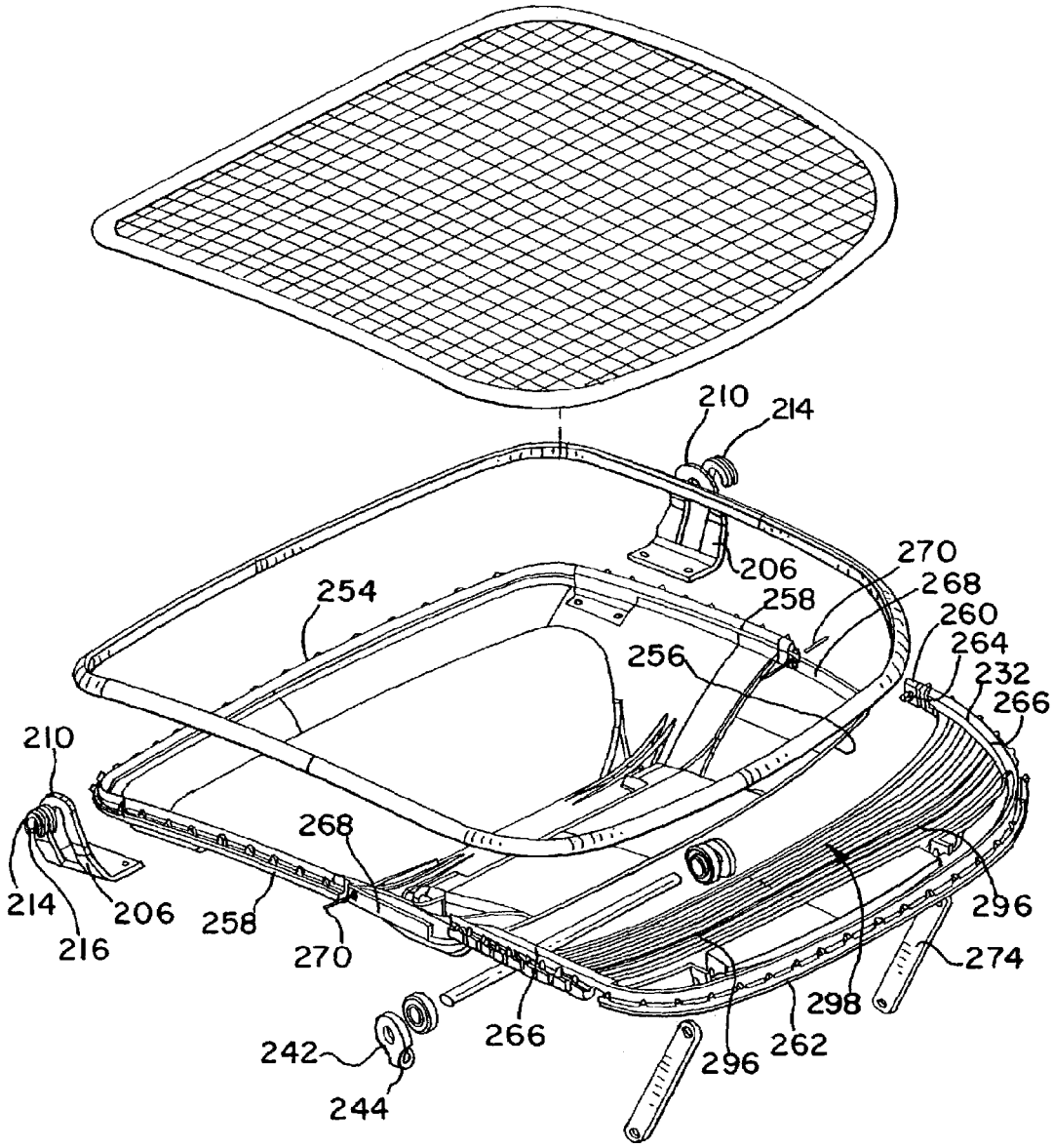
FIG. 20 is an exploded top perspective view of an alternative embodiment of a seat support assembly.
Figure 23:
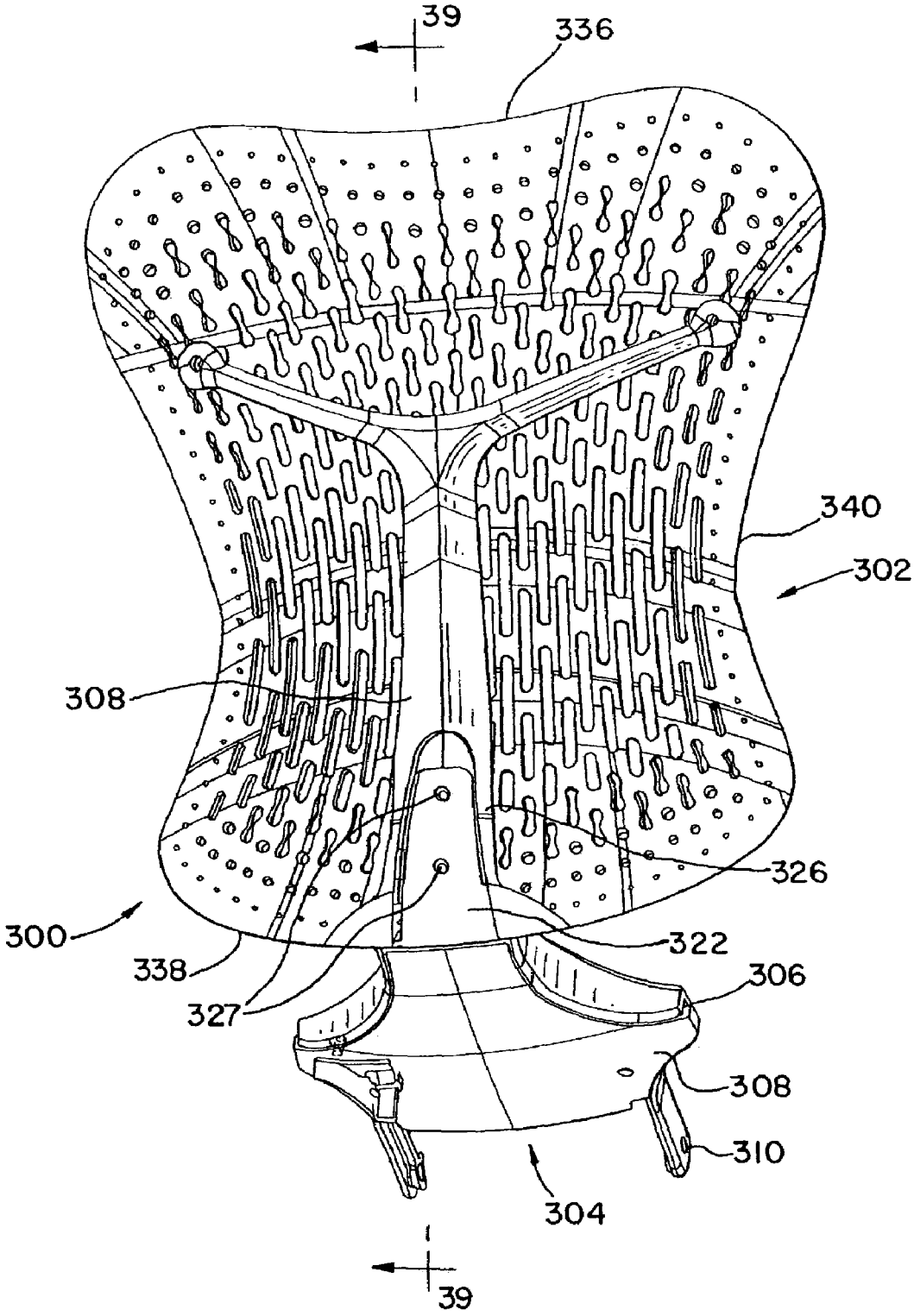
FIG. 23 is rear perspective view of a backrest.
Figure 26:
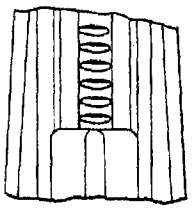
FIG. 26 is an enlarged partial rear view of the backrest frame member.
Figure 25:
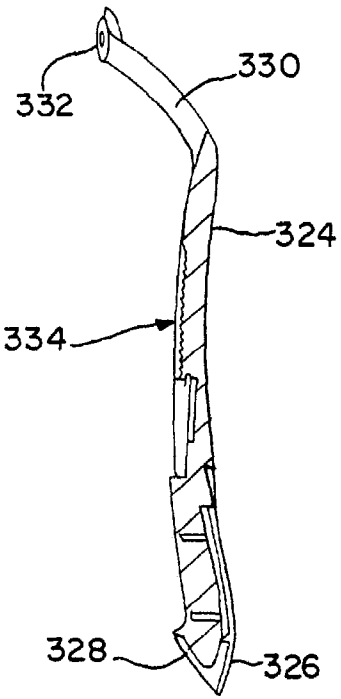
FIG. 25 is a partial section cut and side view of the backrest frame member taken along line 25-25 of FIG. 24.

A linkage assembly 272 is pivotally mounted to a forward portion 262 of the auxiliary seat support. The linkage assembly includes a first link 274 having a first end 275 pivotally mounted to the auxiliary seat support with a pivot axle 276 at a first pivot axis. A second end of the first link is pivotally mounted to a second pivot link 278 at a second pivot axis. In turn, the second link 278 is pivotally mounted to the seat support on the pivot member 236, 237 at the main pivot axis. In the embodiment of FIGS. 17–19 and 81, the first link 274 is preferably curved and has a curved track 280, shown as a slot, formed therein. Alternatively, as shown in FIG. 20, the first link 274 can be linear. Referring to FIGS. 17–19 and 81, the track can be provided with a bearing 282 or liner, which can further be formed as a cover 285 that covers the outer exposed surface of the link. The track 280, or bearing, is disposed on a first portion of the guide member 252, which rides in the track. The first link 274 and track 280 preferably have a downwardly opening concave curvature, or an upwardly facing convex curvature.

In operation, the user grips or grasps the front edge 262 of the auxiliary seat support and bends or flexes the auxiliary seat support as the first link 274 moves relative to the guide 252 and as the first link 274 pivots the second link 278 about the pivot member 236. The curvature of the track 280 preferably corresponds to the distance between the pivot axes on the second link such that the linkage assembly does not bind up. The relative curvatures allow for the first link 274 to maintain relatively the same orientation throughout the range of motion of the front portion of the seat. In addition, the first and second links 274, 278, with the guide member 252 engaging the first link, act as a beam to carry the load from the front edge of the auxiliary seat support to the primary seat support. In one embodiment, shown in FIG. 81, an upper surface of the link 274 is provided with a plurality of indentations 279 that are indexed on a spring 277, so as to provide the user with an indexed positioning device.

The seat also includes a lock device connected between the auxiliary seat support and the primary seat support. Of course, it should be understood that in certain embodiments, for example where the seat is not slideably moveable relative to the housing, but rather only pivotally moveable relative thereto, the lock device and the linkage assembly could be engaged with the housing, rather than the seat support.

Figure 18:
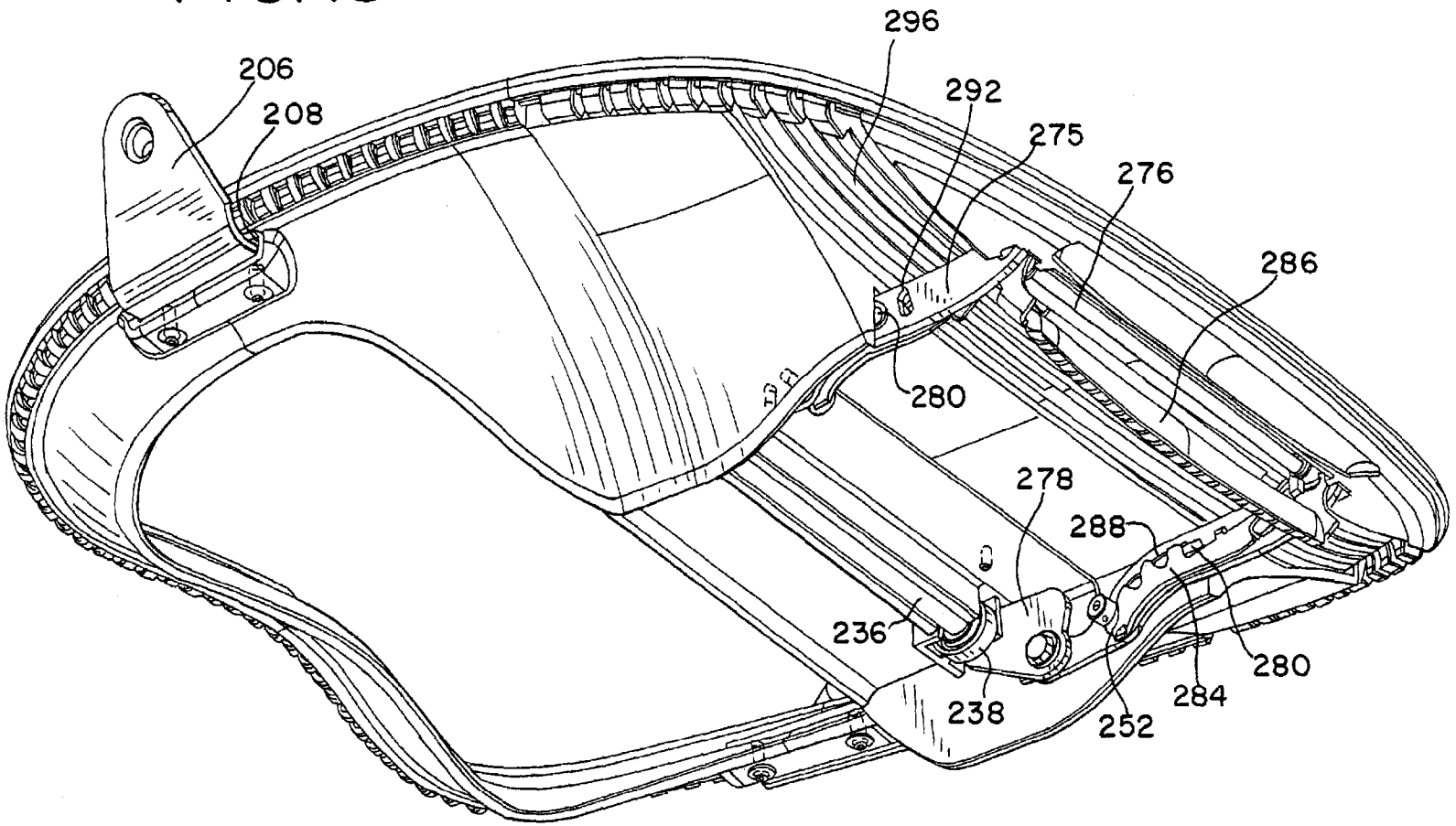
FIG. 18 is a bottom perspective view of the seat support assembly shown in FIG. 17.

Referring to FIGS. 18, 19 and 81, the lock device includes a pair of lock arms 284 joined with a handle portion pivotally connected to a bracket 287 mounted to the auxiliary seat support on the pivot axle 276 at a pivot axis. Each of the lock arms 284 includes a plurality of notches 288, forming a rack therealong, which selectively engage the outer portion of the guide member 252, configured as a latch member. One or more coil springs 294 is mounted on the axle and biases the arm into engagement with the latch member. Of course, it should be understood that tension, compression, torsion springs, and other biasing devices would also work. Referring to the embodiment of FIGS. 18 and 19, the lock arm further includes a tab member 290 extending laterally therefrom, which is received in an elongated opening or track 292 formed in the first link member 274. The tab member 290 rides in the opening 292 and provides a limit on the range of motion of the lock arm.

Referring to the embodiment of FIGS. 81 and 82, the handle 286 includes an arm that extends from the pivot axis 276 and includes a pivot member 297 that is connected through a slotted opening 295 in the end of the lock arm 284. The opposite end of the lock arm is pivotally connected to the link member 278 and the link member 274.

In operation, the user lifts the handle 286 towards the front edge 262 of the auxiliary seat support and rotates the handle relative to the bracket 287 as he/she grips the front edge of the auxiliary seat support and thereby pivots the lock arm 284 against the force of the spring 294 to a disengaged position wherein the notches 288 are disengaged from the latch member 252. The user then moves the front edge 262 or portion of the auxiliary seat support to a desired position relative to the rear portion thereof by bending or flexing the auxiliary seat support, and in particular the rim portion 232 thereof. In one embodiment, the spring 277 indexes along the notches 279. When the desired position is reached, the user releases the handle 286, such that the spring 294 biases the lock arm 284 into an engaged position, with one of the notches 288 engaging the latch member 252. It should be understood that the latch member can be formed on the lock arm, with the notches or rack formed on the primary seat support or housing. The rack defines four to five positions, although it should be understood that the seat can be bent or flexed between at least a first and second position, or to a plurality of such positions other than four or five. Preferably, the curvature of the upper surface of the forward portion of the seat support is greater and increases as it is bent or flexed downwardly about a substantially horizontal axis, e.g., the pivot axis. Preferably, the seat supports are made of a resilient material, such as various polymeric or plastic, or elastomeric materials. In one preferred embodiment, the seat supports are made of nylon.

It should be understood that the primary and auxiliary seat supports can be integrally formed as a single one-piece unit, with a forward portion of the seat support being bendable or flexible, or relatively rigid, for example where no seat depth is intended. Likewise, it should be understood that the seat support can be formed as a single one-piece web or sheet material, without an additional membrane, wherein the one-piece web is made of a flexible material such as plastic and wherein the web forms the seating surface for the user. Of course, the same linkage and lock mechanism can be used to control the flexing and positioning of the forward portion of the seat support.

Referring to FIGS. 17–20 and 82, the auxiliary seat support 204 preferably includes a plurality of laterally extending and longitudinally spaced ribs 296 that form a recess 298. A pad 299 is disposed in the recess 298 and provides support for the legs of the user, especially as the forward portion of the seat is bent or flexed downwardly, to form a waterfall contour of the front portion of the seat. In this way, the effective amount of seat support surface contacting the user's legs can be reduced, for example for shorter users, simply by bending the forward portion of the seat. In addition, the user can lock or latch the forward portion in various positions, including at least the first and second position.

Figure 21:
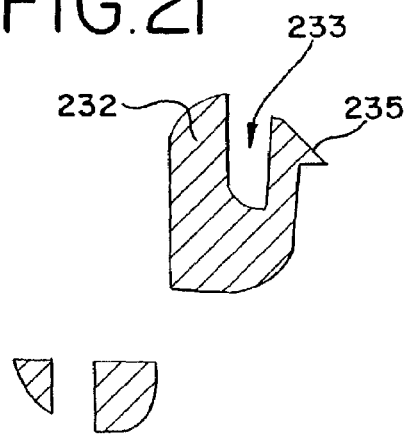
FIG. 21 is a cross-sectional view of a portion of a seat support member.
Figure 22:
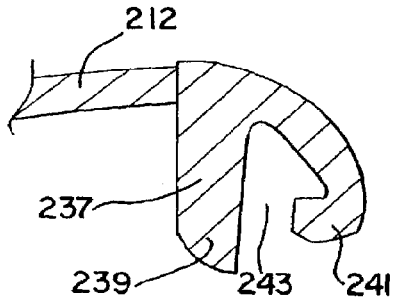
FIG. 22 is a cross-sectional view of a carrier member.
Figure 14:
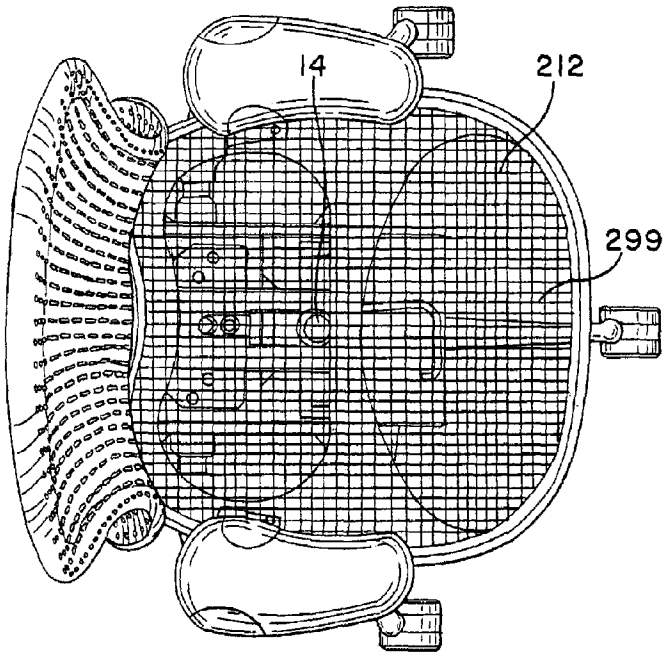
FIG. 14 is a top view of the chair shown in FIG. 11.
Figure 13:
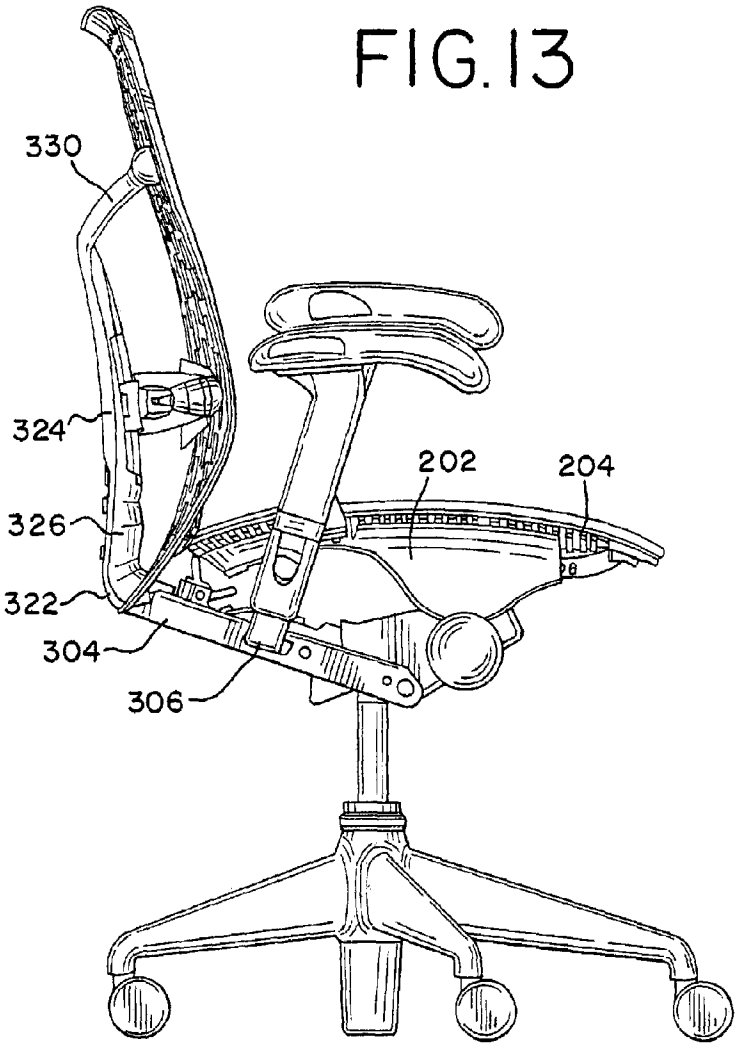
FIG. 13 is a right side view of the chair shown in FIG. 11, with the left side view being a mirror image thereof.

Referring to FIGS. 21 and 82, the rim portion 232 of the primary and auxiliary seat supports includes a channel 233 and a plurality of outwardly extending hook members 235. A carrier member 237, shown in FIGS. 22 and 82, is secured around the periphery of a membrane 212. The membrane is preferably a woven material, and can be made of various cloth fabrics, elastomeric materials and yarns. For example, the membrane can be made from various materials described in U.S. Pat. No. 6,059,368, which is hereby incorporated herein by reference.

The carrier member 237 has an insert portion 239 disposed in the channel 233 and a cover portion 241 forming one or more recesses 243 shaped to correspond to and mate with the hook members 235 of the rim portion. The insert portion 239 of the carrier member is disposed in the channel 233 as the cover portion snaps over and engages the hook portions 235 so as to secure the membrane to the seat supports. Various methods of attaching a carrier member to a membrane, and for securing the carrier member to the seat support, are disclosed in U.S. Pat. No. 6,059,368, and U.S. patent application Ser. No. 09/666,624, entitled Carrier and Attachment Method for Load Bearing Fabric, filed Sep. 20, 2000, the entire disclosures of which are hereby incorporated by reference.

An information card (not shown) providing indicia for using the various chair mechanisms can be slidably mounted to the seat support, or alternatively, to the armrests or backrest. Preferably, the card or the support structure therefore are provided with travel limiting members to prevent the card from being removed from the chair where it can be then be lost.

Figure 43:
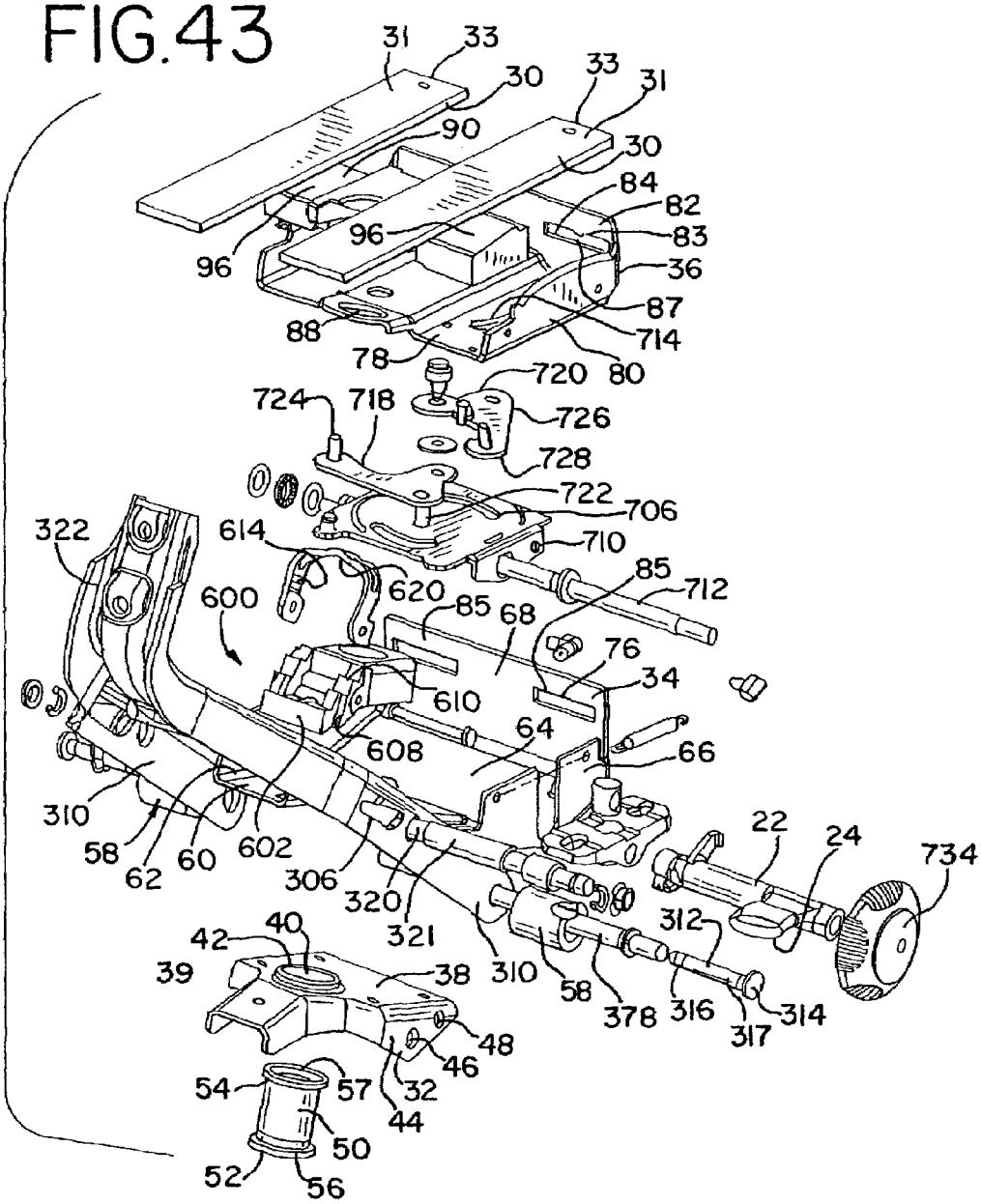
FIG. 43 is an exploded perspective view of the tilt assembly.
Figure 44:
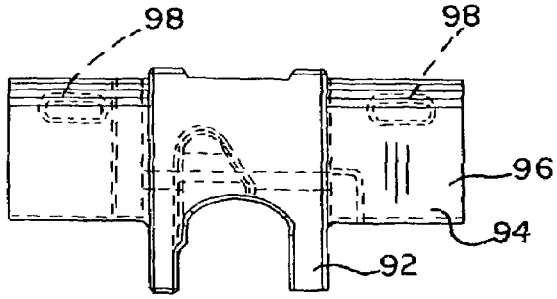
FIG. 44 is a top view of a fulcrum member.
Figure 45:
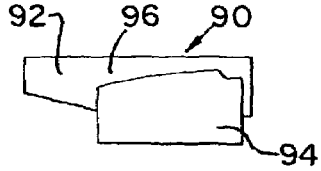
FIG. 45 is a side view of the fulcrum member.
Figures 46, 47:
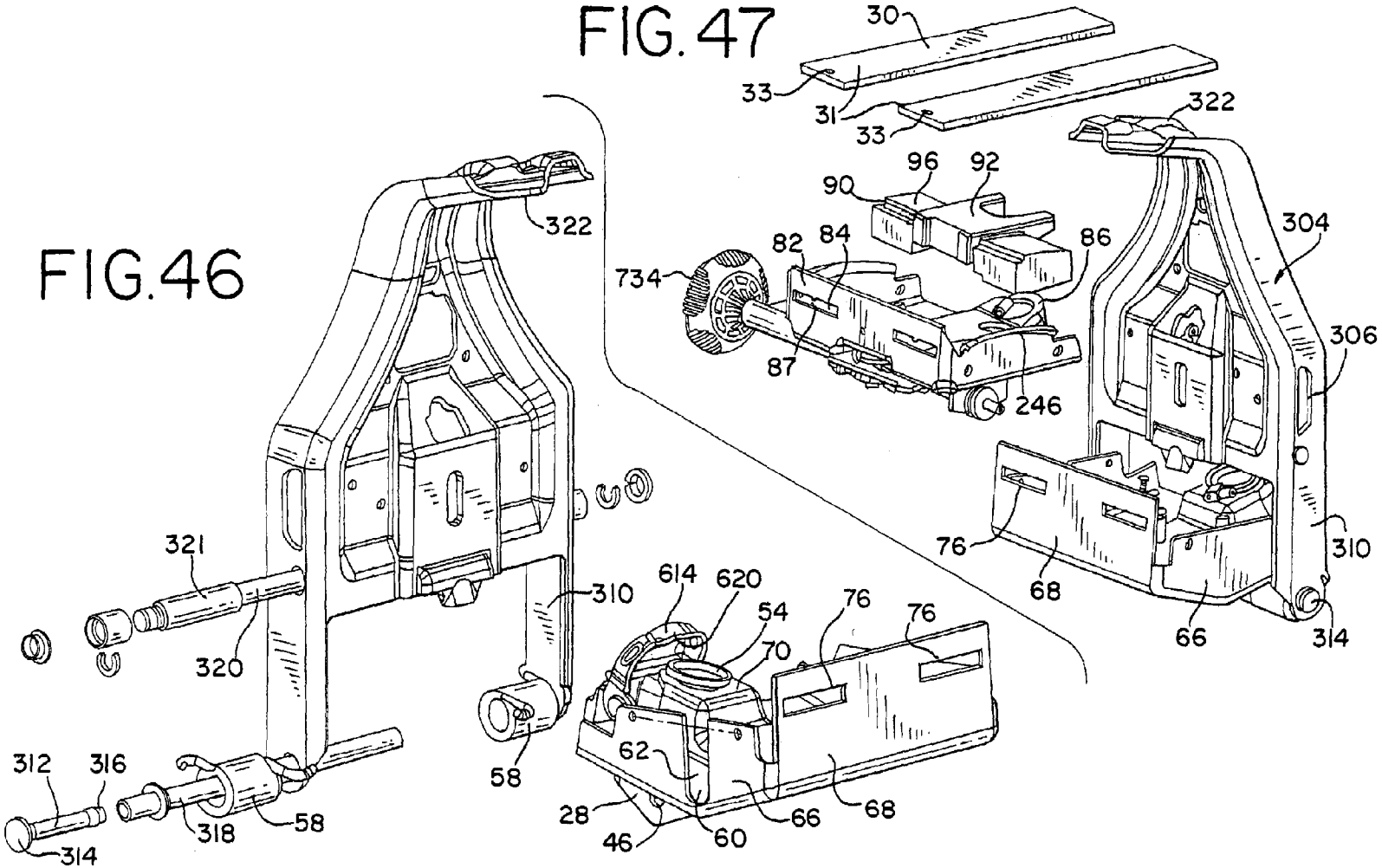
FIG. 46 is an alternative exploded view of the tilt assembly.
FIG. 47 is another alternative exploded view of the tilt assembly.
Figures 48, 49:
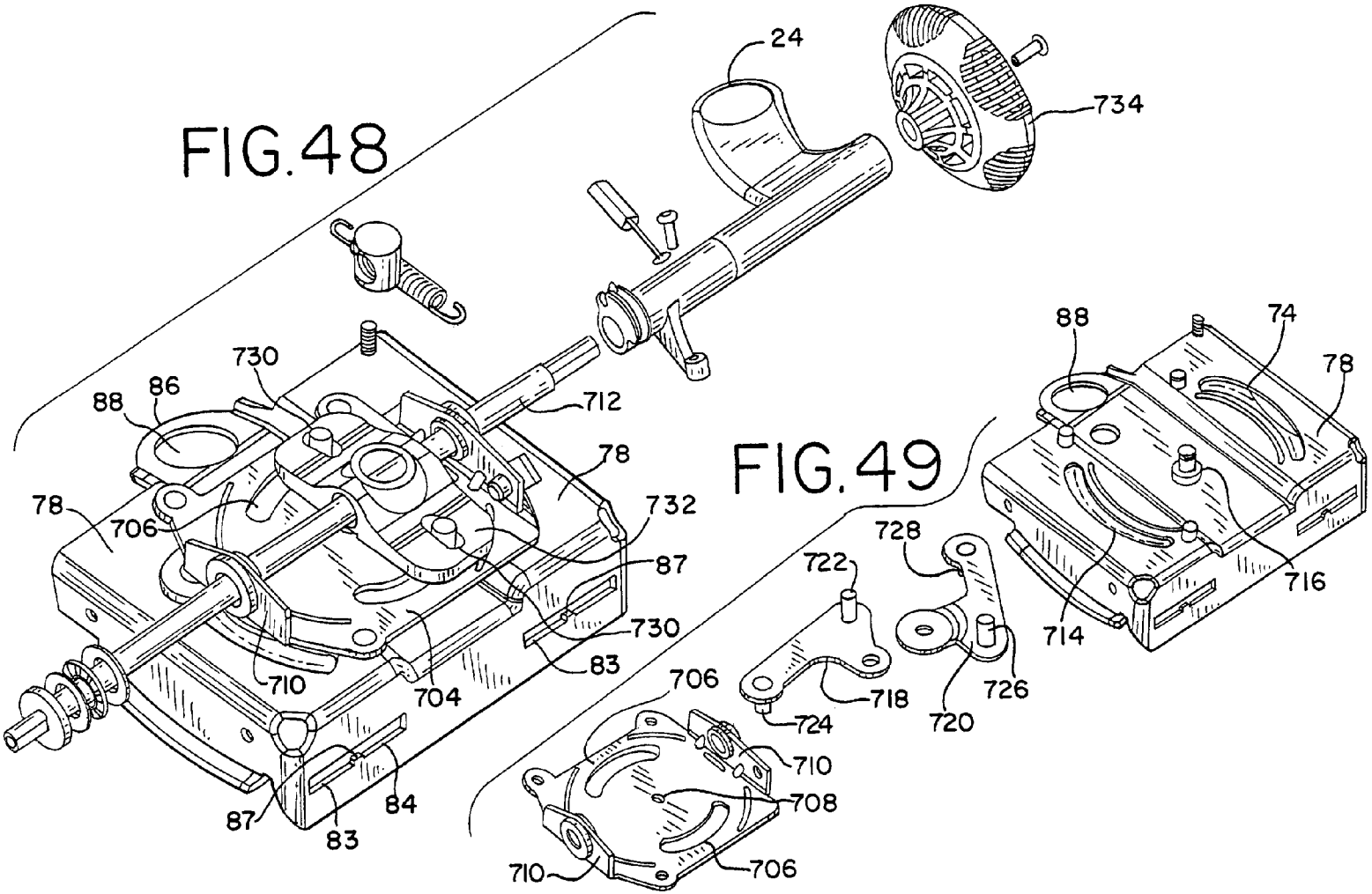
FIG. 48 is a perspective view of the actuator mechanism and linkage assembly for the fulcrum member.
FIG. 49 is an exploded view of the linkage assembly for the fulcrum member.
Figure 51:
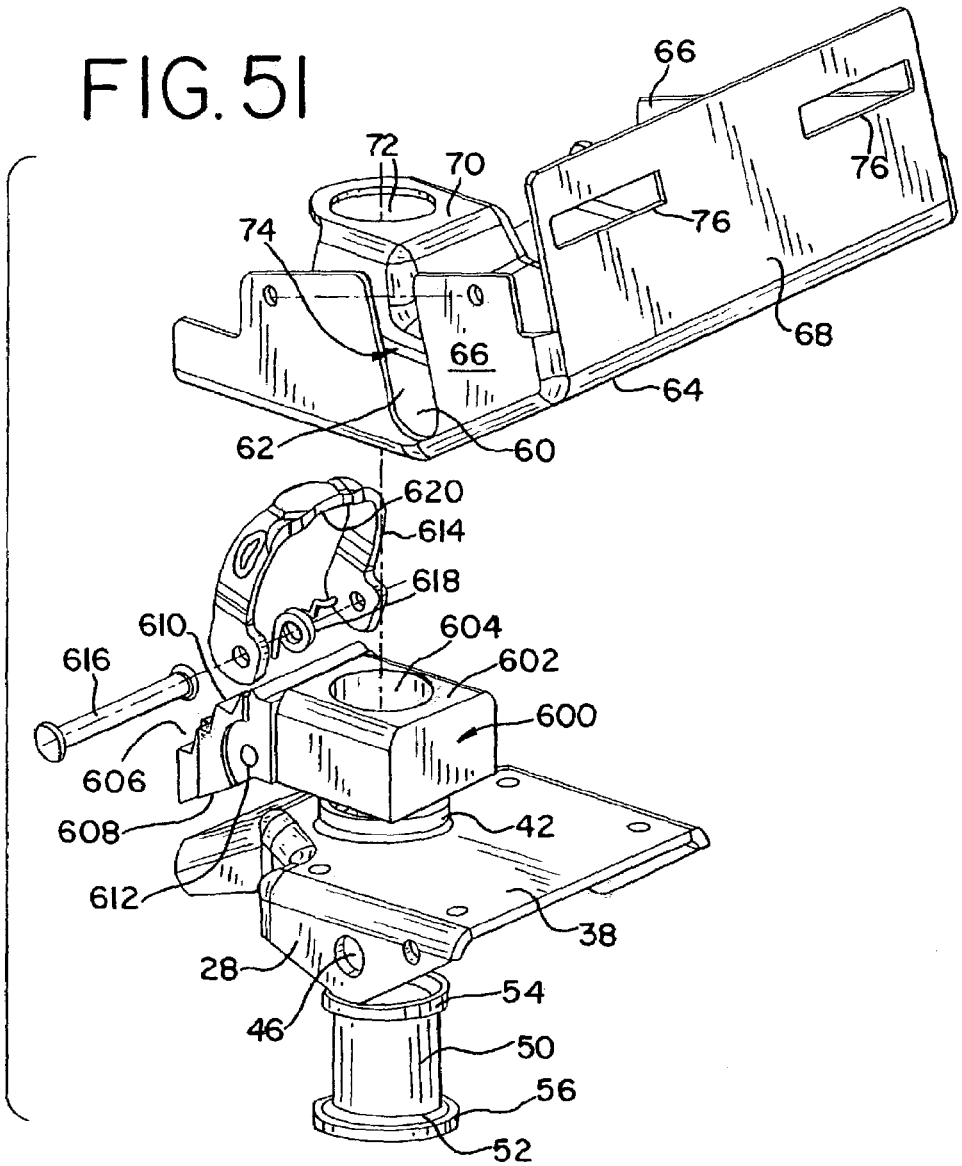
FIG. 51 is an exploded view of the tilt control housing and stop members.

Tilt Assembly:

As shown in FIGS. 43, 46 and 51, the housing 10 includes a pivot bracket 32, a lower housing member 34 and an upper housing member 36. The pivot bracket 32 preferably has a substantially horizontal platform 38 with an opening 40 formed therein and a raised rim 42 formed around the opening, a pair of opposite side walls 44 having two pairs of aligned openings 46 therethrough, and a rearwardly and downwardly extending platform 39.

An annular bushing 50 has a first and second end 52, 54, with an annular flange 56 extending radially outward from the first end. The annular bushing 50 is inserted through the opening 40 in the platform 38, as the lower surface thereof abuts and is supported by the flange 56. The bushing is mounted on the upper end of the support column 12.

The back support arms 310 are preferably secured to the pivot bracket 32 at the first openings 946 with a pair of insert pivot members 317 as described above. In addition, a pair of assist springs 58 are mounted on the pivot members 317. Each spring 58 includes a first leg engaging the pivot bracket 32 and a second leg engaging the back support arm 310, wherein the spring biases the seat support in an upward direction. The springs 58 are preferably coil springs, although it should be understood that torsion springs, tension springs and compression springs also could be used to assist in the biasing of the back support member.

Referring to FIG. 51, a stop assembly 600 includes a stop block 602 with an opening 604 therethrough. The stop block is disposed on the platform 39, with the rim 42 received in a bottom end of the opening 604 and with the bushing 50 extending through the opening in the stop block. The stop block includes a staircase 606 portion having a lower surface 608 that abuts and is supported by the platform 39. The staircase includes a plurality of steps 610 formed on an upper portion thereof. The stop block 602 has a horizontal opening 612 formed therethrough. An upside down U-shaped stop member 614 is pivotally mounted to the stop block 602 with a pivot member 616. A spring 618 is mounted on the pivot member 616 to bias the stop member 614 in a rear ward direction. The stop member has a curved stop surface 620 formed on an underside of the apex of the member 614.

The lower housing member 34 has a bottom wall 60, having a horizontal portion 62 and an upwardly and forwardly extending portion 64, a pair of opposite side walls 66 and a front wall 68. The lower housing member further includes a mounting podium 70 extending upwardly from a rear portion of the bottom wall. The podium 70 forms a cavity that receives the stop block 602 and includes an opening 72 that receives the bushing 50. At least one of the side walls 66 includes a slot 74 formed therein through which various pivot members can extend. The front wall 68 includes a pair of horizontally extending slots 76, which are shaped to receive an end of the leaf springs 30.

Referring to FIG. 43, the upper housing member 36 has a bottom wall 78, a pair of side walls and a front wall. The front wall includes a pair of horizontally extending slots 84. The upper housing member is disposed in the lower housing member 34 such that various fastener holes and slots 76, 84 are aligned, whereinafter the upper housing is secured to the lower housing with fasteners, or by welding and the like. The lower surface of the bottom wall 78 of the upper housing member and the upper surface of the bottom wall 60 of the lower housing member are spaced apart, such that a linkage assembly can be disposed therebetween.

As shown in FIGS. 43 and 46, each support arm 310 also includes a second opening positioned rearwardly of said first opening. The second opening receives a support member 320, which defines a horizontal axis.

When the three-bar linkage formed by the back support, seat and housing is combined with a pair of leaf springs 30, the resultant chair can be designed in a compact and aesthetically pleasing form. It should be understood that the three-bar linkage could be formed by pivotally connecting the seat support and back support to the housing and by pivotally and slideably connecting the seat support to the back support, or by pivotally connecting the seat support to the housing and to the back support and then pivotally and slideably connecting the back support to the housing.

In one preferred embodiment, shown in FIGS. 58–60 and 66–68, the housing 910 includes a pair of pivot brackets 932, a lower or outer housing member 934 and an upper or inner housing member 936. The pivot brackets 932 are secured to opposite sides of the inner and outer housing members with a plurality of fasteners. The pivot bracket 932 define a pair of aligned openings 946 along a lateral horizontal axis. The back support arms 310 are preferably secured to the pivot bracket 932 at the first openings 946 with a pair of insert pivot members 317 as described above.

Figure 66:
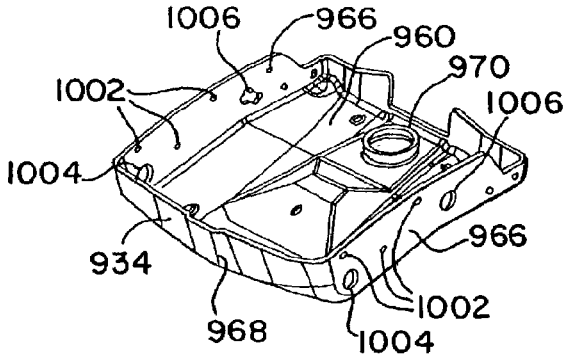
FIG. 66 is a perspective view of an outer tilt housing member.
Figure 65:
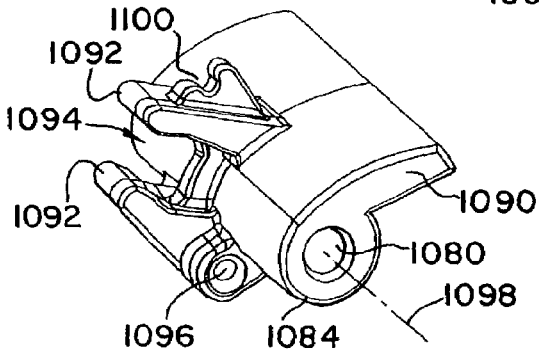
FIG. 65 is a perspective view of a forward tilt limiter.

In this embodiment, the annular bushing 50 is disposed through openings 940, 972 in spaced apart portions of the inner and outer housing members, with the bushing capturing those members. The bushing is mounted on the upper end of the support column 12. Referring to FIG. 66, the lower housing member 934 has a bottom wall 960, a pair of opposite side walls 966 and a front wall 968. The bottom wall includes the opening 972 that receives the bushing 50. The side walls 966 include a plurality of openings 1002, 1004. Some of the openings 1002 are configured to receive fasteners, which join the lower housing member to the upper member and pivot member. Other openings 1004 are shaped and dimensioned to receive various actuator members and controls.

Yet other openings 1006 are positioned to be connected to a backrest support, seat or other linkage assembly supporting a seating structure in a different seating arrangement, or to support various actuator controls. In this way, the tilt housing is provided with a plurality of connector arrangements. For example, in one arrangement, the backrest support arms 402 and seat 200, which define a mounting arrangement, are configured to be pivotally connected to the pivot brackets 932 at the opening 946 and pivotally and translatably supported on the tracks 240 of the pivot bracket 932, with the opening 946 and track 240 defining a first connector arrangement. In another seating arrangement, one or both of the seat 200 and the back support 304, which define a mounting arrangement, which may be the same as or different from the first mounting arrangement, is configured to be connected to the upper and lower housing members at various openings, for example openings 1006, which define a second connector arrangement. In other seating arrangements, the seat and backrest are connected to the upper and lower housing, or a pivot bracket (which may vary from the disclosed pivot bracket) with a linkage assembly, which defines yet another mounting arrangement. Indeed, various openings in the housing members, including one or more of the inner and outer housing members and pivot bracket, can be formed to define different connection points that support the particular seating structure that is being mounted thereon. The connector and mounting arrangements can be sliding or fixed pivots as required by the chair kinematics. The dies used to form the various housing members are preferably constructed so that additional connector openings can be added later if another pivot point is desired. In addition, if the pivot point falls outside the side surface of the upper or lower housing members 934, 936, the location can simply be provided by adding the side pivot brackets 932, as shown herein.

As explained above, the seat to back support pivot connection is not defined by the tilt housing, and this connection, whether direct or by way of a link or linkage, can be made independent of the configuration of the tilt housing so as to further add to the flexibility of altering the kinematics of the seating structure. Moreover, a single back support can be used to support a variety of different configurations, simply by altering the shape and configuration of the armrests, which are connected to the seat as explained above.

Figure 67:
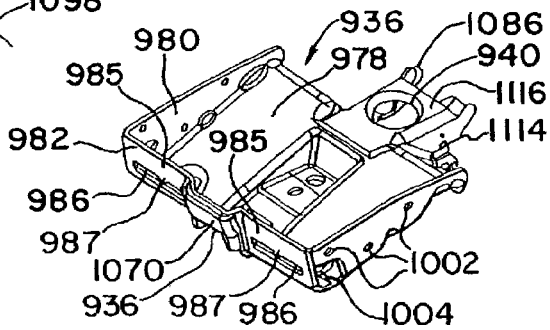
FIG. 67 is a perspective view of an inner tilt housing member.

Referring to FIGS. 60 and 67, the upper housing member 936 has a bottom wall 978, a pair of side walls 980 and a front wall 982. The front 982 wall includes a pair of horizontally extending slots 84. The upper housing member 936 is disposed in the lower housing member 934 such that various fastener holes 1002 and connector openings 1004 are aligned, whereinafter the upper housing is secured to the lower housing with fasteners, or by welding and the like. The lower surface of the bottom wall 978 of the upper housing member 936 and the upper surface of the bottom wall 960 of the lower housing member 934 are spaced apart at various locations.

Referring to FIG. 60, the back support 308 includes a web 1008 having an upper and lower surface 1010, 1012 and a forwardly extending edge 1014. The edge includes a raised central portion 1016 and a pair of outer side portions 1018. The back support 308 further includes a pair of downwardly facing curved portions positioned 1020 on each side of the middle portion.

Figure 59:
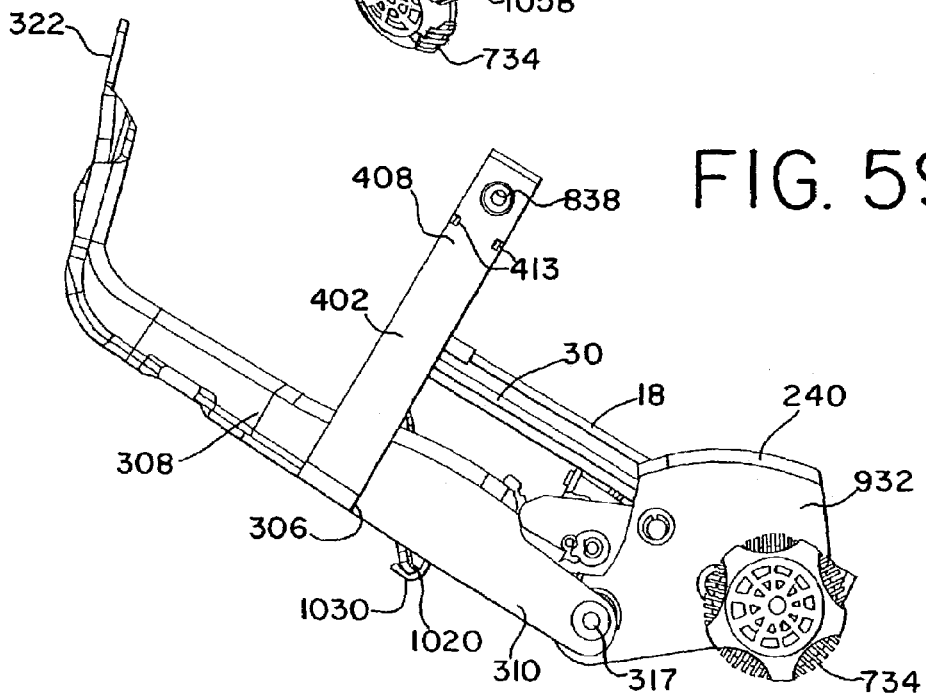
FIG. 59 is a side view of one embodiment of a tilt assembly and back support with the springs in a disengaged position.

Referring to FIGS. 58–60, a spring link 1022 includes a lower end having a pair of arms 1026 each with a rearwardly facing curved hook portion 1030 that pivotally engages the curved portions 1020 of the back support. In alternative embodiments, the spring link can be pivotally connected to the bask support with a pin or axle. An upper end of the spring link 1022 includes a forwardly facing hook portion 1024, which a pair of tabs or locator members 1028 spaced therealong. A downwardly facing edge of the hook portion 1024 engages the top of the springs 30, with the tabs 1028 inserted in openings 33 in the springs to locate them relative to the spring link. In operation, as the back support 308 tilts rearwardly, the spring link 1022 pivots between the spring 30 and the back support 308, which avoids the spring sliding along the back support. Such sliding can create relatively large friction forces acting between the spring and back support. Of course it should be understood that the spring link can be omitted with the springs directly engaging the back support.

Although the above-described three-bar mechanism is preferred, it should be understood that the leaf springs can also be incorporated into synchro-tilt chairs using linkage mechanisms such as four-bar linkages and the like. With a four-bar linkage, links can be provided to pivotally connect the seat support and/or back support to the housing and/or to each other about various horizontal axes.

As best shown in FIGS. 43–45, 47 and 60–62, a fulcrum member 90 is moveably installed in the upper housing member 36 beneath the pair of leaf springs 30. The fulcrum member 90 is preferably formed from a single piece of hard, durable material having a relatively low coefficient of friction, such as DELRIN or CELCON Acetal, so as to allow the fulcrum member to slide relatively easily along the bottom surface of the bottom wall 78, 978 of the upper housing, even when heavily loaded by the spring. It should be understood, however, that other materials such as steel would also work. Similarly, the bottom surface can be lined with a material having a low coefficient of friction, such as TEFLON, or the fulcrum member can be configured with rollers that roll on the housing member.

The fulcrum member 90 includes a central portion 92, opposite side support portions 94, each having a support surface 96, and a bottom surface 97. Preferably, the support surfaces 96 are not symmetrical with respect to any laterally extending vertical plane that is perpendicular to the longitudinal vertical plane in which the leaf springs 30 flex. Preferably, the support surface 96 is curvilinear and slopes rearwardly and downwardly, such that a tangent of any point therealong slopes rearwardly and downwardly. Preferably, at least a portion, and preferably the entirety, of the support surface 96 forms an arc. In a preferred embodiment, the arc has a radius between about 5 and 7 inches, and more preferably about 6 inches. In operation, the spring follows the support surface, which provides more contact therebetween as the user tilts rearwardly in the chair. In particular, as the spring bends in an arc, it naturally contacts the curved support surface of the fulcrum at a laterally extending tangent line. As the user reclines further rearwardly, the tangent contact moves rearwardly, thereby shortening the cantilevered length of the spring 30 at the end thereof engaging the support member 320 or spring link 1022. In turn, this change in the length of the spring varies the stiffness of the spring as the user tilts rearwardly.

Referring to FIGS. 43–45 and 47, each support portion 94 has a laterally extending track 98, formed as a slot, in the bottom surface thereof. The support portions 94 of the fulcrum member are supported by and slide along tracks formed on the upper surface of the bottom wall of the upper housing member. A rear lug 86 is formed on the rear portion of the bottom wall 78 and includes an opening 88 received on the annular bushing 50. The second end 54 of the bushing is then turned or rolled, or otherwise deformed, to form a second annular flange 57 extending radially outward from the bushing. In this way, the bushing captures the pivot bracket 32, the stop block 602, and the upper and lower housing members 34, 36, or in an alternative embodiment the upper and lower housing members 934, 936.

Other embodiments of the fulcrum member and adjustment mechanism for adjusting the longitudinal position thereof, are illustrated and described in U.S. Pat. No. 6,250,715, which is hereby incorporated herein by reference. It should be understood that the fulcrum member can alternatively be fixed within the housing at a specific location, such that the resistive force of the chair can not be adjusted.

Referring to FIGS. 43 and 48–50, in one preferred embodiment, an adjustment mechanism, including a linkage assembly 700 and an actuation mechanism 702, is connected to the fulcrum member 90. The linkage assembly 700 includes a cover bracket 704 mounted to a bottom wall 78 of the upper housing member 36. The cover bracket 704 includes a pair of opposite arcuate tracks 706 centered around a opening 708 defining a pivot axis. Preferably, the tracks, formed as slots in the bracket, are generally oriented in the lateral direction. The cover bracket 704 further includes a pair of opposite side walls 710, to which a screw member 712 is rotatably mounted. The bottom wall 78 of the upper housing member also includes a pair of opposite arcuate tracks 714 centered around a pivot member 716, which extends downwardly from the bottom wall and defines a pivot axis. Preferably, the tracks 714, which are formed as slots in the bracket, are generally oriented in the longitudinal direction, or in a direction opposite the tracks 706 formed in the cover bracket.

The linkage assembly includes a first and second link 718, 720 pivotally mounted to the cover bracket at the pivot axis. The first link 718 has a first guide member 722 extending upwardly and vertically therefrom and which is disposed in one of the tracks 714 in the upper housing member. The first link 718 further includes a second guide member 724 extending downwardly and vertically therefrom, and which is disposed in one of the tracks 706 in the lower housing member. The second link 720 has a first guide member 726 extending upwardly and vertically therefrom and which is disposed in the other track 714 in the upper housing member opposite the first track. The second link 720 further includes a second guide member 728 extending downwardly and vertically therefrom, and which is disposed in the other track 706 in the lower housing member. The first guide members 722, 726 of the links are further inserted or disposed in the slots 98 formed in the bottom of the fulcrum member. The second guide members 724, 728 are disposed or inserted in a pair of longitudinally extending tracks 730 formed in an actuator member, which is threadably engaged with the actuation screw 712, which is preferably, but not necessarily, double threaded. The various guide members 722, 724, 726, 728 define pivot axes between the links 718, 720 and the fulcrum member 90 and the actuator member 732.

In operation, the user rotates a knob 734, or grippable member, secured to the end of the screw 712. Preferably, the knob is visible to the user sitting in the chair and is located at approximately the handfall position of the user's right hand when seated in the chair. The knob is preferably circular and is shaped and dimensioned to be gripped in the palm of the user. In addition, the knob includes flexible fin regions spaced around the circumference thereof that can be gripped by the user's fingers. Preferably, the knob is rotated clockwise to increase the biasing force of the springs, and counterclockwise to decrease the force. Preferably, as the screw 712 is rotated, it threadably engages the actuator member 732 and moves it in a lateral direction. As the actuator member 732 is moved laterally, it moves the guide members 724, 728 in the arcuate tracks 706, as the guide members also move in the tracks 730 formed in the actuator member. Movement of the guide members 724, 728 causes the first and second links 718, 720 to pivot about the pivot axis 716, and thereby causes the guide members 722, 726 to move within the arcuate tracks 714 formed in the upper housing member. As the guide members 722, 726 move in the tracks 714, they engage the fulcrum member 90 and thereby move the fulcrum member in the longitudinal direction as the guide members 722, 724 move in the tracks 98 formed in the fulcrum member. Preferably, the torque required to adjust the position of the fulcrum member is less than about 5 lbf. In addition, preferably the fulcrum can be moved from its maximum to minimum biasing position with a maximum of 6 full revolutions of the knob. It should be understood that the various interfacing tracks and guide members can be formed or mounted on the opposite members as described herein without departing from the scope of this invention.

In alternative embodiment of the actuation mechanism, shown in FIGS. 60, 61, 69 and 70, a lead nut 1040 is threadably engaged on a threaded drive shaft, or lead screw 1042. The lead nut 1040 is disposed in a recess 1046 and captured by the middle portion 92 of the fulcrum member 90. As the drive shaft 1042 is rotated, it moves the lead nut 1040 and the fulcrum 90 to the desired position. Preferably, the drive shaft 1042 includes an end shaft portion 1044 that is rotatably supported at an opening 1050 formed between two gear housing members 1048, which are joined to form a gear housing. A bevel gear 1052 is also mounted on the drive shaft 1042, and is disposed in the gear housing. The bevel gear 1052 meshes with the bevel gear 810, which is mounted in the gear housing about an axis 1054 substantially perpendicular to the longitudinal axis of the drive shaft 1042. A bearing 1056 is disposed between the gear housing 1048 and the bevel gear 10. An actuation shaft 1058 extends through the pivot member 804 and tube 22 and includes a first end 1060 shaped and configured to non-rotatably mate with the bevel gear 810. An opposite second end of the shaft is connected to the knob 734.

In operation, the user rotates the knob 734, which rotates the shaft 1058 and the bevel gear 810. The bevel gear 810 meshes with and rotates the bevel gear 1052 and thereby rotates the drive shaft 1042, which in turn moves the lead nut 1040 and fulcrum 90.

As best shown in FIG. 70, the gear housing preferably includes a locator portion 1064 formed along the bottom thereof that is disposed in an opening 1068 formed in the bottom of the upper, inner housing member 936. The locator portion 1064 abuts the housing member 936 and prevents the gear housing 1048 from moving in the fore/aft direction, and also in the lateral direction. The gear housing 1048 further includes a locator portion 1066 formed on the front thereof that slides under a shoulder 1070 formed in the inner housing member 936. The locator portion abuts 1066 the shoulder 1070 and prevents the gear housing 1048 from rotation about the horizontal axis 1054 defined by the actuator shaft 1058. During assembly, the locator portion 1066 is first inserted under the shoulder 1070, and the gear housing 1048 is thereafter rotated such that the locator portion 1064 is disposed in the opening 1068. The springs 30, once installed, further prevent the gear housing 1048 from being displaced by applying a downward force to the gear housing 1048 by way of the fulcrum member 90 and drive shaft 1042.

In an alternative embodiment, the drive shaft can simply extend through the front wall of the housing, to which it is rotatably mounted. An adjustment knob can be secured to the drive shaft. In operation, rotation of the drive shaft threadably engages and moves the fulcrum member.

The slotted openings 74, 86, 986 formed in the front walls 68, 82, 982 of the housing members 34, 36, 936 defined cross members 83, 85. The pair of leaf springs 30 are installed in the chair by inserting an end 31 of each spring through one of the openings 74, 86, 986 such that a top surface of the spring 30 engages the cross member 83, 85. A tab member 87, 987 or protuberance extends downwardly from the cross member and is disposed in an opening 33 formed in the end of the spring to locate and restrain the movement of the spring in the longitudinal direction. Instead of a cross member formed integrally into the housing, a separate horizontal rod can be installed laterally in a forward portion of the housing so as to engage the top surface of the forward end of the spring.

The leaf springs 30 are constrained laterally within the housing by the sides of the center portion 92 of the fulcrum. The leaf springs 30 extend rearwardly within the housing 10 such that a bottom surface of the springs engages the support surface 96 of the fulcrum member 90. An end of the spring is inserted beneath the support member 320 or the edge of the spring link hook portion 1024 such that top surface engages support member 320, which preferably includes a bearing member 321, or spring link 1022. Although each spring 30 is shown as a single leaf, it should also be understood that multi-leaf springs could also be employed. The leaf springs are preferably made of a composite material, such as a fiberglass and epoxy matrix, although it should be understood that other resilient materials such as steel would also work. The composite material can be a fibrous composite, a laminated composite or a particulate composite. A suitable composite spring is commercially available from Gordon Plastics, Inc. of Montrose, Colo. under the specification designation of GP68-UD Unidirectional Fiber Reinforced Bar Stock, and sold under the tradename POWER-TUFF. The fiberglass/epoxy matrix bar preferably is unidirectional with a glass content of about 68% and a laminate density of 0.068 lbs./in.$^3$. The bar preferably has a flexstrength of about 135,000 psi, a flex modulus of about 5,000,000 psi, and an ultimate strain of about 2.4%. The use of a composite material bar can help eliminate the problems associated with creep. Another suitable spring is unidirectional fiberglass 70±2% by weight 30% vinyl esther hi-performance resin. The shape, size (width, thickness, length) and material of the springs can be varied to provide various spring characteristics. In addition, the spring can be compression molded in various curved shapes to provide unique tilt balance and ride options.

In operation, the end 84 of the leaf spring 30 biases the support member 320, the back support 304 and the seat support 202, via the back support and armrests, in an upward direction so as to thereby support a user sitting in the chair. The opposite end of the spring engages the cross member 83, 85 or rod mounted in the housing, while an intermediate portion of the spring is supported by the fulcrum member 90. In this way, the spring 30 acts as a simply supported beam with a load imparted intermediate the supported ends thereof. To adjust the force applied to the back support, the user simply actuates the linkage assembly which moves the fulcrum member in a linear, longitudinal direction within the housing. It should be understood that the spring biases the seat support by way of the back support, and that in alternative embodiments, the spring can bias the back support and seat support through a common element, such as with a pivot member that pivotally connects those members, or can directly bias the seat support and also the back support. In any of these embodiments, it should be understood that the springs are biasing each of the seat support and back support, individually and in combination.

As the fulcrum member 90 is moved rearwardly in the housing 10, the distance between the point of support at the front of the housing and the support member is decreased, so as to correspondingly increase the force applied by the rear end of the spring. Conversely, the fulcrum member 90 can be moved forwardly in the housing 10 to decrease the amount of resistive force applied to the seat support and back support by increasing the beam length, or the distance between the fulcrum 90 and the support member 320 or spring link 1022. Since the leaf spring 30 is simply supported at each end, rather being clamped to the housing, the pivot rod (or spring link) or both, bending moments are not introduced at the ends of the spring. When clamped, the properties of the spring, and the amount of the clamping, can effect the loading and associated stresses. Moreover, by providing a simply supported spring, tolerances can be relaxed and the curvature of the spring is allowed to undulate as the beam length changes.

Because the leaf springs 30 are disposed in the housing 10 in a side-by-side arrangement, and are preferably formed as flat bars, the housing can be made more compact at lower cost in an aesthetically pleasing way. This advantage is even more apparent when the leaf spring arrangement is combined with the three bar mechanism. Moreover, the resistive force of the spring can be adjusted easily and simply by slideably moving the fulcrum 90 within the housing 10. Since the resistive force is determined by the beam length, rather than by prestressing the spring, the adjustment does not require a progressively larger actuation force as is typically associated with torsion springs and bars and compression springs.

Tilt Limiter:

Referring to FIGS. 52–57, one preferred tilt limiter mechanism is shown. Although the tilt limiter is shown as having a mechanism secured to the back support, with the stop members 602, 614 mounted to the housing, or base, it should be understood that the location of those aspect could be reversed, or alternatively, could be operative between a seat support and a housing, or base.

In a preferred embodiment, the tilt limiter mechanism includes a U-shaped bracket 622 having a rear wall 624, a pair of side walls 626 and a pair of mounting flanges 628 secured to the back support. It should be understood that the bracket could be formed integrally with the back support. The tilt limiter includes an upper and lower tilt limiter member 630, 632 slideably mounted to the back support on a guide member 634 that extends through a slot 636 formed in the back support and has an upper and lower guide portion 638, 640 extending upwardly and downwardly from the support member respectively. In particular, each tilt limiter member includes a track 642, 644 disposed on one of the guide portions.

Figure 55:
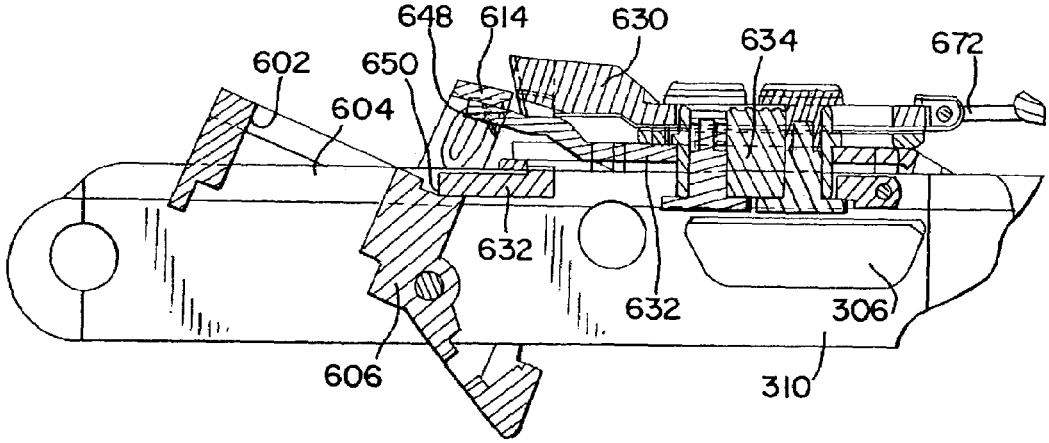
FIG. 55 is a partial cross-sectional view of the back support secured in a forward tilt position.

The upper tilt limiter member 630 includes a upwardly facing stop surface 646, which is provided with a curved contour to mate with the lower surface 620 of the stop member 614 when the upper tilt limiter member is moved forwardly under the stop member 614. In this way, the upper tilt limiter member 630 limits the forward tilt of the back support and attached seat as it engages the stop member 614. In operation, the tilt limiter member 630 is slid rearwardly such that the back support 304 can pivot forwardly until a curved lip 648 formed on a leading edge of a back support cross member that extends between the arm portions 310 engages the stop member 614 to define a forward tilt position, as shown in FIG. 55. In this position, the lower tilt limiter member 632 can be moved forwardly to engage an uppermost step 650 on the stop block, such that the backrest is locked in the forward tilt position.

Figure 56:
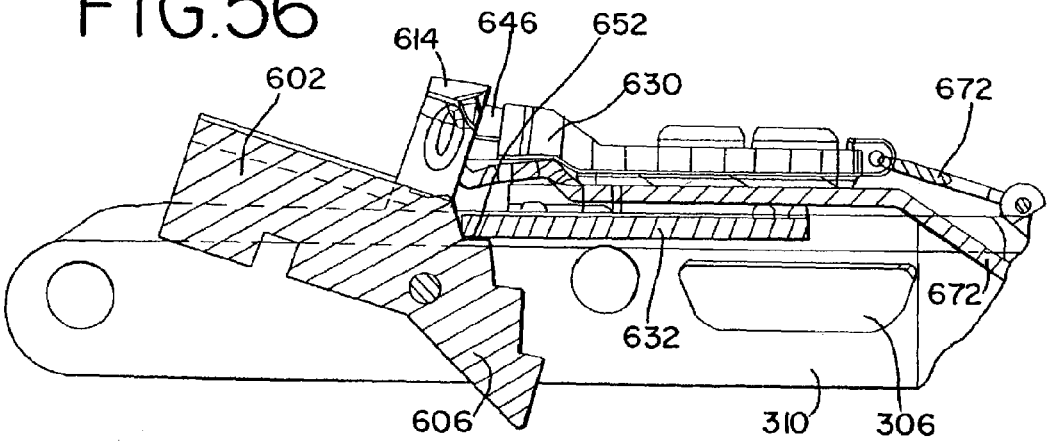
FIG. 56 is a partial cross-sectional view of the back support secured in an at-rest neutral position.
Figure 57:
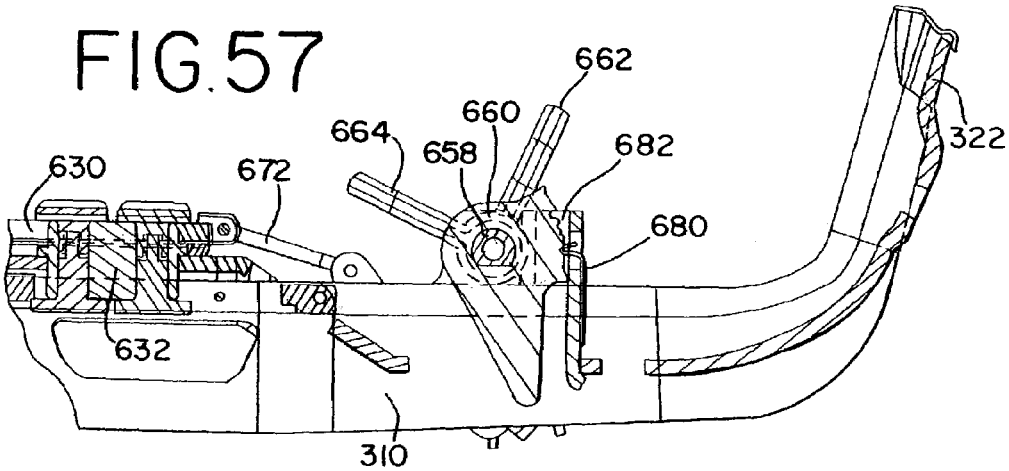
FIG. 57 is a partial cross-sectional view of a portion of the tilt limiter mechanism.

The backrest, and chair, can also be locked in a neutral, or upright position, as shown in FIG. 56, by engaging the upper stop 614 with the upper tilt limiter member 630 and by engaging a next lower step 652 from the uppermost step with the lower tilt limiter member 632. Other rear tilt positions can be limited by moving the lower tilt limiter member 632 to various positions such that it selectively engages one of the next lower steps 610 on the stop member 602. Preferably, the steps are arranged and dimensioned to provide tilt limit positions at 5 degree tilt intervals.

Figures 52, 53:
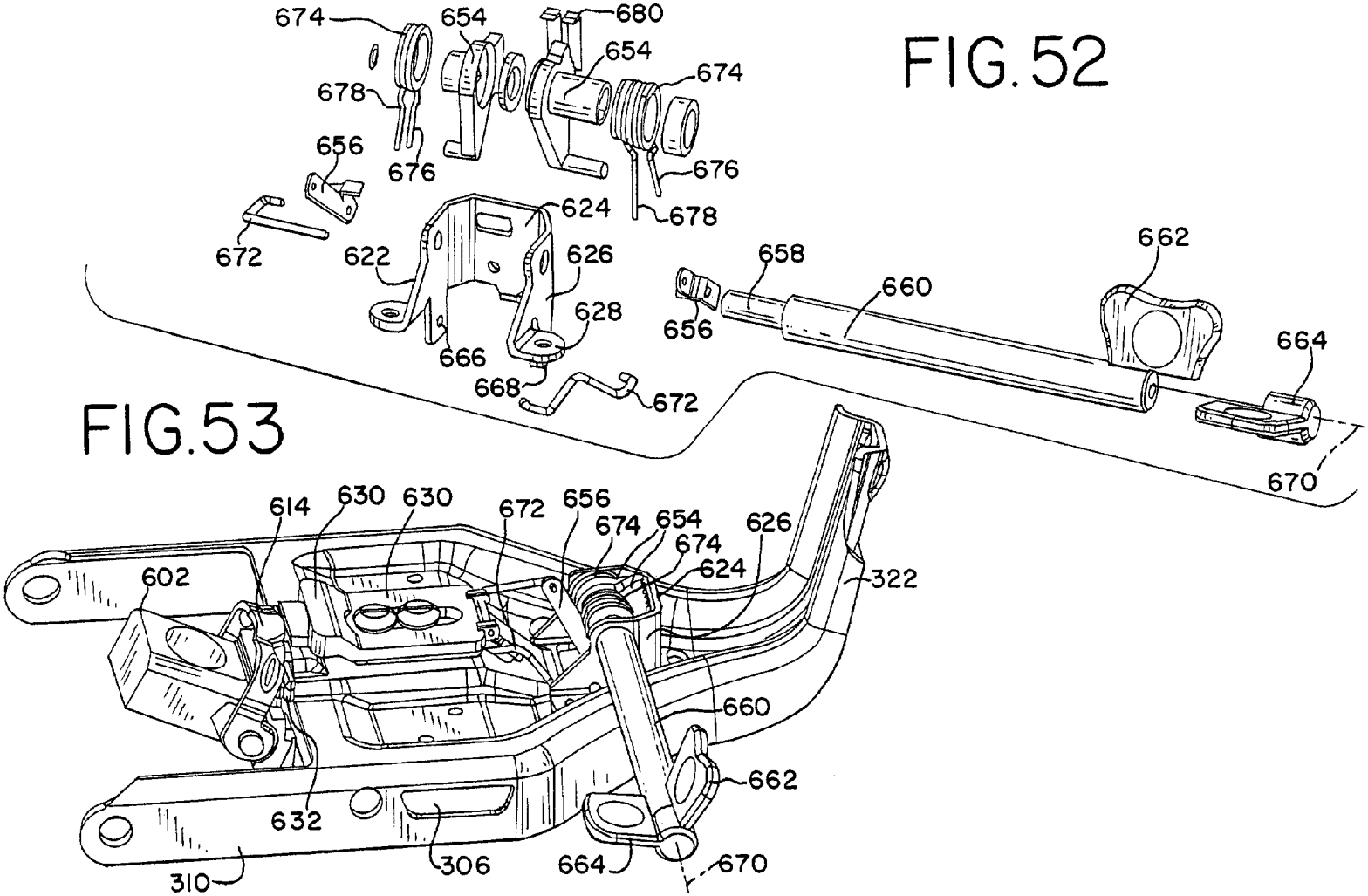
FIG. 52 is an exploded perspective view of a tilt limiter mechanism.
FIG. 53 is a perspective view of the back support and tilt limiter assembly.
Figure 54:
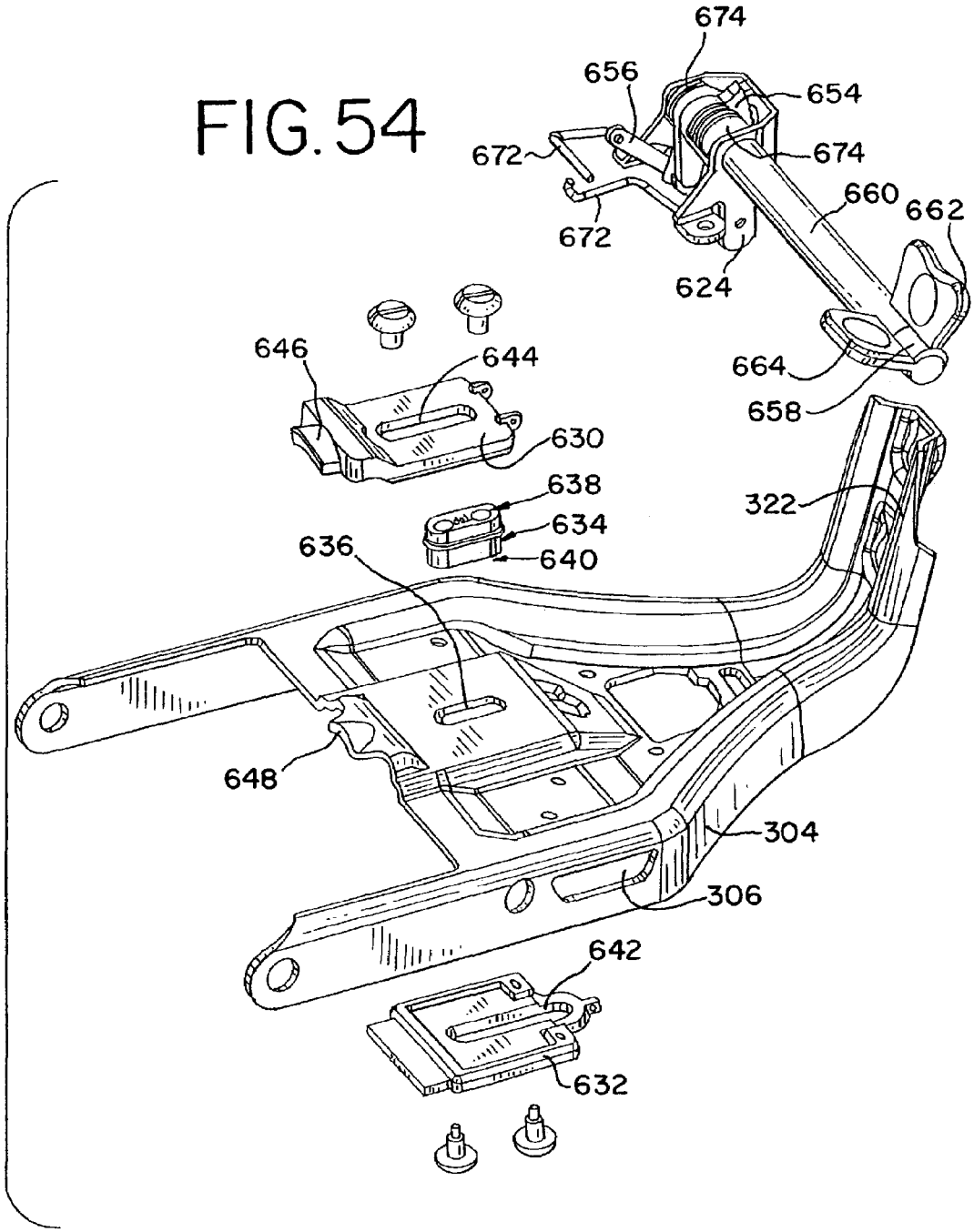
FIG. 54 is an exploded perspective view of the back support and tilt limiter assembly.

Each tilt limiter member 630, 632 is moved in the longitudinal direction using an actuator mechanism. The actuator mechanism includes a pair of drive links 654 mounted to a first and second coaxially mounted pivot members 658, 660, each having a grippable portion, or paddle mounted to an end thereof. The shape of the paddles are configured to resemble the shape of the overall chair, as shown in FIG. 53. In particular, the position of the upstanding paddle, which is preferably used to adjust the position of the rear tilt limiter, provides indicia to the user about the setting of the tilt limiter and the maximum rear tilt position thereof, even when the chair is not in such a position. Likewise, the substantially horizontal paddle, which is preferably used to adjust the position of the forward tilt limiter, provides indicia to the user about the setting of the forward tilt limiter, even when the chair is not in such a position. The pivot members 658, 660 are rotatably mounted to the bracket about a horizontal axis of rotation. It should be understood that the drive links and pivot members can be mounted about spaced apart, and even non-parallel, axes of rotation.

A pair of follower links 656 each have a first end are pivotally mounted to the bracket 624 at a first and second pivot axis 666, 668, which are spaced from the horizontal axis of rotation, and which are preferably, but not necessarily coaxial. A second end of the follower links 656 are each pivotally mounted to a coupling link 672, which is further pivotally mounted to the tilt limiter members 630, 632. It should be understood that the follower links can be directly coupled to the tilt limiter members without an intervening or intermediate coupling link.

A pair of springs 674 are mounted on the pivot member about the axis. Each spring includes a first arm 676 engaging a lug on one of the drive links 654 and a second arm 678 engaging a lug on one of the follower links 656. A pair of indexing members 680, formed as cantilever springs are mounted to the rear wall 624 of the bracket 622 and selectively engage racks 682 formed on the drive members 654.

In operation, the user rotates one of the levers 662, 664 to a desired tilt limiter position determined by the indexing member 680, which in turn pivots a corresponding drive link 654 and an associated arm 676 of the spring 674. If there is no load on the seat and backrest creating a frictional force between the tilt limiter member 630, 632 and the stop member 602, 614, the other arm of the spring 678 moves the follower link 656, coupling link 672 and the connected tilt limiter member 630, 632 to the desired position. However, if a load is applied to create a friction force between the tilt limiter member 630, 632 and the stop member 614, 606, the spring 674 will simply load up, but will not move the tilt limiter member until the user removes the load, wherein the spring 674 moves the tilt limiter to the selected position. In this way, the user is provided with pressure release mechanisms for both the forward and rear tilt limiters. The various drive and follower links can be made of metal or plastic, or other suitable materials know to those of skill in the art.

In an alternative preferred embodiment, best shown in FIGS. 60 and 63–65, tilt limiter members 1080, 1082 are pivotally mounted to the tilt housing, and in particular the outer housing 934, and releasably engage the back support member 308. In particular, a forward tilt limiter member 1080 includes a base portion 1084 pivotally mounted about a substantially horizontal axis between a pair of rearwardly facing lugs 1086 formed on the upper housing member 936.

The tilt limiter member 1080 is mounted on a pivot axle 1088 about a pivot axis 1098, although it should be understood that such an axle could be formed integrally with the tilt limiter member. The tilt limiter member includes 1080 a stop arm 1090 extending outwardly, radially from the base portion 1084. The tilt limiter member 1080 further includes a pair of limiter arm members 1092 extending from the base portion and defining a space 1094 therebetween. The tilt limiter member 1080 further includes a pivot axis opening 1098 spaced apart from the axis in a substantially parallel relationship therewith. Finally, the tilt limiter member includes a notch 1100 or groove formed on one of the tilt limiter arms 1092 opposite the other of the arms.

In operation, the tilt limiter member 1080 is rotated between a forward tilt position, wherein the stop arm 1090 is pivoted such that it extends over the central portion 1016 of the back support web edge 1014 and engages the top surface of the web 1010, and a normal operating position, wherein the stop arm 1090 is pivoted downwardly such that the central portion 1016 of the back support engages the base portion 1084 of the tilt limiter member 1080. The rearwardly facing edge 1102 of the upper housing member 936 is disposed in the space 1094 between the tilt limiting arms 1092, which define and limit the rotation of the tilt limiter member between the normal and forward tilt positions. In addition, an over-center spring 1104 is mounted to the upper housing member and engages the notch 1100, and biases the tilt limiter member to one or the other of the normal and forward tilt positions.

Figure 63:
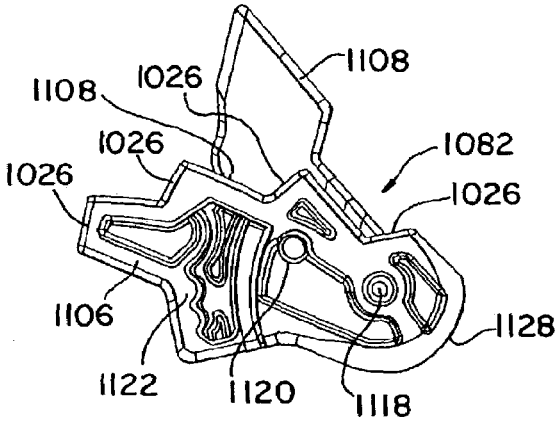
FIG. 63 is a side view of a rear tilt limiter.
Figure 64:
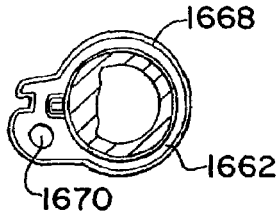
FIG. 64 is a partial cross-sectional view of a tilt limiter drive member.

Referring to FIGS. 60 and 63, the rearward tilt limiter member 1082 includes a pair of spaced apart stop members 1106 connected with a U-shaped connector 1108 or bridge. The tilt limiter member 1082 is pivotally mounted to the lower housing member 936 about a pivot axis 1110. In one preferred embodiment, the stop members 1106 each have an inwardly extending pivot member 1112 that are pivotally disposed in a pair of openings 1114 formed on side walls of a center portion 1116 of the upper housing. A pivot member, axially aligned with the pivot members 1112, is further secured through the outer side wall 966 of the lower housing member and pivotally engages an opening 1118 in the opposite outer sides of the stop members. The pivot members can also be integrally formed with the tilt limiter member. To install the tilt limiter member 1082, the connector 1108 is flexed such that the pivot members 1112 can be snapped into engagement with the housing member 934. The outer pivot members can then be installed to pivotally connect the tilt limiter member 1082 to the housing member 936. The tilt limiter member 1082 further includes an opening 1120 spaced apart from the pivot axis 1110. In addition, the tilt limiter member 1082 has a rack 1122, or a plurality of indexing notches, formed along an outer side portion of the stop members. A detent 1124, such as a spring, is selectively engaged with one or more of the indexing notches 1122 as the tilt limiter member 1082 is pivoted between various rear tilt positions.

Each stop member 1106 has a stepped profile or contour defining a plurality of steps 1126 and corresponding stop surfaces. In addition, the bottom surface 1128 of the stop member is curved and engages the bottom wall 960 of the housing member 934, which is shaped to support the bottom surface. In this way, the loads applied to the stop members 1106 by the back support 308 are carried by the housing member 934, rather than the pivot members 1112.

In operation, the tilt limiter member 1082 is pivoted between a plurality of tilt limiter positions, wherein the back support side portions 1018 engage one of the steps 1126 of the tilt limiter. In one embodiment, the tilt limiter member has four positions, although other pluralities of steps and positions are suitable.

Referring to FIGS. 60 and 63–65, each tilt limiter member is rotated about a respective pivot axis using an actuator mechanism similar to that described above. The actuator mechanism includes a pair of drive links 1654 matingly engaged with and mounted to a first and second coaxially mounted pivot members 1658, 1660, each having a grippable portion, or paddle mounted to an end thereof, with the paddles arranged and configured as described above. The drive links 1654 preferably each include a tubular pivot portion 1662 and an arm 1664 extending laterally therefrom. The arm 1664 includes an opening 1666 formed in an end portion thereof. The first drive link 1654 is inserted through and pivotally engaged with the opening 1006 in one of the side walls 966 of the housing member 934, with the arm 1666 positioned inside the housing. The drive link 1654 includes an annular flange 1668 that engages the outer surface of the housing side wall 966 and prevents the drive link from being pulled through the opening 1006. In one embodiment, wherein the seating structure is configured without a tilt limiter, the drive link 1654 is disabled simply by inserting a fastener through an opening 1670 formed in the annular flange and securing the drive link to the housing in a non-rotatable relationship. A drive shaft 1672 connected to a paddle is inserted into the drive link 1654. The drive shaft 1672 includes a circumferential groove 1674 that engages the drive link 1654 with a snap fit. On the opposite side of the housing, a second drive link 1654 is inserted through the opening 1006, with an annular flange engaging the outer surface of the side wall 966 and with the arm 1664 disposed inside the housing. The drive shaft 1672 extends through the pivot member 1658 and the near drive link 1654 and captures the near drive link 1654 and pivot member 1658 and secures them to the housing as the drive shaft 1672 is snap fitted with the drive link 1654 on the opposite side.

The pivot members 1658, 1660 are rotatably mounted to the housing about a horizontal axis of rotation. It should be understood that the drive links 1654 and pivot members 1658, 1660 can be mounted about spaced apart, and even non-parallel, axes of rotation.

A first follower link 1700 has a first end pivotally mounted to the drive link 1654 at a first pivot axis. A second end of the follower link is pivotally mounted to the forward tilt limiter member 1080 at the opening 1096. A second follower link 1702 has a first end pivotally mounted to the drive link 1654 at a first pivot axis. A second end of the follower link 1702 is pivotally mounted to the rear tilt limiter member at the opening 1120.

In operation, the user rotates the rearward or forward pivot member 1658, 1660, for example by gripping a paddle member 1802, 1804. As the pivot member 1658, 1660 is rotated, the drive link 1654 is pivoted, which in turn moves the follower link 1700, 1702 and the corresponding tilt limiter member 1080, 1082 to the desired position. A pair of triangular shaped arm members 1083 formed on the tilt limiter member 1082 hold the ends of the follower links in engagement therewith.

As shown in FIGS. 58 and 60, the paddle members 1802, 1804, or actuators, are pivotable about the same axis. Preferably, the paddle member 1802, which controls the forward tilt limiter, is oriented in generally the same orientation as the seat, e.g., in a generally horizontal orientation, while the paddle member 1804, which controls the rear tilt limiter or the tilt of the back and back, is oriented in generally the same orientation as the back. In addition, the paddle members are arranged adjacent one another in generally the same relationship as the seat and back. In addition, the paddle member 1804 is generally shaped like the back member. In this way, the paddle members 1802, 1804 provide indicia and are intuitive to the user for control of the rear tilt and forward tilt. Of course, the paddle members, and their orientation and shape, could be suitable for controlling other adjustment mechanisms, and preferably adjustment mechanisms associated with the seat and back respectively.

Various aspects of the seating structure are also disclosed in U.S. Provisional Application No. 60/356,478, filed Feb. 13, 2002, and U.S. Provisional Application No. 60/418,483, filed Oct. 15, 2002, the same day as the present application and entitled "Backrest For A Seating Structure With An Adjustable Sacral Support," both of which are hereby incorporated herein by reference.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A backrest for a seat structure, the backrest comprising:

a frame member;

a compliant, resilient back member having a top, a bottom and opposite sides, wherein said back member is mounted to said frame member, said back member comprising a lumbar region, a thoracic region disposed above said lumbar region, and a lower region disposed below the lumbar region, wherein said lumbar region comprises a first array of openings formed therethrough, said first array comprising a first plurality of staggered, elongated openings, wherein said first plurality of said first array openings are elongated in a direction from the top to the bottom of the back member, and wherein said thoracic region comprises a second array of openings formed therethrough, said second array comprising a second plurality of staggered, elongated openings, wherein said second plurality of said second array openings are elongated in a direction from the top to the bottom of the back member, wherein said first plurality of openings have a greater elongation on average than said second plurality of openings, and wherein second plurality of staggered, elongated openings comprises at least two adjacent vertical columns of openings, wherein said adjacent vertical columns of openings are offset in a vertical direction from said top to said bottom of said back member such that said openings in said adjacent vertical columns are not horizontally aligned.

2. The invention of claim 1 wherein said lower region comprises a third array of openings formed therethrough, said third array comprising a third plurality of staggered, elongated openings, wherein said first plurality of openings have a greater elongation on average than said third plurality of openings.

3. The invention of claim 2 wherein said third plurality of staggered, elongated openings transition from a longitudinal orientation to a lateral orientation.

4. The invention of claim 3 wherein said laterally oriented openings define a generally triangular pattern positioned along a centrally located longitudinally extending axis of said back member, said axis extending from said top to said bottom of said back member.

5. The invention of claim 1 wherein back member has a first thickness at a center portion of said lumbar region and a second thickness at a peripheral side portion of said lumbar region, wherein said second thickness is greater than said first thickness.

6. The invention of claim 1 wherein said back member comprises a peripheral portion defining a periphery of said back member, wherein said peripheral portion comprises a plurality of openings formed therethrough.

7. The invention of claim 1 wherein said back member is bowed at said lumbar region.

8. The invention of claim 1 wherein said back member is made of polypropylene.

9. The invention of claim 1 wherein said top of said back member comprises a curved portion defining a convex forward body support surface along a peripheral portion of said back member.

10. The invention of claim 1 wherein said frame member is secured to said back member at a pair of spaced apart upper locations forming a gap therebetween and a lower location, wherein said back member bridges said gap and is free of any attachment to said frame between said pair of spaced apart upper locations.

11. The invention of claim 10 wherein said upper locations are spaced from said top of said back member.

12. The invention of claim 1 further comprising a lumbar support member connected to said frame and engaging a rear surface of said back member in said lumbar region thereof.

13. The invention of claim 1, wherein said first and second arrays of openings transition from an obround shape to a substantially circular shape between first and second locations, wherein said second location is spaced above said first location.

14. The invention of claim 13 wherein said lower region comprises a third array of openings, wherein said first and third arrays of openings further transition from said obround shape to said peanut-shape to said substantially circular shape between said first location and a third location, wherein said third location is spaced below said first location.

15. The invention of claim 1 wherein said first plurality of staggered, elongated openings comprises at least two adjacent vertical columns of openings, wherein said adjacent vertical columns of openings are offset in a vertical direction from said top to said bottom of said back member such that said openings in said adjacent vertical columns are not horizontally aligned.

16. The invention of claim 1 wherein said back member has a molded non-planar, three-dimensional shape formed along a longitudinally extending centerline independent of any component being engaged therewith.

17. A backrest for a seat structure, the backrest comprising:

a frame member;

a compliant, resilient back member having a top, a bottom and opposite sides, wherein said back member is mounted to said frame member, said back member comprising a lumbar region, a thoracic region disposed above said lumbar region, and a lower region disposed below the lumbar region, wherein said lumbar region comprises a first array of openings formed therethrough, said first array comprising a first plurality of staggered, elongated openings, wherein said first plurality of said first array openings are elongated in a direction from the top to the bottom of the back member, and wherein said thoracic region comprises a second array of openings formed therethrough, said second array comprising a second plurality of staggered, elongated openings, wherein said second plurality of said second array openings are elongated in a direction from the top to the bottom of the back member, wherein said first plurality of openings have a greater elongation on average than said second plurality of openings; and a lumber support member connected to said frame and engaging a rear surface of said back member in said lumbar region there, wherein said lumbar support member comprises a laterally extending lumbar frame connected to said frame member and a flexible belt member mounted on said lumbar frame and engaging said rear surface of said back member.

18. The invention of claim 17 wherein said lumbar frame is bow shaped.

19. A backrest for a seating structure, the backrest comprising:

a frame member comprising an upper support member and a lower support member spaced from said upper support member, said upper support member having opposite shoulder portions, wherein said frame member further comprises a lumbar support disposed between said upper and lower support members;

a fabric member having a front, body-supporting surface and a rear surface and comprising at least one pocket received on said opposite shoulder portions, and wherein said fabric member is connected to said lower support member and extends in tension between said upper and lower support members, and wherein said fabric member comprises a central thoracic region that is free of contact on said rear surface thereof, wherein said lumbar support comprises a lumbar frame member having opposite ends and a belt member extending between said opposite ends, and wherein said belt member engages said rear surface of said fabric.

20. A backrest for a seat structure, the backrest comprising:

a frame member;

a compliant, resilient back member having a top, a bottom and opposite sides, wherein said back member is mounted to said frame member, said back member comprising a lumbar region, a thoracic region disposed above said lumbar region, and a lower region disposed below the lumbar region, wherein said lumbar region comprises a first array of openings formed therethrough, said first array comprising a first plurality of staggered, elongated openings, wherein said first plurality of said first array openings are elongated in a direction from the top to the bottom of the back member, wherein said thoracic region comprises a second array of openings formed therethrough, said second array comprising a second plurality of staggered, elongated openings, wherein said second plurality of said second array openings are elongated in a direction from the top to the bottom of the back member, wherein said first plurality of openings have a greater elongation on average than said second plurality of openings, and wherein said lower region comprises a third array of openings formed therethrough, said third array comprising a third plurality of staggered, elongated openings, wherein said first plurality of openings have a greater elongation on average than said third plurality of openings, and wherein said third plurality of openings transition from a longitudinal orientation to a lateral orientation, wherein at least some of the third plurality of openings are curved inwardly from said longitudinal orientation to said lateral orientation.

21. A backrest for a seat structure, the backrest comprising:

a frame member;

a compliant, resilient back member having a top, a bottom and opposite sides, wherein said back member is mounted to said frame member, said back member comprising a lumbar region, a thoracic region disposed above said lumbar region, and a lower region disposed below the lumbar region, wherein said lumbar region comprises a first array of openings formed therethrough, said first array comprising a first plurality of staggered, elongated openings, wherein said first plurality of said first array openings are elongated in a direction from the top to the bottom of the back member, wherein said thoracic region comprises a second array of openings formed therethrough, said second array comprising a second plurality of staggered, elongated openings, wherein said second plurality of said second array openings are elongated in a direction from the top to the bottom of the back member, wherein said first plurality of openings have a greater elongation on average than said second plurality of openings, and wherein said lower region comprises a third array of openings formed therethrough, said third array comprising a third plurality of staggered, elongated openings, wherein said first plurality of openings have a greater elongation on average than said third plurality of openings, wherein said third plurality of staggered, elongated openings comprises at least two adjacent vertical columns of openings, wherein said adjacent vertical columns of openings are offset in a vertical direction from said top to said bottom of said back member such that said openings in said adjacent vertical columns are not horizontally aligned.

* * * * *